US005300419A

United States Patent [19]

Seto et al.

[11] Patent Number: 5,300,419

[45] Date of Patent: Apr. 5, 1994

[54] SILVER HALIDE COLOR PHOTOGRAPHIC MATERIAL

[75] Inventors: Nobuo Seto; Hiroyuki Yoneyama; Masakazu Morigaki; Hidekazu Sakai; Hidetoshi Kobayashi; Shigeru Yamazaki, all of Kanagawa, Japan

[73] Assignee: Fuji Photo Film Co., Ltd., Kanagawa, Japan

[21] Appl. No.: 888,858

[22] Filed: May 27, 1992

[30] Foreign Application Priority Data

May 28, 1991 [JP] Japan ..... 3-150897
Jan. 22, 1992 [JP] Japan ..... 4-29904

[51] Int. Cl.[5] ..... G03C 7/34; G03C 7/392

[52] U.S. Cl. ..... 430/551; 430/552; 430/553; 430/607

[58] Field of Search ..... 430/552, 553, 607, 551

[56] References Cited

U.S. PATENT DOCUMENTS

| | | | |
|---|---|---|---|
| 4,910,128 | 3/1990 | Kamio et al. | 430/553 |
| 5,047,314 | 9/1991 | Sakai et al. | 430/553 |
| 5,190,853 | 3/1993 | Seto et al. | 430/607 |
| 5,219,724 | 6/1993 | Kato et al. | 430/607 |

FOREIGN PATENT DOCUMENTS

| | | | |
|---|---|---|---|
| 2270954 | 11/1987 | Japan | 430/551 |
| 63-220142 | 9/1988 | Japan . | |
| 63-256951 | 10/1988 | Japan . | |
| 1-147455 | 6/1989 | Japan . | |
| 3220142 | 9/1989 | Japan | 430/551 |
| 2-141745 | 5/1990 | Japan . | |
| 2-148035 | 6/1990 | Japan . | |

*Primary Examiner*—Lee C. Wright
*Attorney, Agent, or Firm*—Birch, Stewart, Kolasch & Birch

[57] ABSTRACT

Disclosed is a silver halide color photographic material containing at least one cyan dye forming coupler of the following general formula (C-1) and at least one compound of the following general formula (I) in the same layer of the material:

(C-1)

where $R_0$ represents an alkyl group, an alkenyl group, an aryl group, or a heterocyclic group;

X represents a hydrogen atom, or a group capable of being split off by a coupling reaction with the oxidation product of an aromatic primary amine color developing agent; and Ar represents an aromatic group;

(I)

where $R_1$, $R_2$ and $R_3$ each represent an aliphatic group, an aryl group, or a heterocyclic group;

$R_4$ represents a hydrogen atom, an aliphatic group, an aryl group, or a heterocyclic group;

$R_1$ and $R_2$, or $R_3$ and $R_4$ may be bonded to each other to form a 5-membered to 8-membered ring along with the nitrogen atom in the formula;

the compound of formula (I) may form a dimer or a higher polymer at the position of $R_1$, $R_2$, $R_3$ or $R_4$;

provided that $R_1$ and $R_3$, or $R_2$ and $R_4$ are not bonded to each other to form a ring, and that the sum of the carbon atoms of $R_1$, $R_2$, $R_3$ and $R_4$ is 6 or more.

26 Claims, No Drawings

SILVER HALIDE COLOR PHOTOGRAPHIC MATERIAL

FIELD OF THE INVENTION

The present invention relates to a silver halide color photographic material and, more precisely, to a silver halide color photographic material having an excellent color forming capacity. After development, the material has a final color image which is hardly faded or discolored and which is free from staining of the white background area (i.e. an increase of the density in the non-image area) during and after storage.

BACKGROUND OF THE INVENTION

A silver halide color photographic material generally has silver halide emulsion layers each being sensitive to three primary colors of red, green and blue. The material is processed by a so-called subtractive color process of reproducing a color image where the three couplers in the respective emulsion layers yield colors which are complementary to the colors to which the respective layers are sensitive. The color image to be obtained by processing such a silver halide color photographic material is generally composed of an azomethine dye or indoaniline dye to be formed by reaction of the oxidation product of an aromatic primary amine color developing agent with a coupler. The color photographic image thus obtained is not always stable to light or wet heat. When it is exposed to light for a long period of time or it is stored under the conditions of high temperature and high humidity, the color image is often faded or discolored or the white background area thereof is often stained, so that the quality of the thus exposed or stored image is deteriorated.

On the other hand, various efforts have been made for the purpose of more faithfully reproducing the color of the object to be photographed. As one means, couplers which have a high coloring capacity and which may yield dyes of good hue have been developed. However, the dyes to be formed from most of the couplers do not have sufficient color fastness and especially the color fastness thereof to light is insufficient. In addition, staining of the white background area is large when these couplers are used. Therefore, such couplers are not practical.

Fading and discoloration of the color images which are formed are fatal drawbacks for recording materials. In order to remove the drawbacks, an anti-fading agent or a stain inhibitor have been used. For the purpose of preventing deterioration of the image quality due to ultraviolet rays, an ultraviolet absorbent has been used. In order to overcome the drawbacks discussed above, various means have been proposed.

Examples of anti-fading, stain-inhibiting or ultraviolet-absorbing agents include, for example, known compounds such as hydroquinones, hindered phenols, catechols, gallates, aminophenols, hindered amines, chromanols, indanes and ethers or esters of these compounds as formed by silylating, acylating or alkylating the phenolic hydroxyl group therein, as well as metal complexes.

However, although these compounds have some effect as an anti-fading or anti-discoloring agent for color images, they are still insufficient for meeting the customers' need of desiring to have color images with higher image quality. In addition, these compounds often vary the color hue of the color images formed or often cause fogging of the photographic materials containing them. Further, these compounds can not be dispersed well in the coating emulsion. Also, after the emulsion containing these compounds has been coated on a photographic support, the compounds often form fine crystals. For these reasons, the above-mentioned compounds are not totally favorable as practical additives to color photographic materials.

Use of hydrazine compounds having particular structures for prevention of fading and discoloration of color photographic materials has been proposed in, for example, JP-A-63-220142, JP-A-63-229455, JP-A-63-256951, JP-A-62-270954, JP-A-2-148035 and JP-A-2-141745. (The term "JP-A" as used herein means an "unexamined published Japanese patent application".) However, the compounds as described in these patent publications do not have sufficient anti-fading, anti-discoloring and anti-staining effects. JP-A-2-141745 has proposed the use of hydrazine compounds with cyan couplers. However, the compounds described therein are almost ineffective when used in combination with the couplers of the present invention. JP-A-1-147455 has proposed the use of hydrazine compounds for the purpose of preventing color fogging (e.g. coloration of non-exposed area) and color mixing and for the purpose of improving photographic characteristics such as graininess. However, the compounds described therein are also almost ineffective when used along with the couplers of the present invention. In addition, the compounds described in the above-mentioned patent publications often cause fogging or retard coloration of couplers, or have some other bad effects on photographic characteristics. Further, some of the compounds have poor solubility and can not be coated normally.

On the other hand, staining of the color image is one serious problem for color photographs. Stains are unfavorable since they impair the clarity of the images formed and additionally impair the visual sharpness of the color images formed. In particular, in reflective photographic materials such as color printing papers, since the reflection density of stains is to be emphasized to theoretically several times the transmission density thereof, even weak and fine stains are an extremely important factor in deteriorating the image quality of the images formed.

In general, both processed and non-processed silver halide color photographic materials containing cyan coupler(s) of formula (C-1) often have yellow to red stains after being stored for a long period of time either in a dark place or in a light place. Such staining is a fatal problem especially when cyan coupler(s) of formula (C-1) is/are introduced in reflective photographic materials such as color printing papers. Under this situation, therefore, development of a technique capable of effectively inhibiting fading, discoloration and staining of photographic color images formed without having any bad effects on photographic characteristics is desired.

SUMMARY OF THE INVENTION

An object of the present invention is to provide a silver halide color photographic material capable of forming a color image which is neither discolored for a long period of time nor stained in the non-exposed area and which has excellent storability and storage stability.

Another object of the present invention is to provide a silver halide color photographic material containing a novel anti-fading agent which does not cause change in the color hue of the color image formed and does not retard coloration of the couplers contained in the material. The novel anti-fading agent in the material also does not cause fogging of the material and has a sufficient effect for preventing fading or discoloration of the cyan image formed. Additionally, after coating, it does not give any fine crystals on the material.

Still another object of the present invention is to provide a silver halide color photographic material containing a novel anti-fading agent which has excellent solubility in high boiling point organic solvents. Before and after coating, the agent does not give any fine crystals. In addition, the agent has no bad effects on other photographic additives.

Still another object of the present invention is to provide a silver halide color photographic material capable of forming a color image which is not discolored and is hardly stained in the non-exposed (white background) area under various storing conditions for a long period of time.

The present inventors variously investigated for the purpose of attaining the above-mentioned objects and, as a result, have found that the objects of the present invention can be attained by a silver halide color photographic material containing at least one cyan dye forming coupler of the following general formula (C-1) and at least one compound of the following general formula (I) in one and the same layer of the material:

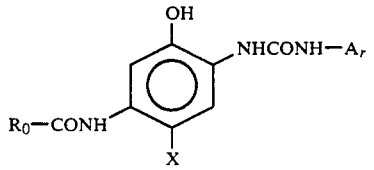

(C-1)

where $R_0$ represents an alkyl group, an alkenyl group, an aryl group, or a heterocyclic group;

X represents a hydrogen atom, or a group capable of being split off by a coupling reaction with the oxidation product of an aromatic primary amine color developing agent; and Ar represents an aromatic group;

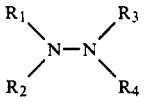

(I)

where $R_1$, $R_2$ and $R_3$ each represent an aliphatic group, an aryl group, or a heterocyclic group;

$R_4$ represents a hydrogen atom, an aliphatic group, an aryl group, or a heterocyclic group;

$R_1$ and $R_2$, or $R_3$ and $R_4$ may be bonded to each other to form a 5-membered to 8-membered ring along with the nitrogen atom in the formula;

the compound of formula (I) may form a dimer or a higher polymer at the position of $R_1$, $R_2$, $R_3$ or $R_4$; provided that $R_1$ and $R_3$, or $R_2$ and $R_4$ are not bonded to each other to form a ring, and that the sum of the carbon atoms of $R_1$, $R_2$, $R_3$ and $R_4$ is 6 or more.

DETAILED DESCRIPTION OF THE INVENTION

The aliphatic group as referred to herein may be linear, branched or cyclic and may be saturated or unsaturated. For example, the aliphatic group may be an alkyl group, an alkenyl group, a cycloalkyl group or a cycloalkenyl group. The heterocyclic group as referred to herein is one having hetero atom(s), such as oxygen, sulfur, nitrogen and/or selenium atom(s), in the ring(s) of the group, and the ring(s) may contain aromatic ring(s). The aliphatic group and aromatic group may further have one or more substituents. Such substituents include, for example, an aliphatic group, an aryl group, a heterocyclic group, an acyl group, an acyloxy group, an acylamino group, an alkoxy group, an aryloxy group, a heterocyclic oxy group, an alkoxycarbonyl group, an aryloxycarbonyl group, a heterocyclic oxycarbonyl group, a carbamoyl group, an alkylsulfonyl group, an arylsulfonyl group, a sulfamoyl group, a sulfonamido group, an alkylamino group, an arylamino group, an alkylsulfinyl group, an arylsulfinyl group, an alkylthio group, an arylthio group, a mercapto group, a hydroxyl group, a cyano group, a nitro group, a hydroxyamino group, and a halogen atom.

Specific examples of the aliphatic group as referred to herein include a methyl group, an ethyl group, a tert-butyl group, a cyclohexyl group, an allyl group, a benzyl group, a propargyl group, a methoxyethyl group, an n-decyl group, an n-dodecyl group, an n-hexadecyl group, an ethoxycarbonylethyl group, a phenethyl group, a phenoxyethyl group, a trifluoromethyl group, a heptafluoropropyl group, a dodecyloxypropyl group, a 2,4-di-tert-aminophenoxypropyl group, and a 2,4-di-tert-aminophenoxybutyl group.

Specific examples of the aryl group as referred to herein include a phenyl group, a tolyl group, a 4-methoxyphenyl group, a 2-tetradecyloxyphenyl group, a 3-hydroxyphenyltetradecyl group, a pentafluorophenyl group, a 2-chloro-5-dodecyloxycarbonylphenyl group, a 4-chlorophenyl group, a 3-cyanophenyl group, a 4-cyanophenyl group, a 4-hydroxyphenyl group, and a naphthyl group.

Specific examples of the heterocyclic group as referred to herein include a 2-pyridyl group, a 4-pyridyl group, a 2-furyl group, a 4-thienyl group, a quinolinyl group, and a 2-piperidyl group.

Cyan dye forming couplers of formula (C-1) for use in the present invention will be explained in detail hereinbelow.

In formula (C-1), $R_0$ represents an alkyl group, an alkenyl group, an aryl group or a heterocyclic group, which may optionally be substituted by any of the substituents for the aliphatic group mentioned hereinabove. Preferably, $R_0$ is an alkyl or alkenyl group having a total carbon number ("total carbon number" is hereinafter referred to as "C number") from 1 to 36, an aryl group having a C number from 6 to 48, or a heterocyclic group having a C number from 2 to 48; and more preferably, it is a tertiary alkyl group having from 4 to 36 carbon atoms, or a group of the following formula ($R_0$-1), ($R_0$-2), ($R_0$-3) or ($R_0$-4) having from 7 to 48 carbon atoms.

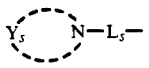

($R_0$-1)

where $Y_s$ represents a nonmetallic atomic group necessary for forming a 3-membered to 8-membered hetero ring along with the nitrogen atom in the formula; and $L_s$ represents an alkylene group.

The 3-membered to 8-membered hetero ring to be formed by $Y_s$ is a 3-membered to 8-membered (preferably, 5-membered to 7-membered) hetero ring having a C number of from 1 to 30 (preferably, from 1 to 24) and optionally further containing N, O, S, Se or Te atom(s) in the ring. It may be either a monocyclic ring or a condensed cyclic ring.

Examples of the monocyclic ring include a 1-pyrrolyl group, a 1-imidazolyl group, a 1-pyrazolyl group, a 1,2,4-triazol-1-yl group, a 1,2,4-triazol-4-yl group, a 1,2,3-triazol-1-yl group, a 1,2,3,4-tetrazol-1-yl group, a 1,2,3,4-tetrazol-2-yl group, and a 4-pyridon-1-yl group. Examples of the condensed ring include an indol-1-yl group, an indazol-1-yl group, a benzimidazol-1-yl group, a benzotriazol-1-yl group, a benzotriazol-1-yl group, a carbazolyl group, a purin-1-yl group, and a xanthen-1-yl group.

Preferably, the group of $Y_s$ is a 1-imidazolyl group, a 1-pyrazolyl group, a 1,2,4-triazol-1-yl group, a 1,2,3,4-tetrazol-1-yl group, a 1,2,3,4-tetrazol-2-yl group, a benzimidazol-1-yl group, a benzotriazol-1-yl group, a benzotriazol-2-yl group, or a 1,2,3-triazol-1-yl group; and more preferably, it is a 1-pyrazolyl group, a 1,2,4-triazol-1-yl group, a 1,2,3,4-tetrazol-2-yl group, a benzotriazol-2-yl group, or a 1,2,3-triazol-1-yl group.

The hetero rings may have substituent(s) and examples of the substituents include a halogen atom, a nitro group, a cyano group, a carboxyl group, an alkyl group, an aryl group, a heterocyclic group, an alkoxy group, an aryloxy group, an alkylthio group, an arylthio group, an acyl group, a sulfonyl group, an amino group, an alkoxycarbonyl group, an acyloxy group, a carbonamido group, a sulfonamido group, a carbamoyl group, a sulfamoyl group, a ureido group, and an alkoxycarbonylamido group.

Specific examples of hetero rings to be formed by Ys are mentioned below.

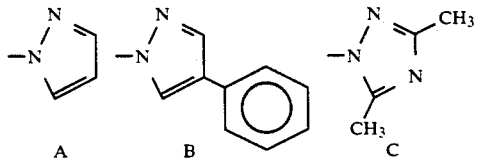
A

B

C

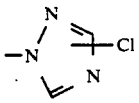
D

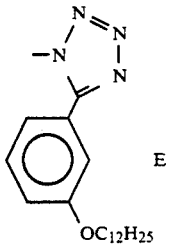
E

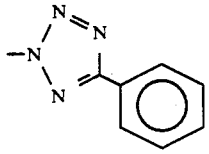
F

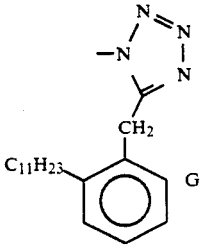
G

-continued

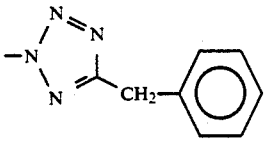
H

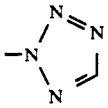
I

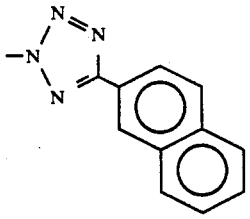
J

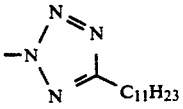
K

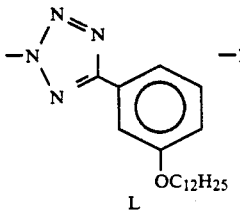
L

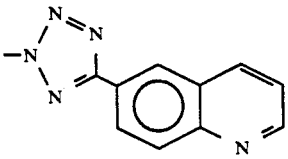
M

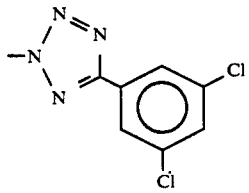
N

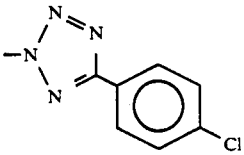
O

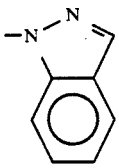
P

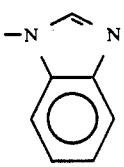
Q

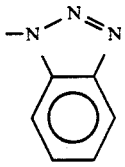
R

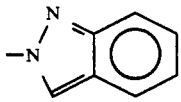
S

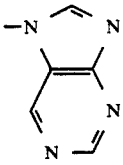
T

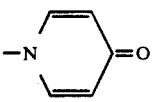
U

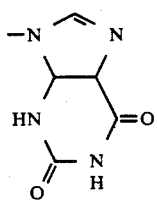
V

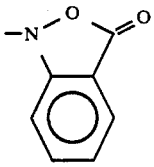
W

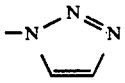
X

In formula ($R_0$-1), $L_s$ is preferably an alkylene group having a C number from 1 to 30, more preferably from 1 to 18; and it may optionally have substituent(s) selected from, for example, a halogen atom, an aryl group, an alkoxy group, an aryloxy group and an alkoxycarbonyl group.

$L_5$ is preferably a group of a general formula ($L_5$-1):

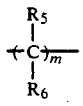

($L_5$-1)

where $R_5$ and $R_6$ each represents a hydrogen atom, an alkyl group, a cycloalkyl group, an aryl group, an alkoxy group, an aryloxy group, or an alkoxycarbonyl group; and m represents an integer of from 1 to 6. When m is a plural number, then, plural $R_5$'s and $R_6$'s each may be same or different In formula ($L_5$-1), $R_5$ and $R_6$ each is preferably a hydrogen atom, a straight chain or branched alkyl group, or an aryl group. $R_5$ is more preferably a hydrogen atom, or an alkyl group, and it is especially preferably a hydrogen atom. $R_6$ is more preferably an alkyl group having a C number from 4 to 40, or an aryl group, and it is especially preferably an alkyl group having a C number from 4 to 25.

Specific examples of Ls are mentioned below.

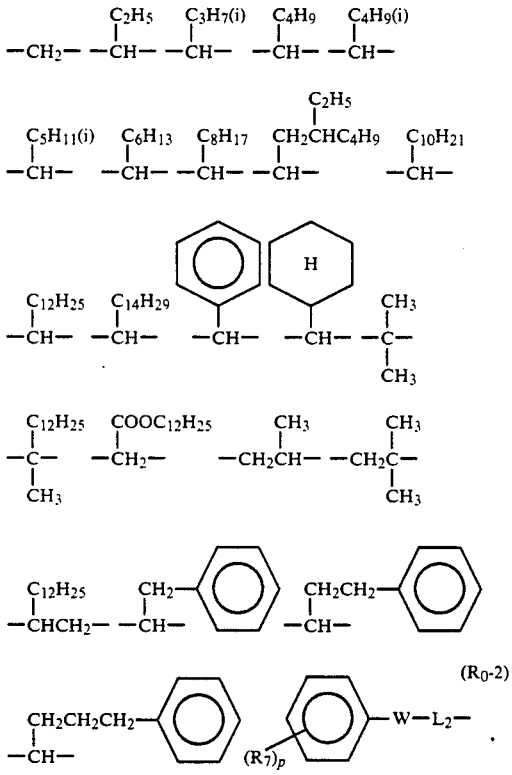

($R_0$-2)

where $L_2$ has the same meaning as Ls in formula ($R_0$-1);

W represents —O—, —S—, —SO—, or —$SO_2$—;

$R_7$ represents a monovalent substituent; and p represents 0 or an integer from 1 to 5, and when p is a plural number, then plural $R_7$'s may be the same or different.

W is preferably —O—. $R_7$ is preferably a halogen atom, an alkyl group, an alkoxy group, a carbonamido group, a sulfonamido group, a carboxyl group, a sulfo group, a cyano group, a hydroxyl group, a carbamoyl group, a sulfamoyl group, an alkoxycarbonyl group, or an arylsulfonyl group.

Specific examples of $R_0$ represented by formula ($R_0$-2) include a 1-(2,4-di-tert-amylphenoxy)pentyl group, a 1-(2,4-di-tert-amylphenoxy)heptyl group, a tert-butyl group, and a tert-pentyl group.

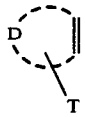

($R_0$-3)

In formula ($R_0$-3), D represents a nonmetallic atomic group necessary for forming a 3-membered to 8-membered hetero ring along with the carbon-carbon double bond in the formula, and the ring may optionally be a condensed ring. Suitable hetero atoms to be in the hetero ring include N, O, S, Se and/or Te. Preferred are N, O and S. Preferably, the hetero ring includes a pyridine ring, a pyrazine ring, a pyrimidine ring, a pyrazole ring, a pyrrole ring, a furan ring, a thiophene ring, a quinoline ring, and an isoquinoline ring. T represents a substituent. Examples of the substituent T include those on the 3-membered to 8-membered hetero ring to be formed by $Y_5$ in formula ($R_0$-1). Preferably, T is an alkoxy group, an alkoxycarbonyl group, an alkylthio group, or an alkylsulfonyl group.

$$R_8—Q—SO_2—L_3— \qquad (R_0\text{-}4)$$

where $R_8$ represents an alkyl group having a C number from 1 to 30, or an aryl group having a C number from 6 to 30;

Q represents —NH—, —S—, —O— or a single bond; and $L_3$ has the same meaning as Ls in formula ($R_0$-1).

$R_8$ is preferably a straight chain or branched alkyl group having a C number from 1 to 24; and Q is preferably —NH—, —O— or a single bond.

In formula (C-1), Ar is preferably an aryl group having a C number from 6 to 36, preferably from 6 to 16. The aryl group is preferably substituted by substituent(s). Examples of the substituents include a halogen atom, a hydroxyl group, a carboxyl group, a sulfo group, a cyano group, a nitro group, an amino group, an alkyl group, an alkenyl group, an alkynyl group, a cycloalkyl group, an aryl group, an alkoxy group, an aryloxy group, an alkylthio group, an arylthio group, an alkylsulfonyl group, an arylsulfonyl group, an acyl group, an acyloxy group, an alkoxycarbonyl group, an aryloxycarbonyl group, a carbonamido group, a sulfonamido group, a carbamoyl group, a sulfamoyl group, a ureido group, an alkoxycarbonylamino group, a sulfamoylamino group, an alkoxysulfonyl group, an imido group and a heterocyclic group. (These substituents which may be on the aryl group are hereinafter referred to as substituent group A.)

Preferred substituents which may be on the aryl group of Ar are a halogen atom (e.g., F. Cl, Br, I), a cyano group, a nitro group, an acyl group (e.g., acetyl, benzoyl), an alkyl group (e.g., methyl, t-butyl, trifluoromethyl, tirchloromethyl), an alkoxy group (e.g., methoxy, ethoxy, butoxy, trifluoromethoxy), an alkylsulfonyl group (e.g., methylsulfonyl, propylsulfonyl, butylsulfonyl, benzylsulfonyl), an arylsulfonyl group (e.g., phenylsulfonyl, p-tolylsulfonyl, p-chlorophenylsulfonyl), an alkoxycarbonyl group (e.g., methoxycarbonyl, butoxycarbonyl), a sulfonamido group (e.g., methanesulfonamido, trifluoromethanesulfonamido, toluenesulfonamido), a carbamoyl group (e.g., N,N-dimethylcarbamoyl, N-phenylcarbamoyl), and a sulfamoyl group (e.g., N,N-diethylsulfamoyl, N-phenylsulfamoyl). Ar is preferably a phenyl group having at least one substituent selected from the group consisting of a halogen atom, a cyano group, a sulfonamido group, an alkylsulfonyl group, an arylsulfonyl group and a trifluoromethyl group; more preferably, it is a 4-cyanophenyl group, a 4-cyano-3-halogenophenyl group, a 3-cyano-4-halogenophenyl group, a 4-alkylsulfonylphenyl group, a 4-alkylsulfonyl-3-halogenophenyl group, a 4-alkylsulfonyl-3-alkoxyphenyl group, a 3-alkoxy-4-alkylsulfonylphenyl group, a 3,4-dihalogenophenyl group, a 4-halogenophenyl group, a 3,4,5-trihalogenophenyl group, a 3,4-dicyanophenyl group, a 3-cyano-4,5-dihalogenophenyl group, a 4-trifluoromethylphenyl group, or a 3-sulfonamidophenyl group; and especially preferably, it is a 4-cyanophenyl group, a 3-cyano-4-halogenophenyl group, a 4-cyano-3-halogenophenyl group, a 3,4-dicyanophenyl group, or a 4-alkylsulfonylphenyl group.

In formula (C-1), X is a hydrogen atom, or a group (including atom—the same shall apply hereunder) capable of being split off by a coupling reaction with the oxidation product of an aromatic primary amine color developing agent. Preferred examples of the coupling split-off group X include a halogen atom, $—OR_9$, $—SR_9$, $—O(CO)R_9$, $—OSO_2R_9$, $—NH(CO)R_9$, $—NH(CO)SR_9$, $—O(CO)OR_9$, $—O(CO)NHR_9$, an arylazo group having a C number from 6 to 30, and a heterocyclic group having a C number from 1 to 30 and bonded to the coupling active position of the compound (or the position of the compound which is bonded to X) via the nitrogen atom of the group (for example, succinimido, phthalimido, hydantoinyl, pyrazolyl, 2-benzotriazolyl). $R_9$ represents an alkyl group having a C number from 1 to 36, an alkenyl group having a C number from 2 to 36, a cycloalkyl group having a C number from 3 to 36, an aryl group having a C number from 6 to 36, or a heterocyclic group having a C number from 2 to 36, and the $R_9$ group may optionally be substituted by substituent(s) selected from the above-mentioned group A. X is more preferably a hydrogen atom, a halogen atom, an alkoxy group, an aryloxy group, or an alkylthio group, and especially preferably it is a hydrogen atom, a chlorine atom, a group of the following formula (Xa), or a group of the following formula (Xb).

(Xa)

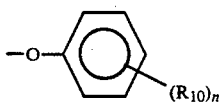

where $R_{10}$ represents halogen atom, a cyano group, a nitro group, an alkyl group, an alkoxy group, an alkylthio group, an alkylsulfonyl group, an arylsulfonyl group, a carbonamido group, a sulfonamido group, an alkoxycarbonyl group, a carbamoyl group, a sulfamoyl group, or a carboxyl group; and m represents an integer from 0 to 5, and when m is a plural number, then plural $R_{10}$'s may be same or different.

(Xb)

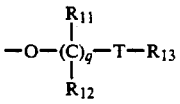

where $R_{11}$ and $R_{12}$ are independently a hydrogen atom or a monovalent group;

T represents —CO—, —SO—, $—SO_2—$ or $—(PO)R_{14}—$;

$R_{13}$ and $R_{14}$ each represents a hydroxyl group, an alkyl group, an aryl group, an alkoxy group, an alkenyloxy group, an aryloxy group, or an amino group; and q represents an integer from 1 to 6, and when q is a plural number, then plural $—C(R_{11})(R_{12})$'s may be same or different.

In formula ($X_a$), $R_{10}$ is preferably a halogen atom, an alkyl group (e.g., methyl, t-butyl, t-octyl, pentadecyl), an alkoxy group (e.g., methoxy, n-butoxy, n-octyloxy, benzyloxy, methoxyethoxy), a carbonamido group (e.g., acetamido, 3-carboxypropanamido), or a sulfonamido group (e.g., methanesulfonamido, tolueneuslfonamido, p-dodecyloxybenzenesulfonamido); and it is especially preferably an alkyl group or an alkoxy group. n is preferably an integer from 0 to 2, more preferably an integer of 0 or 1.

In formula ($X_b$), when $R_{11}$ and/or $R_{12}$ each represents a monovalent group, the monovalent group is preferably an alkyl group (e.g., methyl, ethyl, n-butyl, ethoxycarbonylmethyl, benzyl, n-decyl, n-dodecyl), an aryl group (e.g,. phenyl, 4-chlorophenyl, 4-methoxyphenyl), an acyl group (e.g., acetyl, decanoyl, benzoyl, pivaloyl), or a carbamoyl group (e.g., N-ethylcarbamoyl, N-phenylcarbamoyl). More preferably, $R_{11}$ and $R_{12}$ each is a hydrogen atom, an alkyl group, or an aryl group. In formula ($X_b$), T is preferably —CO— or $—SO_2—$, and is more preferably —CO. In formula ($X_b$), $R_{13}$ is preferably an alkyl group, an alkoxy group, an alkenyloxy group, an aryloxy group, or a substituted or unsubstituted amino group; and more preferably, it is an alkoxy group, or a substituted or unsubstituted amino group.

In formula ($X_b$), q preferably is an integer from 1 to 3, more preferably 1.

Specific examples of X in formula (C-1) are as follows:

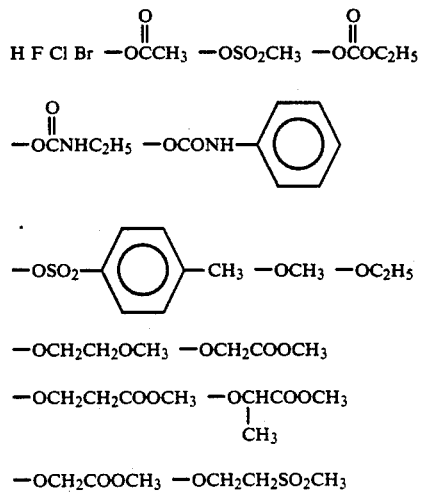

-continued $-OCH_2CONHCH_2CH_2OH$ $-OCH_2CONHCH_2CH_2OCH_3$ $-OCH_2CH{=}CH_2$

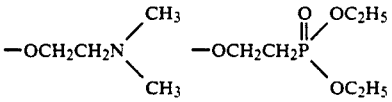

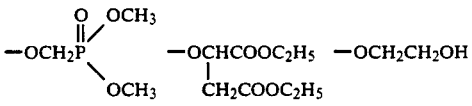

$-OCH_2CH_2SCH_2COOH$ $-OCH_2CH_2NHSO_2CH_3$

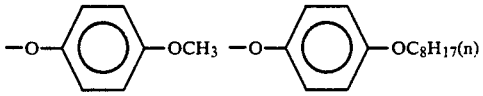

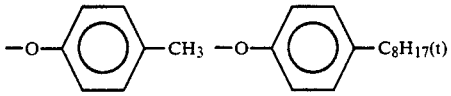

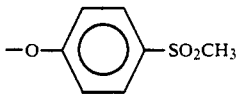

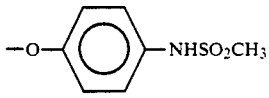

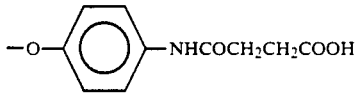

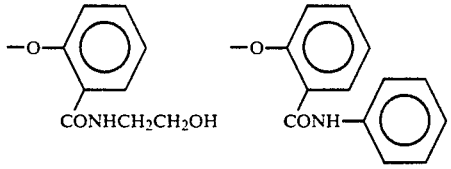

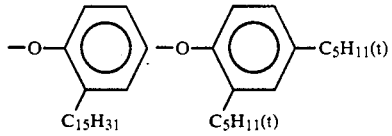

-continued $-SCH_2COOC_2H_5$ $-SCH_2COOH$ $-SCH_2CH_2COOH$

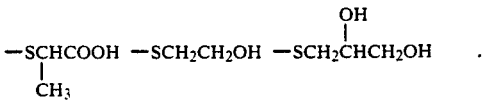

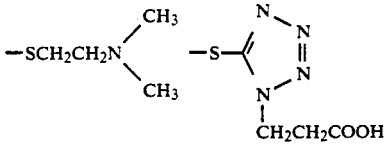

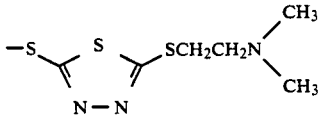

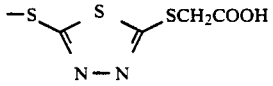

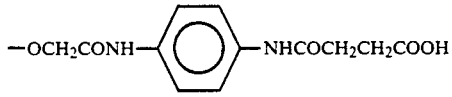

$-OCH_2COOC_4H_9(sec)$ $-OCH_2COOC_4H_9(t)$

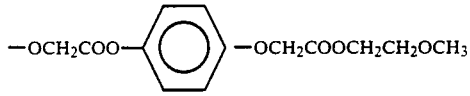

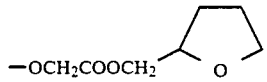

$-OCH_2COOCH_2COOC_2H_5$

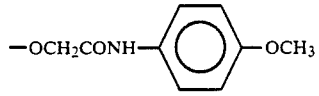

$-OCH_2COOCH_2CH_2SO_2CH_3$

Specific examples of the cyan dye forming couplers of formula (C-1) for use in the present invention are mentioned below, which, however, are not limitative of the invention.

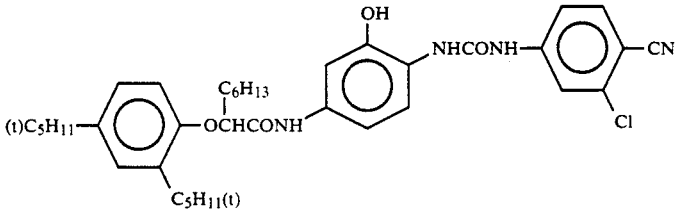

(1)

-continued
(2)
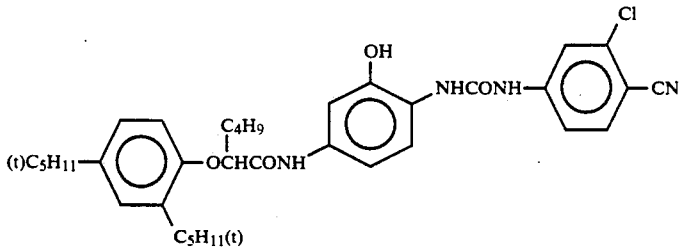
(3)
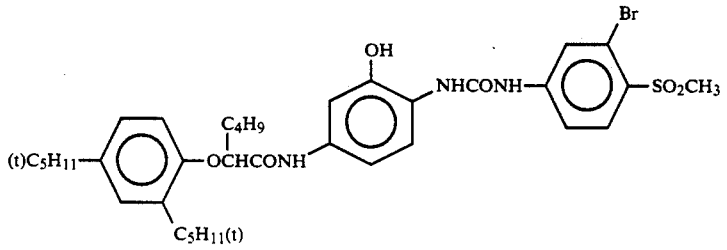
(4)
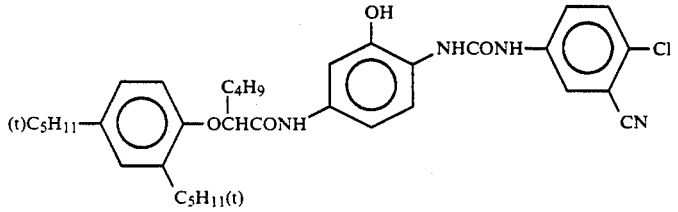
(5)
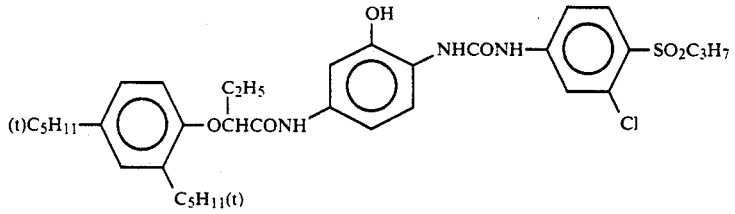
(6)
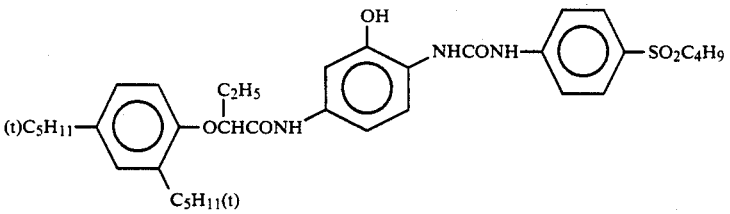
(7)
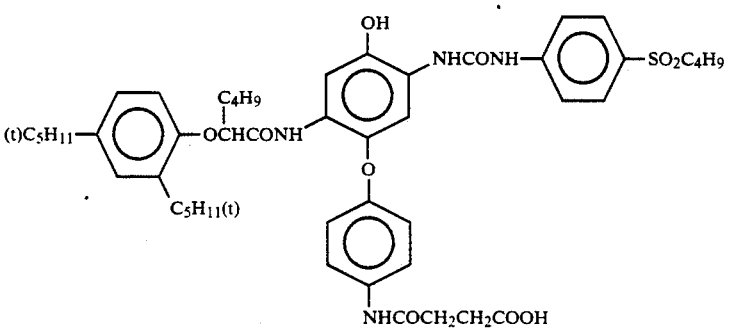

-continued
(8)
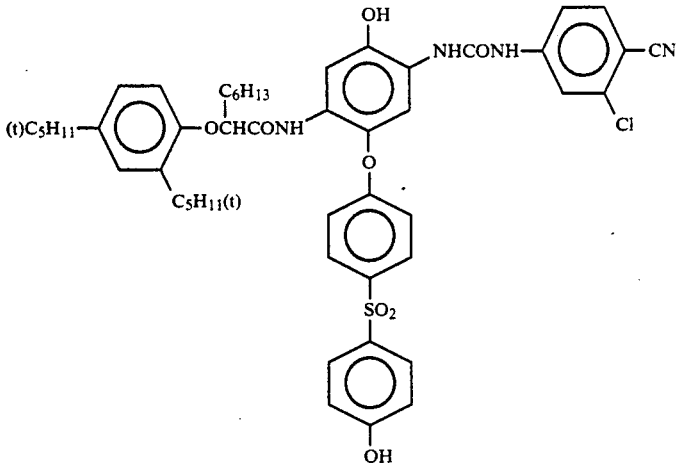
(9)
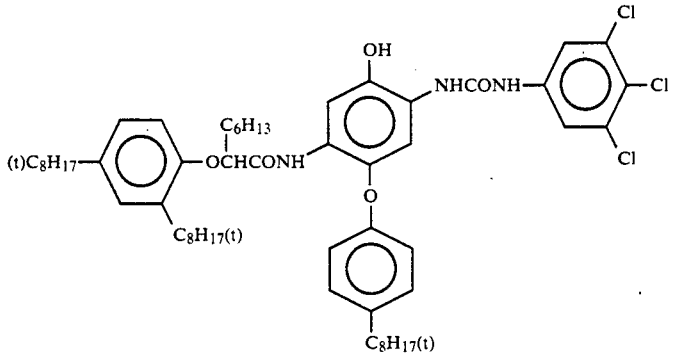
(10)
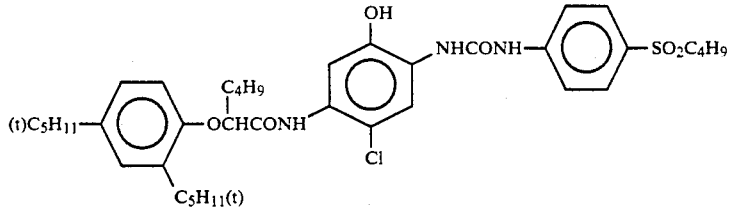
(11)
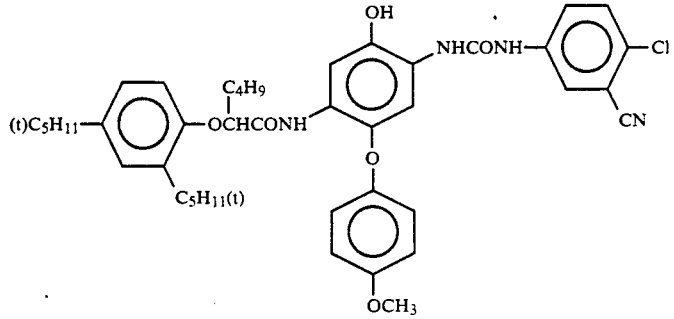

-continued
(12)
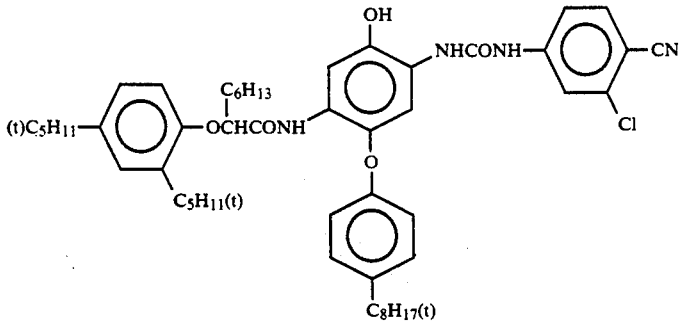
(13)
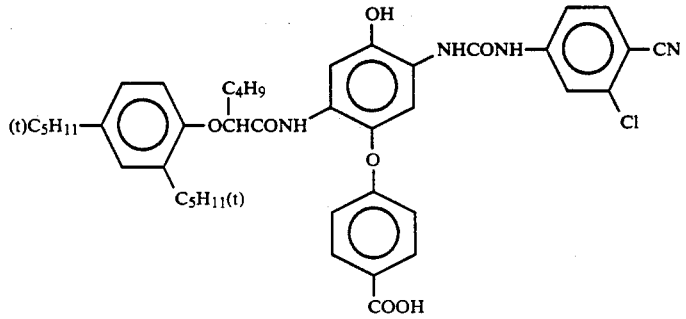
(14)
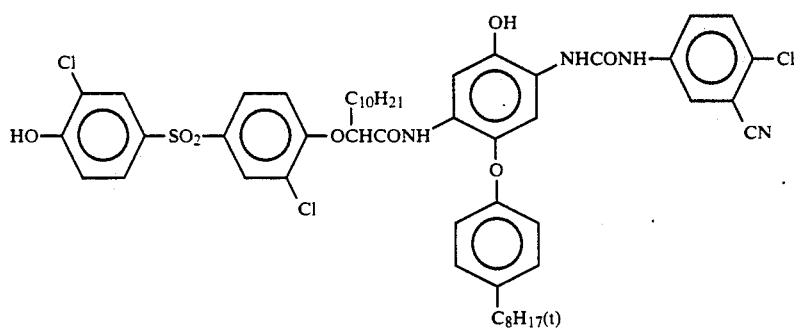
(15)
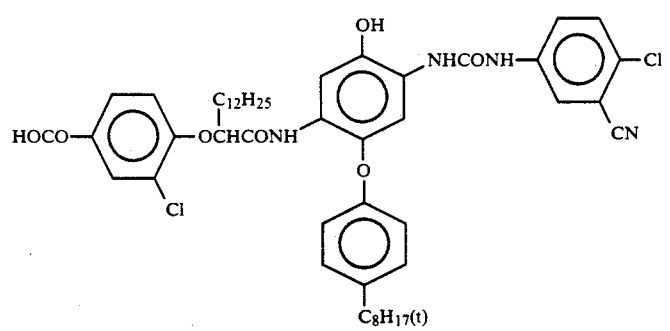
(16)
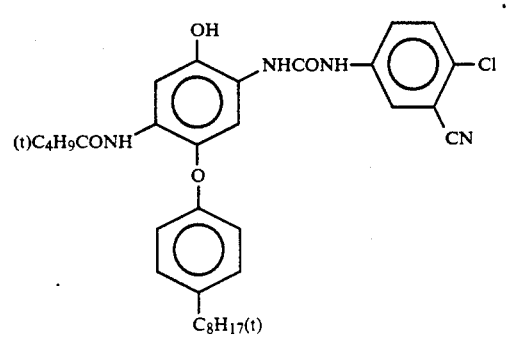

-continued
(17)
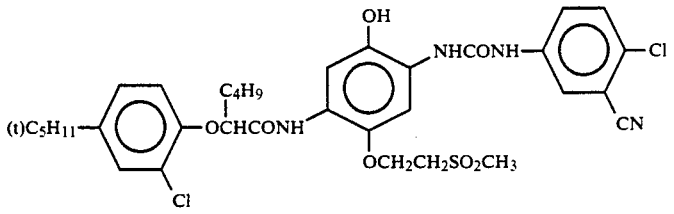
(18)
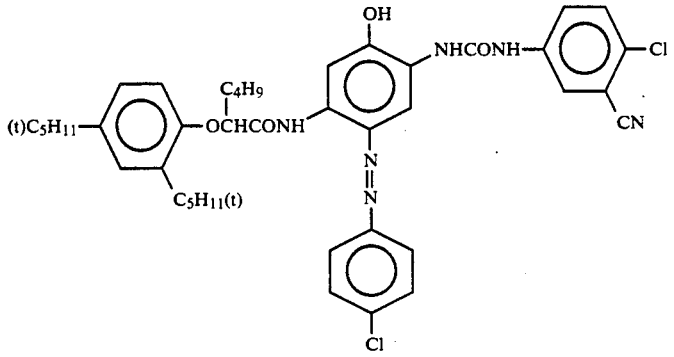
(19)
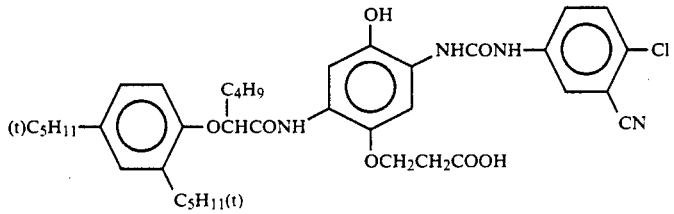
(20)
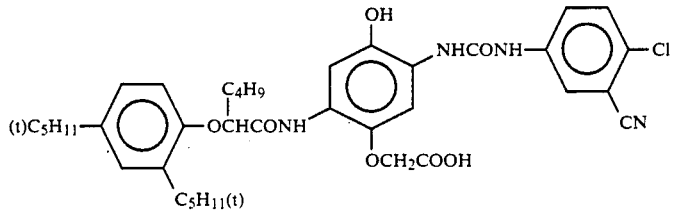
(21)
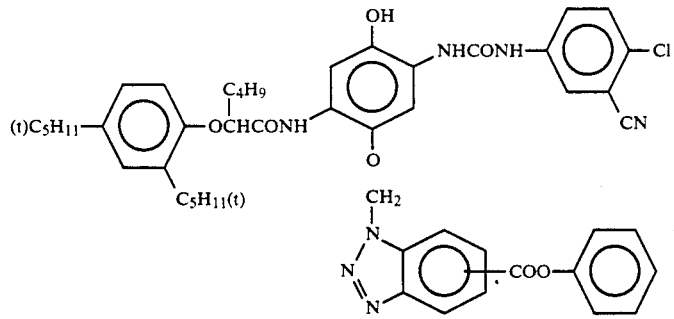
(22)
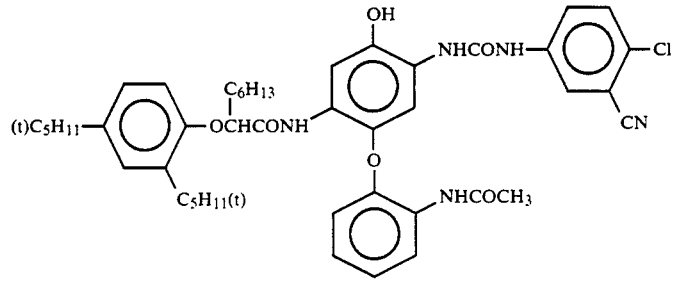

-continued
(23)
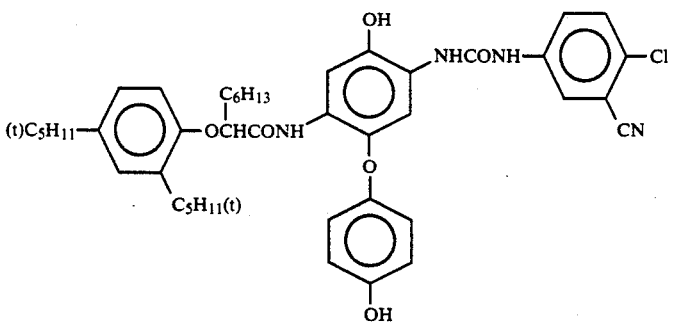
(23)
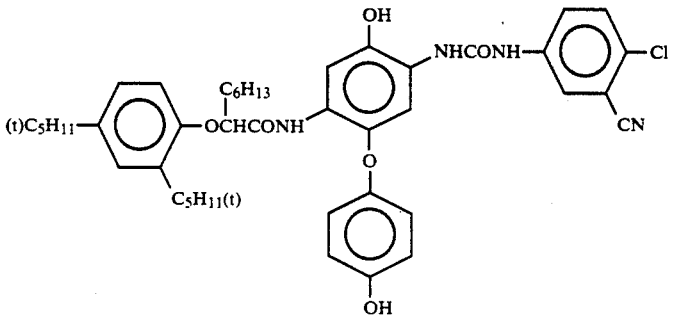
(24)
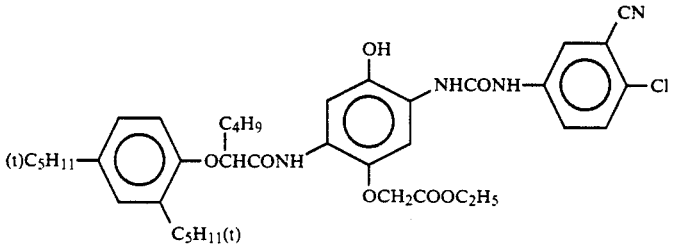
(25)
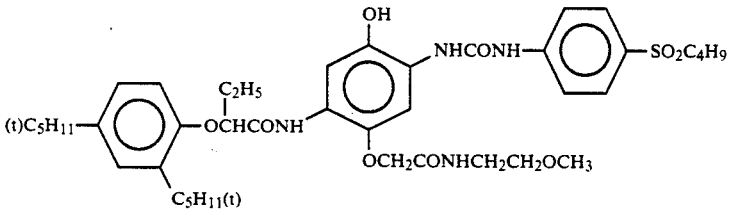
(26)
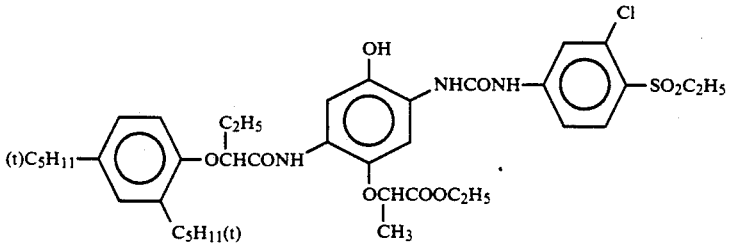
(27)
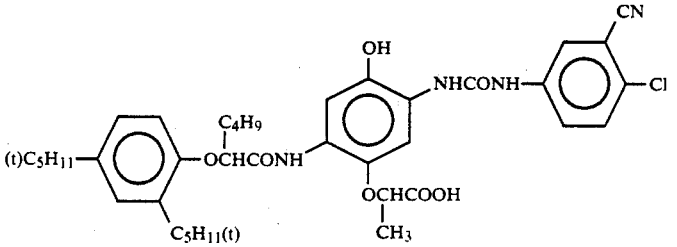

-continued
(28)
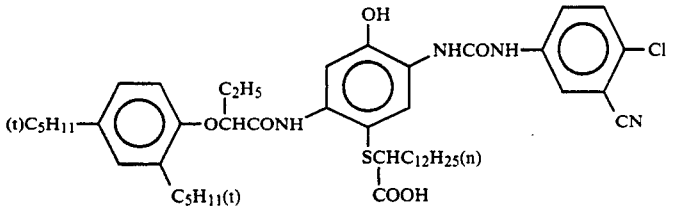
(29)
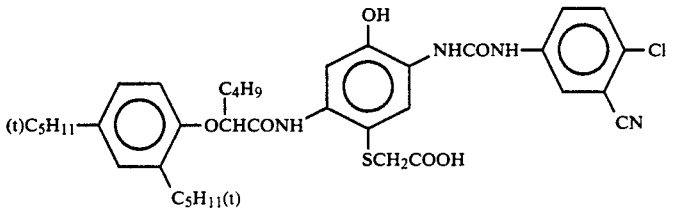
(30)
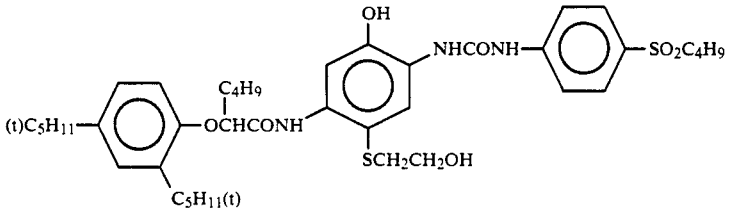
(31)
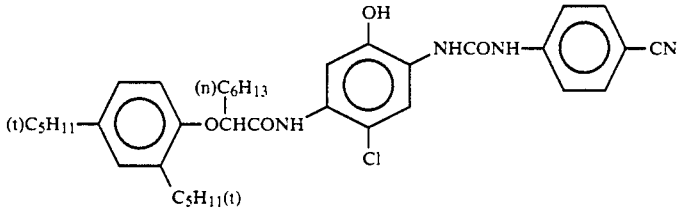
(32)
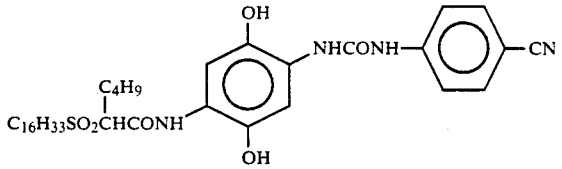
(33)
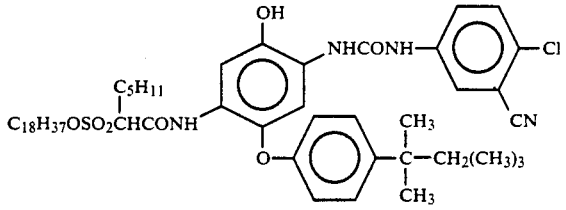
(34)
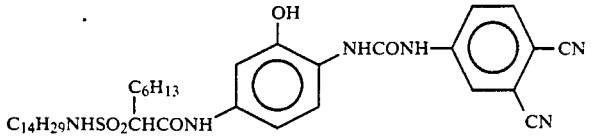

-continued
(35)
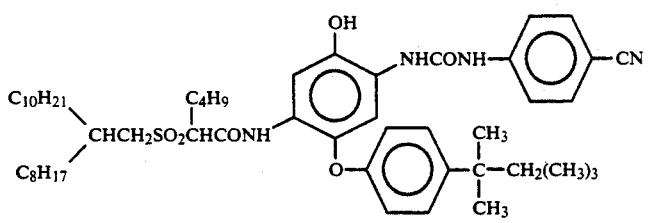
(36)
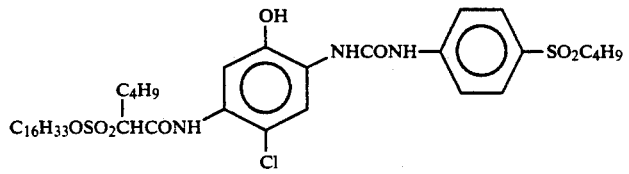
(37)
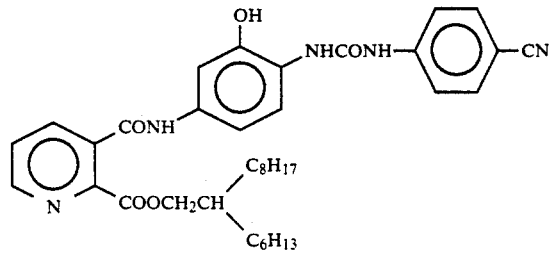
(38)
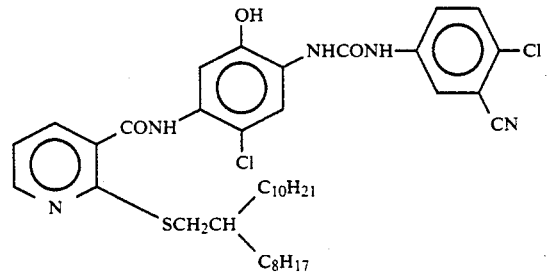
(39)
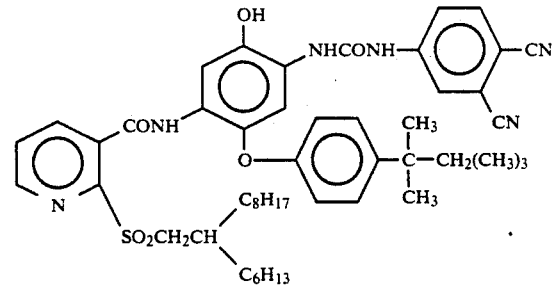
(40)
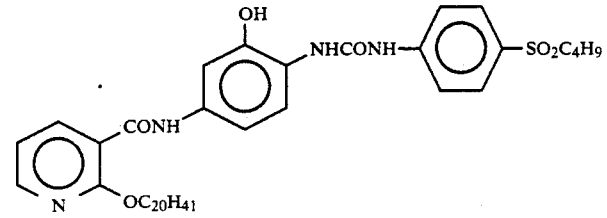

-continued
(41)
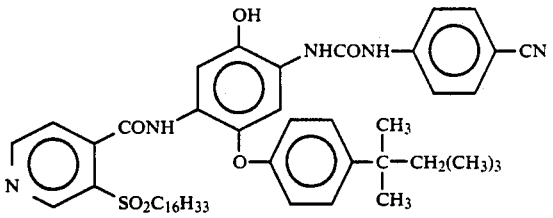
(42)
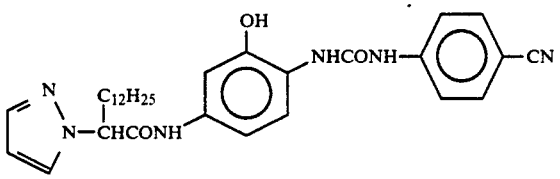
(43)
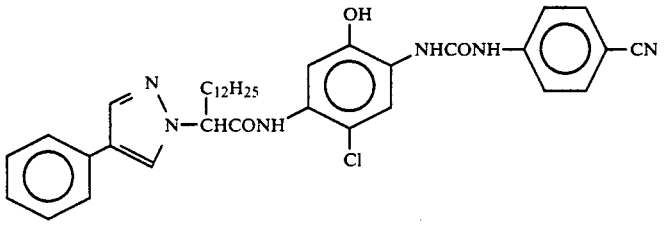
(44)
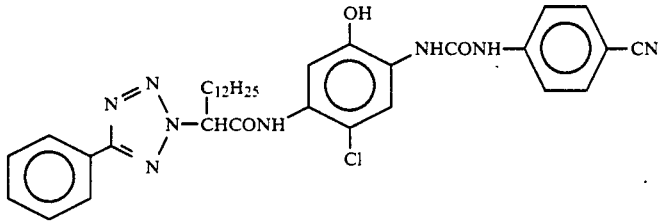
(45)
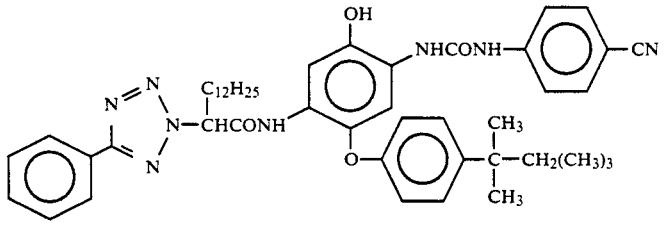
(47)
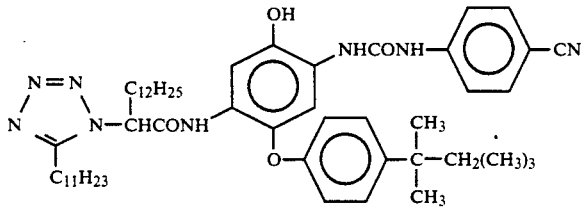
(48)
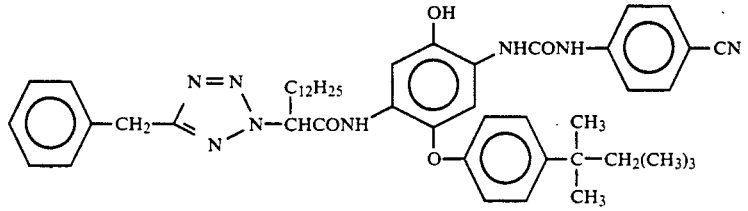

-continued
(49)
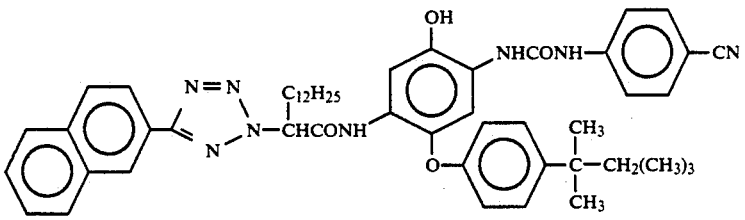
(50)
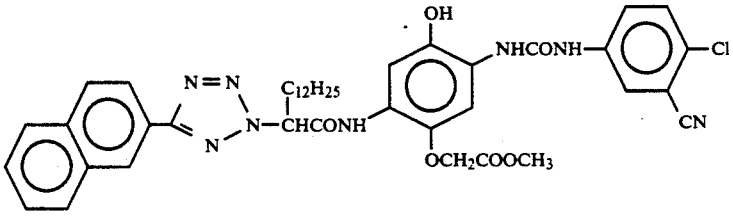
(51)
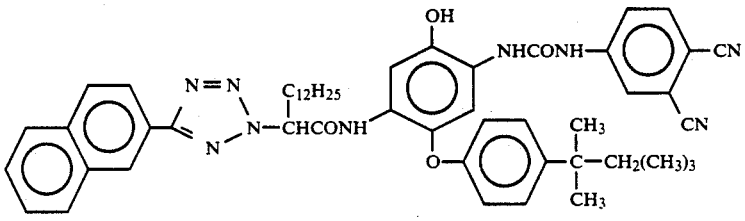
(52)
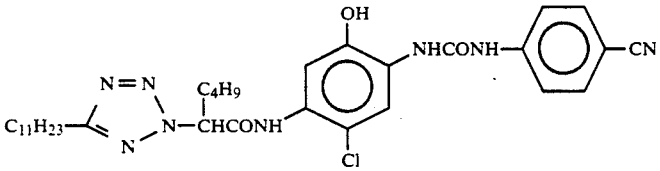
(53)
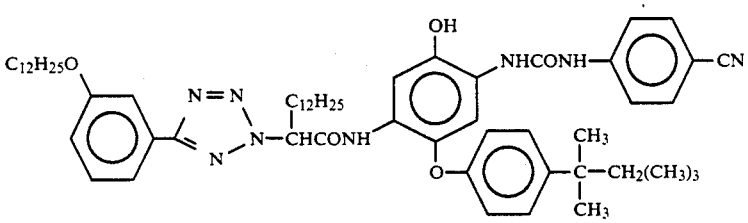
(54)
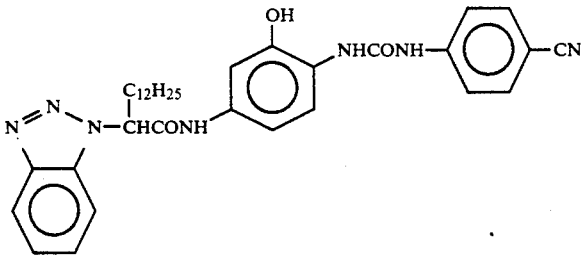
(55)
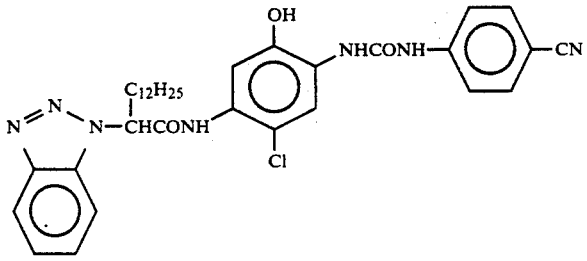

-continued
(56)
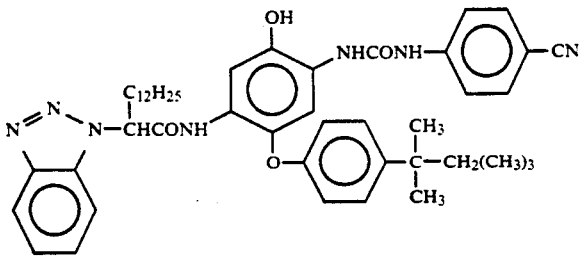
(57)
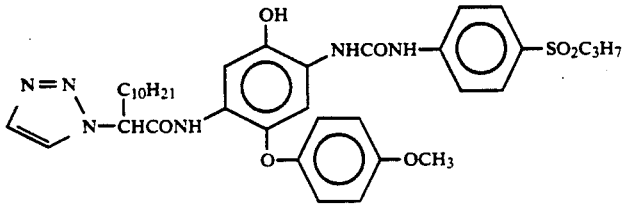
(58)
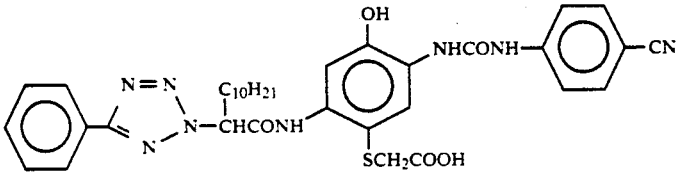
(59)
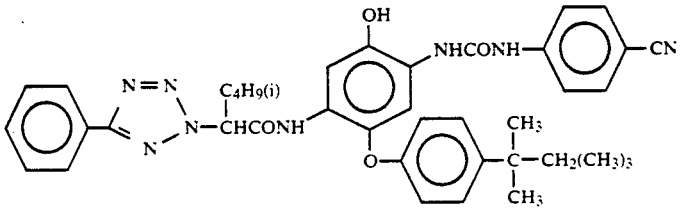
(60)
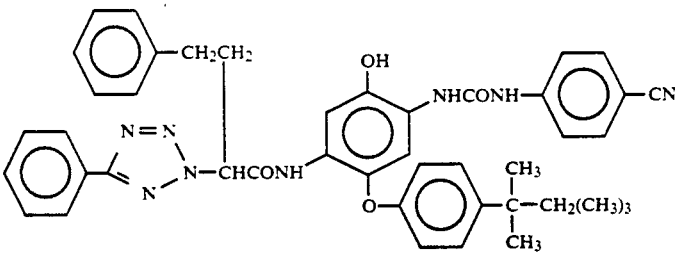
(61)
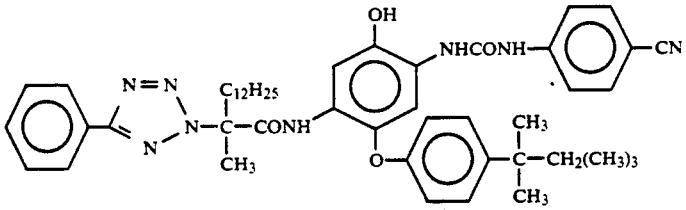
(62)
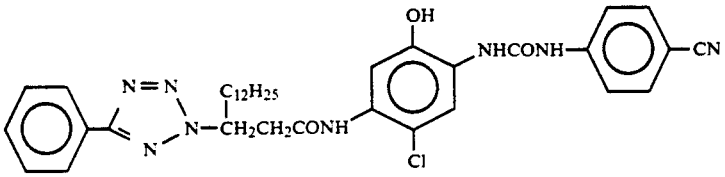

-continued
(63)
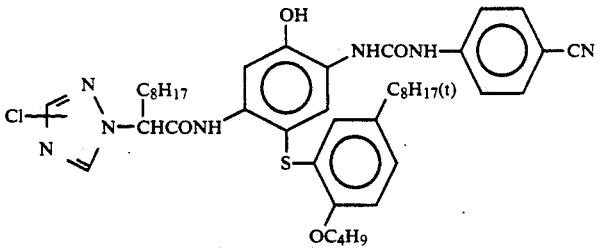
(64)
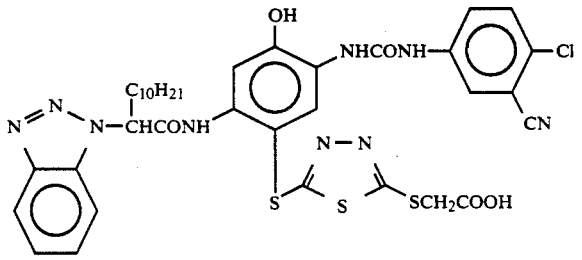
(65)
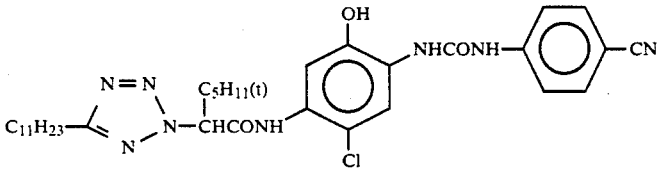
(66)
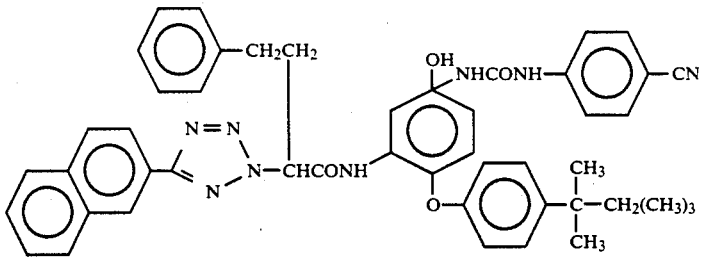
(67)
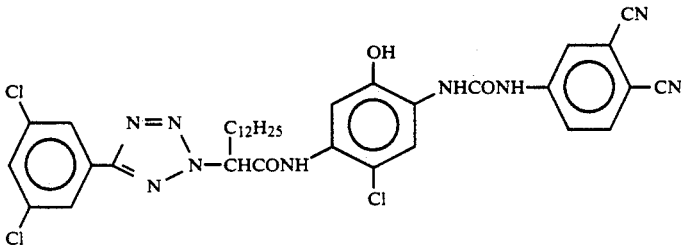

-continued (68)

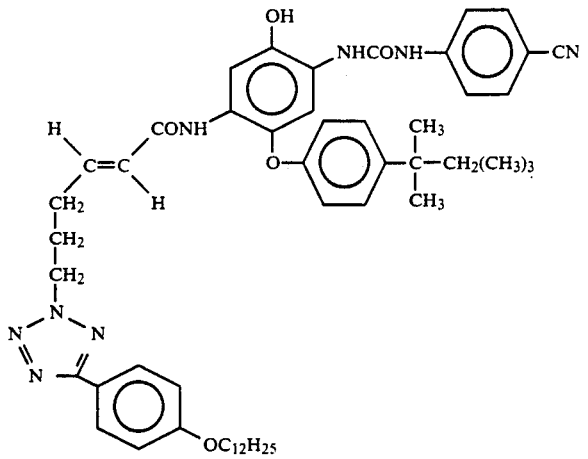

Cyan couplers of formula (C-1) for use in the present invention can be produced by any known methods, for example, by those described in JP-A 3-196037 and 3-196038.

In the present invention, two or more kinds of couplers of formula (C-1) can be used in combination or they may be used along with any other couplers which will be mentioned hereinafter.

The standard amount of the couplers of formula (C-I) to be used in the present invention may be from 0.001 to 1 mol, preferably from 0.002 to 0.4 mol, per mol of light-sensitive silver halide.

Compounds of formula (I) for use in the present invention will be explained in detail hereinbelow.

In formula (I), $R_1$, $R_2$ and $R_3$ each represents an aliphatic group preferably having from 1 to 40 carbon atoms, more preferably from 1 to 34 carbon atoms, an aryl group preferably having from 6 to 36 carbon atoms, more preferably from 6 to 30 carbon atoms, or a heterocyclic group preferably having from 4 to 34 carbon atoms, more preferably from 4 to 28 carbon atoms; and $R_4$ represents a hydrogen atom, an aliphatic group preferably having from 1 to 40 carbon atoms, more preferably from 1 to 34 carbon atoms, an aryl group preferably having from 6 to 36 carbon atoms, more preferably from 6 to 30 carbon atoms, or a heterocyclic group preferably having from 4 to 34 carbon atoms, more preferably from 4 to 28 carbon atoms. The aliphatic group, aryl group and heterocyclic group may optionally be substituted. $R_1$ and $R_2$, or $R_3$ and $R_4$ may form a 5-membered to 8-membered ring. The ring formed may contain an oxygen atom, a sulfur atom or a nitrogen atom. Examples of the 5-membered to 8-membered rings formed include a piperidine ring, a piperazine ring, and a morpholine ring. $R_1$ and $R_3$, and $R_2$ and $R_4$ do not form a ring.

In view of the effect of the present invention, $R_1$, $R_2$ and $R_3$ each is preferably an aliphatic group or an aryl group, more preferably an aliphatic group. $R_4$ is preferably a hydrogen atom or an aliphatic group, more preferably an aliphatic group. $R_1$ and $R_3$ may be bonded to $R_2$ and $R_4$, respectively, directly or through an oxygen atom, a sulfur atom or a nitrogen atom to form a 5-membered to 8-membered ring. Most preferably, $R_1$, $R_2$, $R_3$ and $R_4$ are all alkyl groups, each of which may form a ring. The alkyl group may optionally be substituted, as mentioned above. In particular, the alkyl group is preferably substituted by substituent(s) selected from an alkoxycarbonyl group, an alkoxy group, an alkylsulfonyl group, an alkylacylamino group, a carbamoyl group and/or a phenoxy group, or is also preferably an unsubstituted alkyl group. Especially preferably, the alkyl group is an unsubstituted one. When the groups form a ring, either $R_1$ and $R_2$, or $R_3$ and $R_4$ preferably form a ring. Most preferably, $R_1$ and $R_2$ form a ring.

Also from the effect of the present invention, compounds of formula (I) where $R_1$ and $R_2$ are bonded to each other to form a piperazine ring, a piperidine ring or a morpholine ring, $R_3$ is an alkyl group, and $R_4$ is an alkyl group or a hydrogen atom are preferred; and those where $R_3$ and $R_4$ each is an alkyl group are more preferred.

From the effect of the present invention, compounds of formula (I) are preferred to have from 6 to 60 carbon atoms, more preferably from 15 to 60 carbon atoms; and those having a molecular weight of 250 or more are most preferred.

Specific examples of compounds of formula (I) for use in the present invention are mentioned below, which, however, are not limitative of the invention.

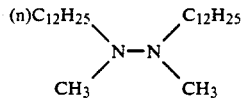

(I-1)

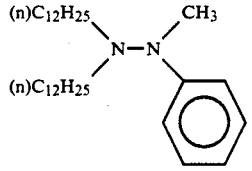

(I-2)

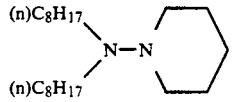

(I-3)

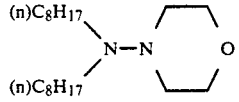

(I-4)

-continued
(I-5)
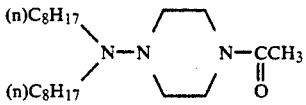
(I-6)
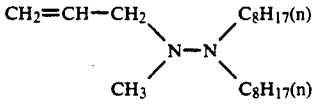
(I-7)
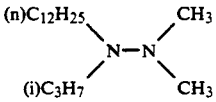
(I-8)
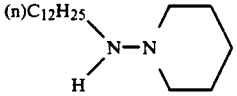
(I-9)
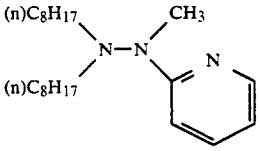
(I-10)
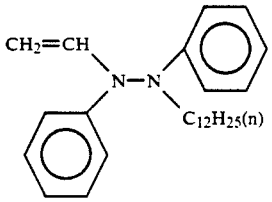
(I-11)
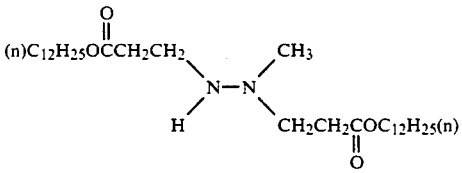
(I-12)
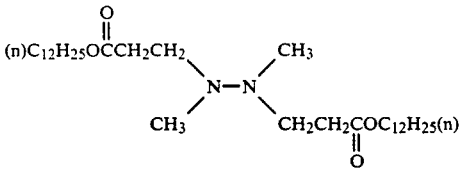
(I-13)
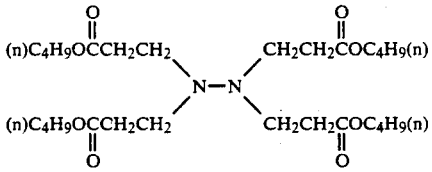
(I-14)
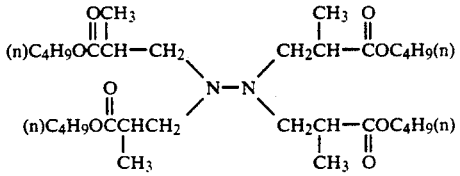
-continued
(I-15)
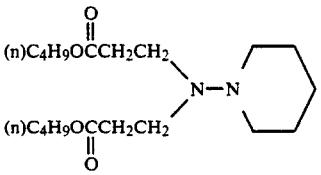
(I-16)
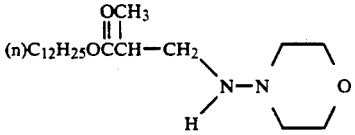
(I-17)
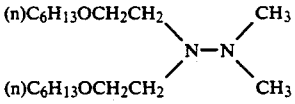
(I-18)
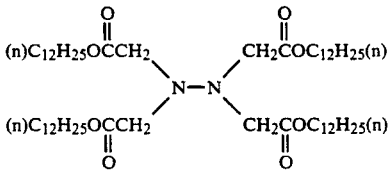
(I-19)
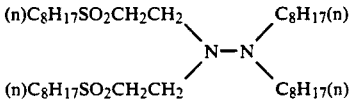
(I-20)
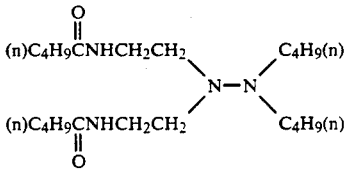
(I-21)
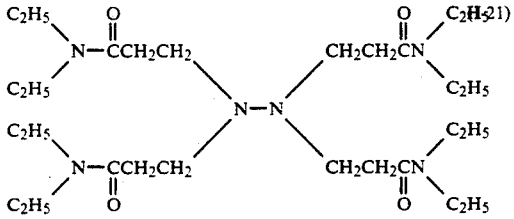
(I-22)
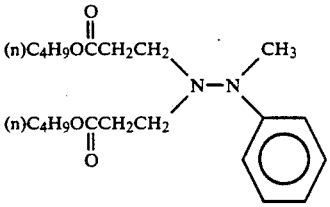
(I-23)
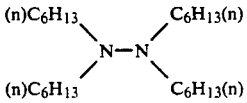
(I-24)
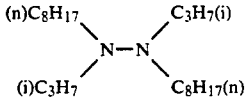

-continued (I-25)

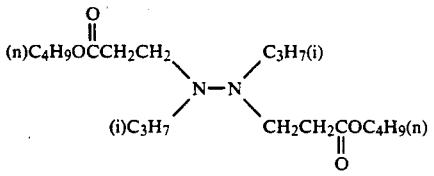

(i-26)

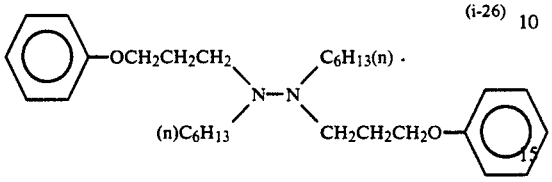

(I-27)

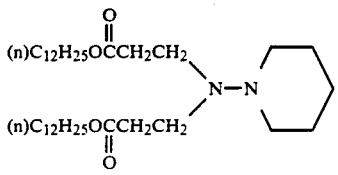

(I-28)

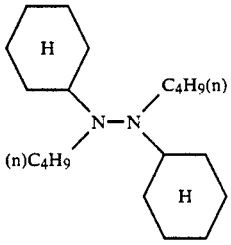

(I-29)

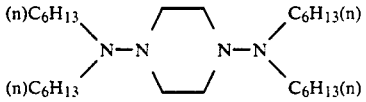

(I-30)

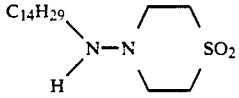

(I-31)

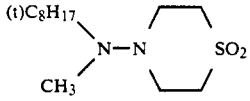

Compounds of formula (I) are produced with ease by or in accordance with the methods described in *J. Am. Chem. Soc.*, 72, 2762 (1950); *Org. Synth.*, II, 395 (1943); *New Experimental Chemistry Lecture* Vol. 14-3, page 1220, (1977, published by Maruzen Publishing Co.); ibid., page 1573, (1978, published by Maruzen Publishing Co.); *Helv. Chem. Acta.*, Vol. 36, page 75 (1953); and JP-A 62-270954, 63-43145, 63-256951 and 63-220142.

Compounds of formula (I) can be used along with any known anti-fading agent. In this case, the anti-fading agent further improves the effect of the invention. Two or more compounds of formula (I) may be used together.

The amount of the compounds of formula (I) for use in the present invention is, though varying in accordance with the kind of the coupler to be used together therewith, suitably from 0.5 to 300 mol %, preferably from 1 to 200 mol %, to the coupler to be used together therewith.

In the present invention, it is more preferred that one or more compounds of formula (II) is/are further incorporated into the layer containing the previous coupler(s) of formula (C-1) and compound(s) of formula (I).

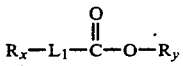

(II)

where $R_x$ represents an aliphatic group preferably having from 1 to 50 carbon atoms, more preferably having from 6 to 40 carbon atoms, an aryl group preferably having from 6 to 56 carbon atoms, more preferably having from 6 to 46 carbon atoms, or a heterocyclic group preferably having from 4 to 54 carbon atoms, more preferably having from 4 to 44 carbon atoms;

$L_1$ represents a single bond or —O—;

$R_y$ represents an aryl group preferably having from 6 to 56 carbon atoms, more preferably having from 6 to 36 carbon atoms,

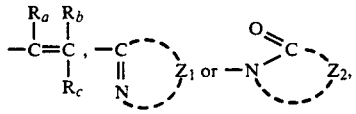

provided that when Ry is an aryl group, then —O—$R_y$ is not a partial structure of a group useful as a photographic reducing agent;

$R_a$, $R_b$ and $R_c$ may be same as or different from one another and each represents a hydrogen atom, an aliphatic group, an aryl group, a heterocyclic group, an alkoxy group, an aryloxy group, a heterocyclic-oxy group, an alkylthio group, an arylthio group, a heterocyclic-thio group, an amino group, an alkylamino group, an acyl group, an amido group, a sulfonamido group, a sulfonyl group, an alkoxycarbonyl group, a sulfo group, a carboxyl group, a hydroxyl group, an acyloxy group, a ureido group, a urethane group, a carbamoyl group, or a sulfamoyl group;

$R_a$ and $R_b$, or $R_b$ and $R_c$ may be bonded each other form a 5-membered to 7-membered hetero ring, which may be substituted or may form a spiro ring or a bicyclo ring or may be condensed with an aromatic ring;

$Z_1$ and $Z_2$ each represents a nonmetal atomic group necessary for forming a 5-membered or 7-membered hetero ring, which may be substituted or may form a spiro ring or a bicyclo ring or may be condensed with an aromatic ring.

Compounds of formula (II) will be explained in detail hereunder.

$R_a$, $R_b$ and $R_c$ may be the same or different and each represents a hydrogen atom, an aliphatic group (preferably having a C number from 1 to 60, more preferably from 8 to 50), an aryl group (preferably having a C number from 6 to 56), a heterocyclic group (preferably having a C number from 4 to 54), an alkoxy group (preferably having a C number from 1 to 50, e.g., methoxy, butoxy), an aryloxy group (preferably having a C number from 6 to 56, e.g., phenoxy, naphthyloxy), a heterocyclicoxy group (perferably having a C number from 4 to 54, e.g., 2-pyridyloxy, 4-pyridyloxy), an alkylthio group (preferably having a C number from 1 to 50, e.g., methoxythio, dodecylthio), an arylthio group (preferably having a C number from 1 to 56, e.g., phenylthio, naphthylthio), a heterocyclic-thio group (preferably having a C number from 4 to 54, e.g., 2-pyridylthio, 2-thienylthio), an amino group, an alkylamino group (preferably having a C number from 1 to 50, e.g., dimethylamino, dodecylamino, dioctylamino), an acyl group (preferably having a C number from 2 to 50, e.g., acetyl, myristyl), an amido group (preferably having a C number from 2 to 50, e.g., acetamido, tetradecanoylamido), a sulfonamido group (preferably having a C number from 1 to 50, e.g., methanesulfonamido, octanesulfonamido), a sulfonyl group (preferably having a C number from 1 to 50, e.g., methanesulfonyl, hexadecylsulfonyl), an alkoxycarbonyl group (preferably having a C number from 1 to 50, e.g., methoxycarbonyl, octyloxycarbonyl), a sulfo group, a carboxyl group, a hydroxyl group, an acyloxy group (preferably having a C number from 2 to 50, e.g., acetyloxy, tetradecanoyloxy), a ureido group (preferably having a C number from 1 to 50, e.g., N,N-dibutylureido, N-octylureido), a urethane group (preferably having a C number from 2 to 50, e.g., butoxycarbonylamino, phenoxycarbonylamino), a carbamoyl group (preferably having a C number from 2 to 50, e.g., N,N-dibutylcarbamoyl, N-octylcarbamoyl), or a sulfamoyl group (preferably having a C number from 1 to 50, e.g., N,N-dimethylsulfamoyl, N-dodecylsulfamoyl).

$R_a$ and $R_b$, and $R_b$ and $R_c$ each may be bonded to each other to form a 5-membered to 7-membered hetero ring (e.g., 5-pyrazol, 2H-pyran-3 yl), which may be further substituted or may form a spiro ring or bicyclo ring or may be condensed with an aromatic ring. $Z_1$ and $Z_2$ each represents a nonmetal atomic group necessary for forming a 5-membered to 7-membered hetero ring (e.g., 2-pyrazolin or oxazole for $Z_1$; piperidine or pyrrolidine for $Z_2$), and the hetero ring may be further substituted or may form a spiro ring or bicyclo ring or may be condensed with an aromatic ring.

Examples of hetero atoms for forming the hetero ring include an oxygen atom, a sulfur atom and a nitrogen atom. In view of the effect of the present invention, $Z_1$ and $Z_2$ each preferably is a nonmetal atomic group necessary for forming a 5-membered or 6-membered hetero ring, with for $Z_1$ a nonmetal atomic group necessary for forming a 5-membered ring being more preferred.

When $R_y$ is an aryl group, then —O—$R_y$ must not be a partial structure of a group useful as a photographic redusing agent. As examples of a group useful as a photographic reducing agent, there are mentioned hydroquinone derivatives and catechol derivatives.

In view of the effect of the present invention, $R_x$ preferably is an aliphatic group or an aryl group and particularly preferably an aliphatic group having from 6 to 40 carbon atoms.

In view of the effect of the present invention, $R_y$ preferably is an aryl group

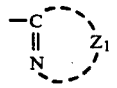

and particularly preferably an aryl group.

When $R_y$ is an aryl group, it is preferred in view of the effect of the present invention that the aryl group is substituted by at least one substituent selected from the group consisting of a chlorine atom, a bromine atom, an alkoxycarbonyl group, an aryloxycarbonyl group, a carbamoyl group, a sulfamoyl group, an acylamino group, a sulfonnamido group, a sulfonyl group, a cyano group and an acyl group, with a chlorine atom, a bromine atom, an alkoxycarbonyl group, a cyano group and sulfonyl group being particularly preferred substituents.

Specific examples of compounds of formula (II) for use in the present invention are mentioned below, which, however, are not limitative of the invention.

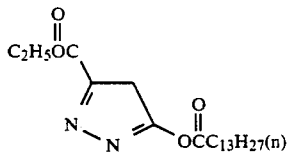

(II-1)

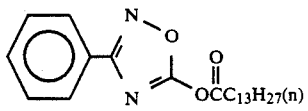

(II-2)

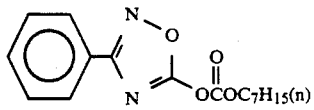

(II-3)

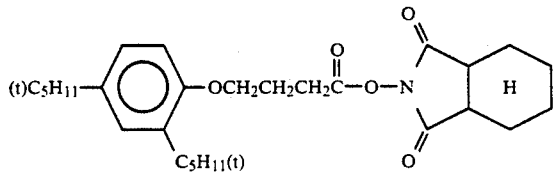

(II-4)

-continued
(II-5)
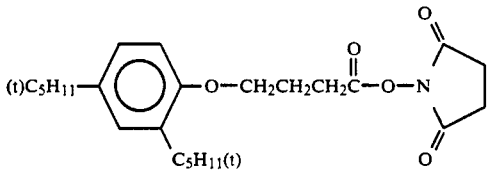
(II-6)
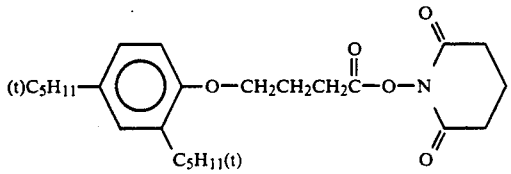
(II-7)
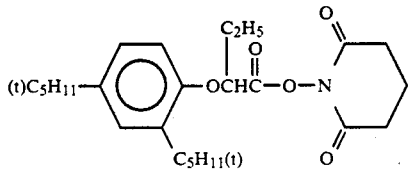
(II-8)
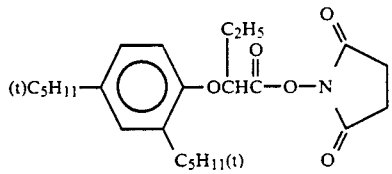
(II-9)
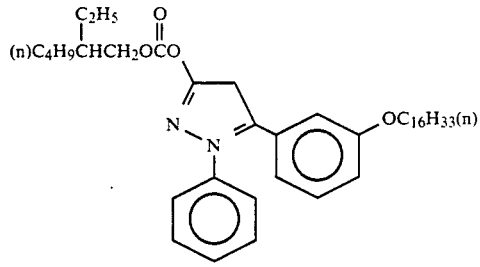
(II-10)
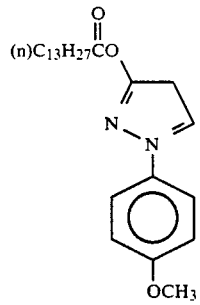
(II-11)
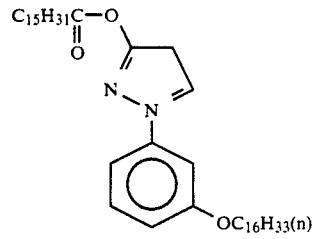

-continued
(II-12)
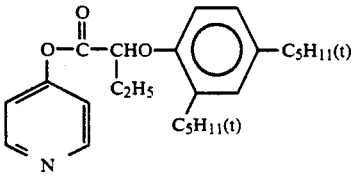
(II-13)
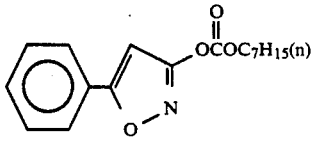
(II-14)
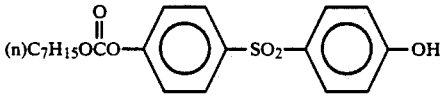
(II-15)
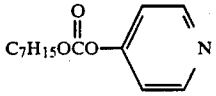
(II-16)
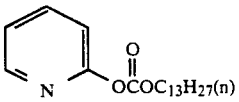
(II-17)
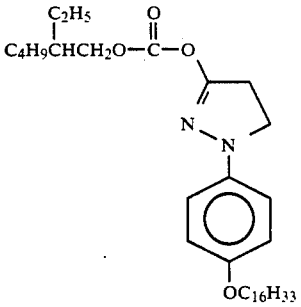
(II-18)
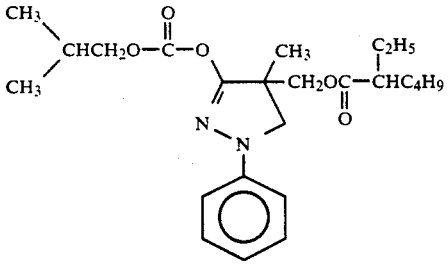
(II-19)
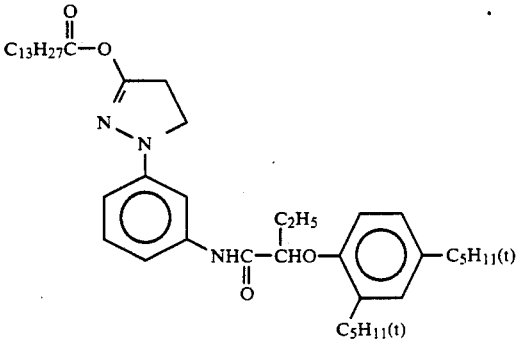

-continued
(II-20)
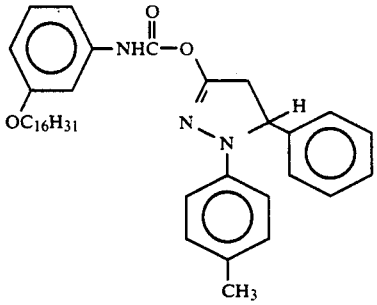
(II-21)
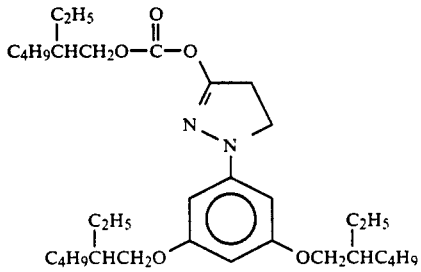
(II-22)
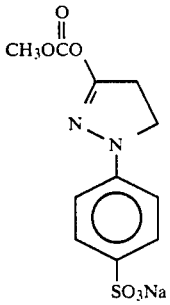
(II-23)
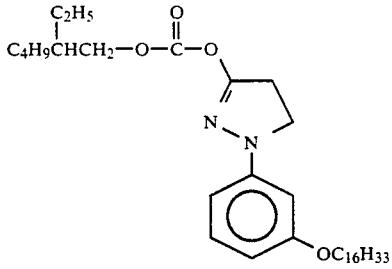
(II-24)
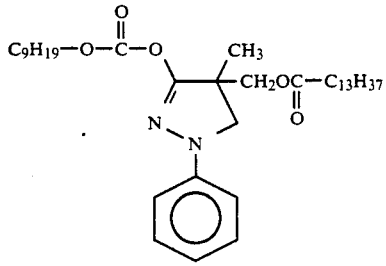

-continued
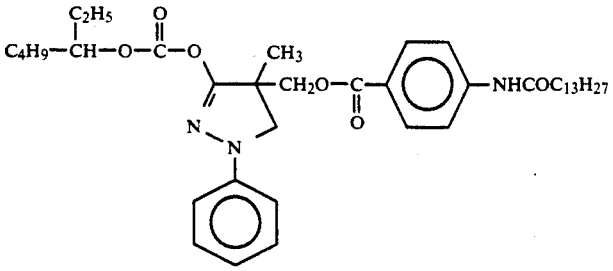
(II-25)
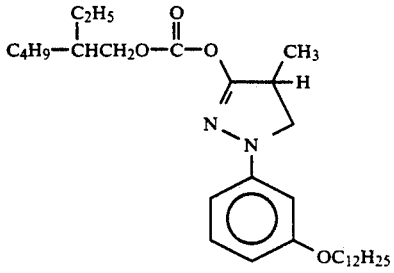
(II-26)
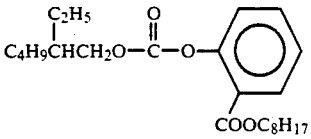
(II-27)
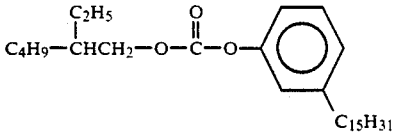
(II-28)
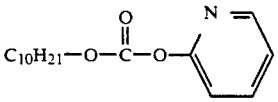
(II-29)
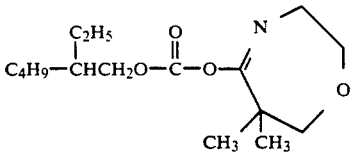
(II-30)
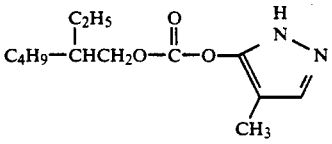
(II-31)
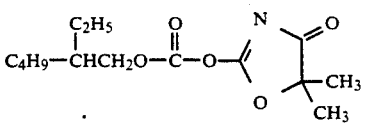
(II-32)
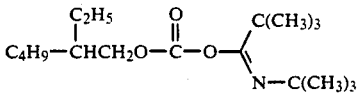
(II-33)

-continued
(II-34)
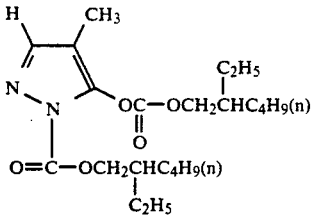
(II-35)
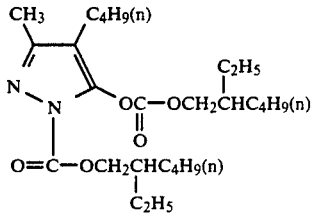
(II-36)
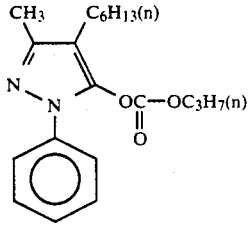
(II-37)
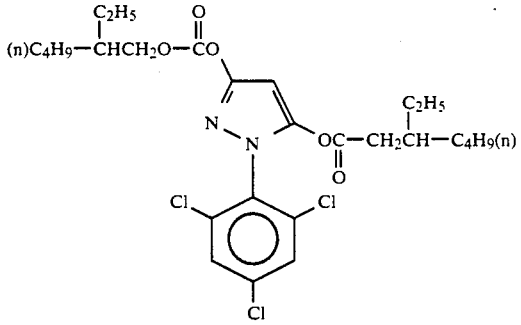
(II-38)
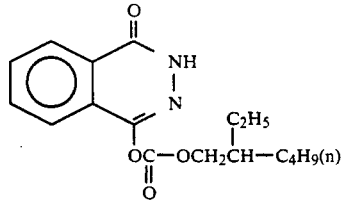
(II-39)
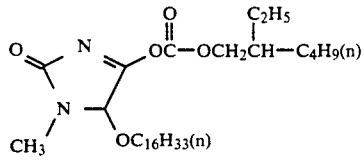
(II-40)
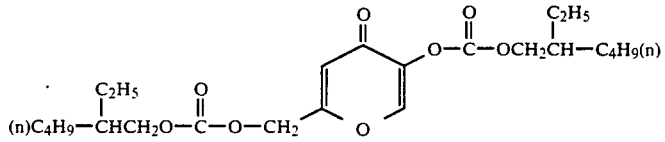

-continued
(II-41)
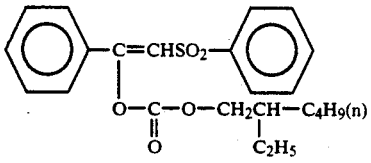
(II-42)
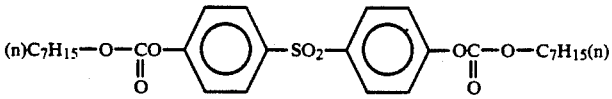
(II-43)
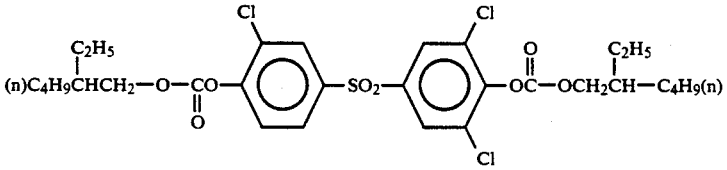
(II-44)
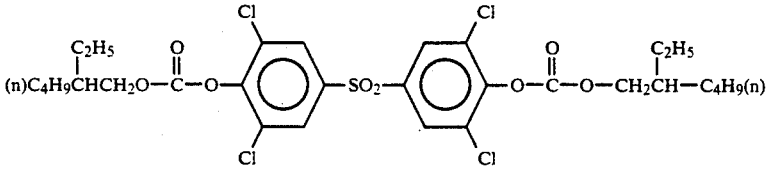
(II-45)
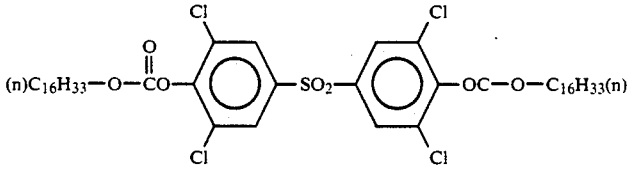
(II-46)
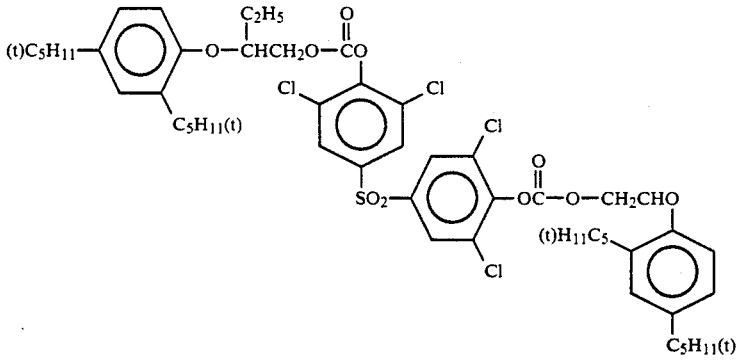
(II-47)
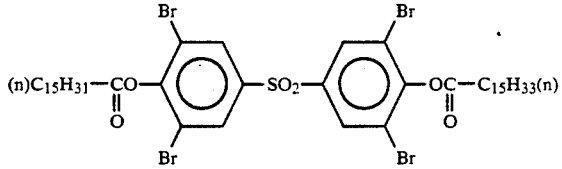
(II-48)
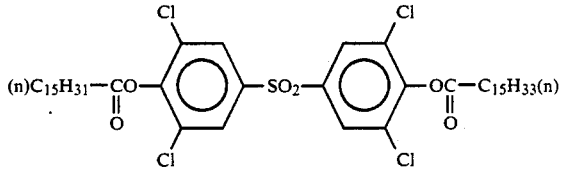

-continued
(II-49)
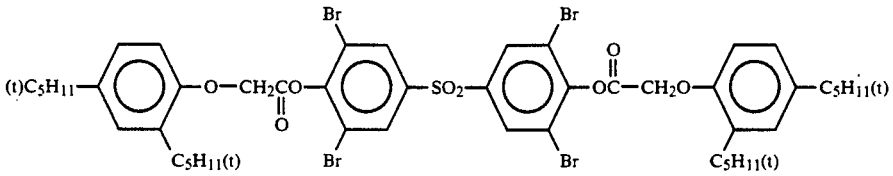
(II-50)
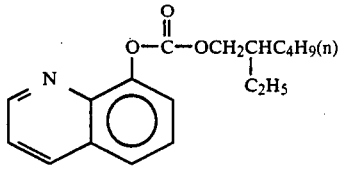
(II-51)
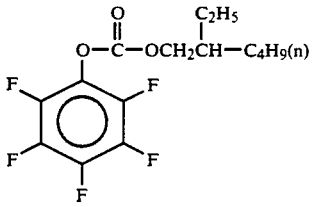
(II-52)
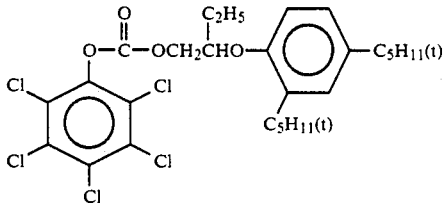
(II-53)
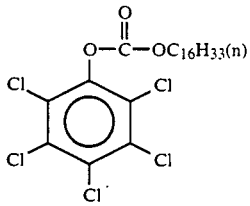
(II-54)
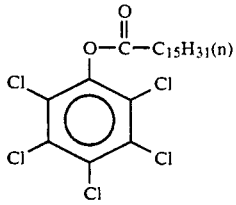
(II-55)
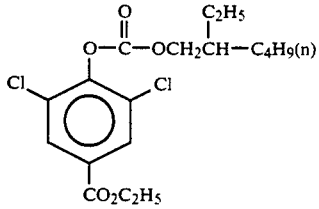
(II-56)
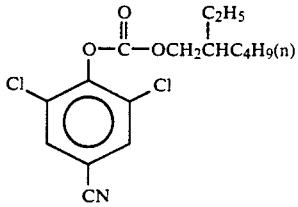

-continued
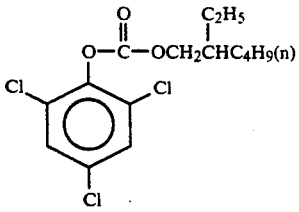
(II-57)
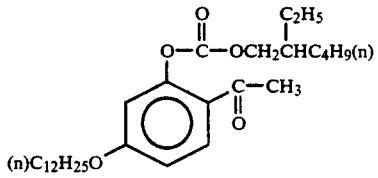
(II-58)
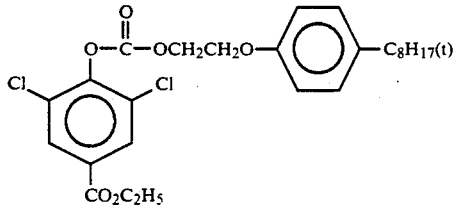
(II-59)
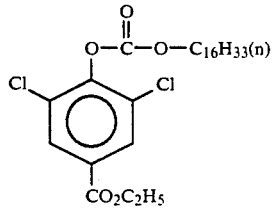
(II-60)
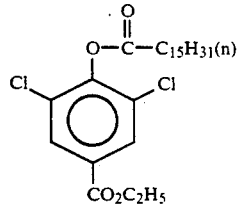
(II-61)
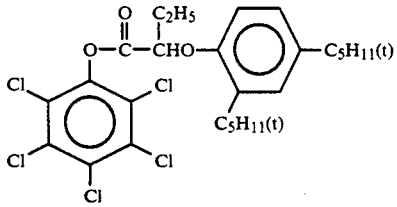
(II-62)
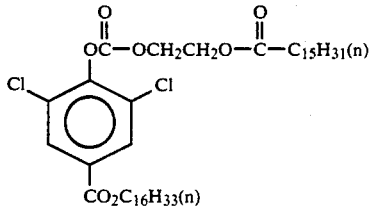
(II-63)

-continued
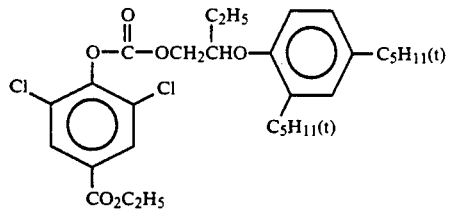
(II-64)
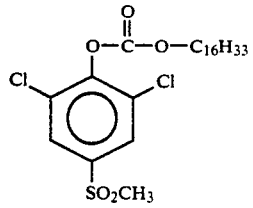
(II-65)
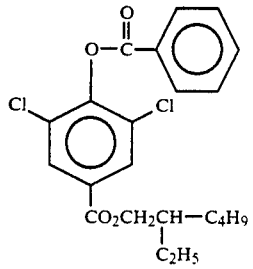
(II-66)
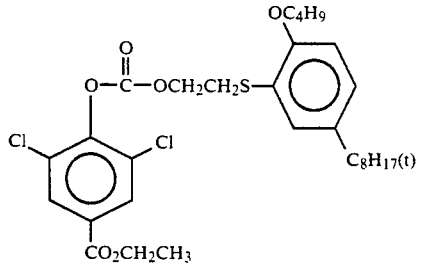
(II-67)
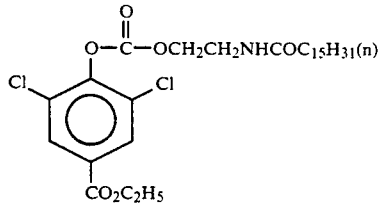
(II-68)
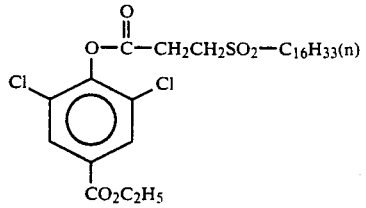
(II-69)
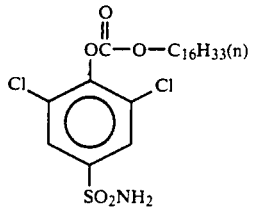
(II-70)

-continued (II-71)

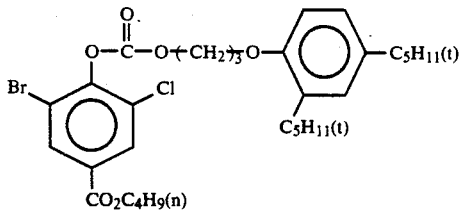

(II-72)

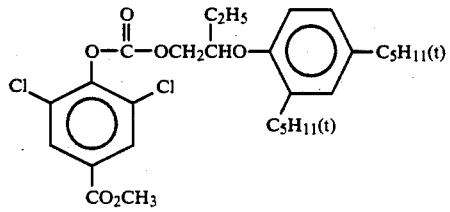

(II-73)

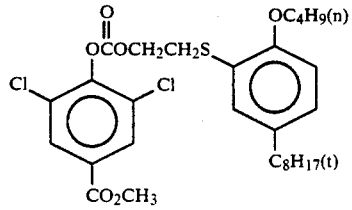

(II-74)

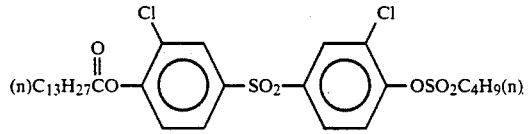

(II-75)

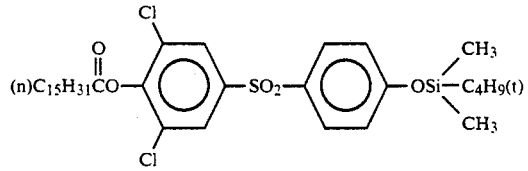

(II-76)

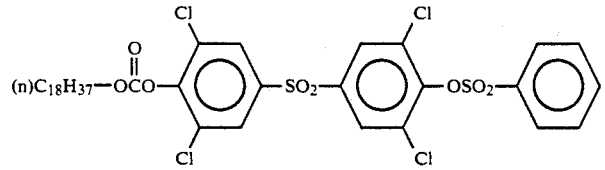

(II-77)

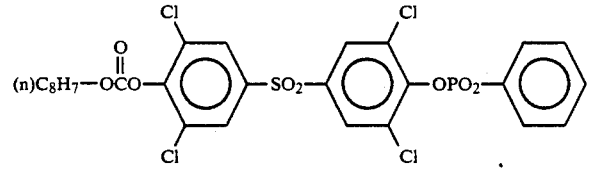

Compounds of formula (II) can be produced by any known methods, for example, by those described in JP-A-64-86139 and JP-A-62-173466.

Examples of using compounds of formula (II) for prevention of stains in color photographic materials are disclosed in JP-A-64-86139. However, the technology as disclosed therein is such that the compounds of formula (II) mask the developing agent as remained in the developed photographic material thereby preventing the formation of stains, especially cyan stains, which are caused by the remaining developing agent, in the material. The disclosed technology is, however, basically different from the novel technology of the present invention of preventing yellow to red stains in the processed photographic materials.

Examples of using compounds of formula (II) to ordinary cyan couplers are disclosed in JP-A-62-173466. However, the examples illustrated therein merely demonstrated the effect of inhibiting cyan stains in the developed photographic materials. Thus, the technical idea disclosed therein is far from the subject matter of the present invention.

Where only compounds of formula (II) are used along with couplers of formula (C-1) of the present invention in the absence of compounds of formula (I), the effect of inhibiting stains in the processed photographic materials during and after storage of them in the dark could somewhat be attained, but the degree of the effect is not satisfactory. In addition, this situation is quite ineffective for inhibiting stains to be formed under light.

Compounds of formula (II) are suitably used in a proportion from 0.5 to 300 mol % to the coupler(s) to be in the same layer, though depending upon the coupler(s) used. In particular, in the present invention, the proportion of compound(s) of formula (II) to be used is preferably from 10 to 250 mol %, more preferably from 50 to 200 mol %, to the coupler(s) of formula (C-1) to be in the same layer, for attaining an extremely excellent effect. Two or more kinds of compounds of formula (II) can be used in combination, or they may also be combined with any other known anti-fading agent and anti-stainning agent.

Compounds of formula (I), compounds of formula (II) and cyan couplers of formula (C-1) of the present invention can be introduced into photographic materials by various known dispersion methods. In general, they may be incorporated thereinto by an oil-in-water dispersion method which is known as an oil-protecting method. Precisely, they are first dissolved in a solvent and then dispersed by emulsification in an aqueous gelatin solution containing a surfactant. Alternatively, water or an aqueous gelatin solution is added to a solution of compounds of formula (I) and/or cyan couplers of formula (C-I) of the present invention, which contains a surfactant, to form an oil-in-water dispersion after phase conversion. Where compounds of formula (I) and/or cyan couplers of formula (C-I) of the present invention are soluble in alkali substances, they can be dispersed by a so-called Fisher dispersion method. If desired, the dispersion of compounds of formula (I) and/or cyan couplers of formula (C-I) of the present invention may be subjected to distillation, noodle washing or ultrafiltration so as to remove low boiling point organic solvents therefrom, and thereafter the dispersion may be blended with a photographic emulsion. As dispersion media for compounds of formula (I) and/or cyan couplers of formula (C-I) of the present invention, preferably usable are high boiling point organic solvents and/or water-insoluble polymer compounds having a dielectric constant (25° C.) from 2 to 20 and a refractive index (25° C.) from 1.5 to 1.7. Compounds of formula (I) of the present invention are preferably used in the form of a co-emulsion with color couplers.

Examples of high boiling point solvents to be used in an oil-in-water dispersion method which may be employed in the present invention are described in U.S. Pat. No. 2,322,027. As one polymer dispersion method, known is a latex dispersion method which may also be employed in the present invention. The process of such a latex dispersion method, the effect of the same and specific examples of latexes for impregnation to be used in the method are described in U.S. Pat. No. 4,199,363 and German Patent OLS Nos. 2,541,274 and 2,541,230. A dispersion method of using organic solvent-soluble polymers may also be employed in the present invention, which is described in PCT Laid-Open WO88/00723.

As examples of high boiling point organic solvents usable in the above-mentioned oil-in-water method, there are mentioned phthalates (e.g., dibutyl phthalate, dioctyl phthalate, dicyclohexyl phthalate, di-2-ethylhexyl phthalate, decyl phthalate, bis(2,4-di-t-amylphenyl) isophthalate, bis(1,1-diehtylpropyl) phthalate), phosphates or phosphonates (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, di-2-ethylhexylphenyl phosphonate), benzoates (e.g., 2-ethylhexyl benzoate, 2,4-dichlorobenzoate, dodecyl benzoate, 2-ethylhexyl p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate), aniline derivatives (e.g., N,N-dibutyl-2-butoxy 5-tert-octylaniline), chlorinated paraffins (e.g., paraffins having a chlorine content from 10% to 80%), trimesates (e.g., tributyl trimesate), dodecylbenzene, and diisopropylnaphthalene. As auxiliary solvents usable along with the high boiling point organic solvents, there are mentioned, for example, organic solvents having a boiling point of approximately from 30° C. to 160° C., such as ethyl acetate, butyl acetate, ethyl propionate, methyl ethyl ketone, cyclohexanone, 2-ethoxyethyl acetate, and dimethylformamide.

Various color couplers may be used in the present invention, along with cyan couplers of formula (C-I). Specific examples of couplers usable in the present invention are mentioned in patent publications as referred to in *Research Disclosure* (*RD*) No. 17643, VII-C to G and RD No. 307105, VII-C to G.

As yellow couplers usable in the present invention, preferred are those described in, for example, U.S. Pat. Nos. 3,933,501, 4,022,620, 4,326,024, 4,401,752 and 4,248,961, JP-B 58-10739, British Patents 1,425,020 and 1,476,760, U.S. Pat. Nos. 3,973,968, 4,314,023 and 4,511,649, and European Patent 249,473A.

From the viewpoint of color reproducibility, couplers of formula (C-I) of the present invention are desired to be used along with yellow couplers capable of forming dyes having a maximum absorption wavelength as positioned in a short wavelength range and having a sharply decreasing absorption in the long wavelength range of more than 500 nm. Such yellow couplers are described in, for example, JP-A-63-123047 and JP-A-1-173499.

As magenta couplers usable in the present invention, preferred are 5-pyrazolone compounds and pyrazoloazole compounds; and especially preferred are those described in U.S. Pat. Nos. 4,310,619 and 4,351,897, European Patent 73,636, U.S. Pat. Nos. 3,061,432 and 3,725,067, *RD* No. 24420 (June, 1984), JP-A-60-33552, *RD* No. 24230 (June, 1984), JP-A-60-43659, JP-A-61-72238, JP-A-60-35730 JP-A-55-118034 and JP-A-60-185951, U.S. Pat. Nos. 4,500,630, 4,540,654 and 4,556,630, and International Patent Laid-Open WO88/04795.

As cyan couplers which may be used in the present invention together with cyan couplers of formula (C-I), there are mentioned phenol couplers and naphthol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, German Patent OLS No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658.

Colored couplers for correcting the unnecessary absorption of colored dyes may also be used in the present invention, and those described in *RD* No. 17643, VII-G, JP-B-57-39413, U.S. Pat. Nos. 4,163,670, 4,004,929 and 4,138,258 and British Patent 1,146,368 are preferred. Additionally, couplers for correcting the unnecessary absorption of the colored dyes by the phosphor dyes to be released during coupling, as described in U.S. Pat. No. 4,774,181, as well as couplers having a dye precursor group capable of reacting with a developing agent to form dyes, as split-off groups, as described in U.S. Pat. No. 4,777,120 are also preferably used.

Couplers capable of forming colored dyes having a pertinent diffusibility may also be used, and those described in U.S. Pat. No. 4,366,237, British Patent 2,125,570, European Patent 96,570, and German Patent OLS No. 3,234,533 are preferred.

Polymerized dye-forming couplers may also be used, and typical examples of such couplers are described in U.S. Pat. Nos. 3,451,820, 4,080,211, 4,367,282, 4,409,320, 4,576,910, and British Patent 2,102,137.

Couplers capable of releasing a photographically useful residue along with coupling may also be used in the present invention. For instance, as DIR couplers capable of releasing a development inhibitor, those described in the patent publications as referred to in the above-mentioned *RD* No. 17643, Item VII-F, as well as those described in JP-A-57-151944, JP-A-57-154234, JP-A-60-184248 and 63-37346, and U.S. Pat. Nos. 4,248,962 and 4,782,012 are preferred.

As couplers capable of imagewise releasing a nucleating agent or development accelerator during development, those described in British Patents 2,097,140 and 2,131,188, and JP-A-59-157638 and JP-A-59-170840 are preferred.

Additionally, as examples of couplers which may be incorporated into the photographic materials of the present invention, there are further mentioned competing couplers described in U.S. Pat. No. 4,130,427; polyvalent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers capable of releasing a dye which recolors after being released from the coupler, as described in European Patent 173,302A; bleaching accelerator-releasing couplers described in *RD* Nos. 11449 and 24241 and JP-A-61-201247; ligand-releasing couplers described in U.S. Pat. No. 4,553,477; leuco dye-releasing couplers described in JP-A-63-75747; and couplers capable of releasing a fluorescent dye as described in U.S. Pat. No. 4,774,181.

The standard amount of the color couplers capable of being incorporated into the photographic materials of the present invention is from 0.001 to 1 mol per mol of light-sensitive silver halide. Preferably, the amount of yellow couplers may be from 0.01 to 0.5 mol per mol of silver halide; that of magenta couplers may be from 0.003 to 0.3 mol per the same; and that of cyan couplers may be from 0.002 to 0.3 mol per the same.

These couplers usable along with cyan couplers of formula (C-I) can be incorporated into the photographic materials of the present invention by the above-mentioned various known dispersion methods.

The photographic materials of the present invention can contain, as a color fogging inhibitor, hydroquinone derivatives, aminophenol derivatives, gallic acid derivatives and ascorbic acid derivatives.

The photographic materials of the present invention can contain various anti-fading agent along with compounds of formula (I), in such an amount that may display the effect of the present invention. As organic anti-fading agents for cyan, magenta and/or yellow images which are usable in the present invention, for example, there are mentioned hydroquinones, 6-hydroxychromanes, 5-hydroxycoumarans, spirochromans, p-alkoxyphenols, hindered phenols such as bisphenols; as well as gallic acid derivatives, methylenedioxybenzenes, aminophenols, hindered amines and their ether or ester derivatives to be formed by silylating, acylating or alkylating the phenolic hydroxyl group of the compounds. In addition, various metal complexes such as (bissalicylaldoximato)nickel complexes and (bis-N,N-dialkyldithiocarbamato)nickel complexes can also be used.

As specific examples of organic anti-fading agents usable in the present invention, there are mentioned hydroquinones described in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028; 6-hydroxychromanes, 5-hydroxychromanes and spirochromans as described in U.S. Pat. Nos. 3,432,300, 3,573,050, 3,574,627, 3,698,909 and 3,764,337, and JP-A-52-152225; spiroindanes described in U.S. Pat. No. 4,360,589; p-alkoxyphenols described in U.S. Pat. No. 2,735,765, British Patent 2,066,975, JP-A-59-10539, and JP-B-57-19765; hindered phenols described in U.S. Pat. Nos. 3,700,455 and 4,228,235, JP-A-52-72224 and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, British Patents 1,326,889, 1,354,313 and 1,410,846, JP-B-51-1420, JP-A-58-1140-36, JP-A-59-53846 and JP-A-59-78344; and metal complexes described in U.S. Pat. Nos. 4,050,938 and 4,241,155, and British Patent 2,027,731(A). These compounds are added to the photographic layers constituting the photographic material of the present invention in an amount of, generally, from 5 to 100% by weight to the corresponding color couplers, in the form of a co-emulsion with couplers, whereby the intended object may be attained.

For the purpose of inhibiting deterioration of cyan color images by heat and especially by light, an ultraviolet absorbent may effectively be incorporated into the cyan coloring layer and both adjacent layers.

As the ultraviolet absorbent usable for this purpose, there are mentioned aryl-substituted benzotriazole compounds (such as those described in U.S. Pat. No. 3,533,794), 4-thiazolidone compounds (such as those described in U.S. Pat. Nos. 3,314,794 and 3,352,681), benzophenone compounds (such as those described in JP-A-46-2784), cinnamate compounds (such as those described in U.S. Pat. Nos. 3,705,805 and 3,707,395), butadiene compounds (such as those described in U.S. Pat. No. 4,045,229), and benzoxazole compounds (such as those described in U.S. Pat. Nos. 3,406,070 and 4,271,307). Ultraviolet absorbing couplers (for example, cyan dye forming α-naphthol couplers) and ultraviolet absorbing polymers may also be used. These ultraviolet absorbents may be mordanted in particular layers. Above all, the above-mentioned aryl-substituted benzotriazoles are preferred.

The silver halide emulsion to be used in the present invention may have any halogen composition of silver iodobromide, silver iodochlorobromide, silver bromide, silver chlorobromide or silver chloride.

Regarding the halogen composition of grains constituting an emulsion for use in the present invention, the grains may have different halogen compositions. Preferably, however, the emulsion contains grains each having the same halogen composition, as the property of the grains may easily be homogenized. Regarding the halogen composition distribution of the grains constituting a silver halide emulsion for use in the present invention, the grain may have a so-called uniform halogen composition structure where any part of the grain has the same halogen composition; or the grain may have a so-called laminate (core/shell) structure where the halogen composition of the core of the grain is different from that of the shell of the same; or the grain may have a composite halogen composition structure where the inside or surface of the grain has a non-layered different halogen composition part (for example, when such a non-layered different halogen composition part is on the surface of the grain, it may be on the edge, corner or plane of the grain as a conjugated structure). Any of such halogen compositions may properly be selected. In order to obtain a high sensitivity photographic material, the latter laminate or composite halogen composition structure grains are advantageously employed, rather than the first uniform halogen composition structure grains. Such laminate or composite halogen composition structure grains are also preferred for preventing generation of pressure marks. In the case of laminate or composite halogen composition structure grains, the boundary between the different halogen composition parts may be a definite one or may also be an indefinite one for forming a mixed crystal structure because of the difference in the halogen compositions between the adjacent parts. If desired, the boundary between them may positively have a continuous structure variation.

The preferred halogen composition varies, depending upon the kind of the photographic material to which the coupler of the invention is applied. For a color paper, a silver chlorobromide emulsion is preferred. For a picture-taking photographic material such as a color negative film, a silver iodobromide emulsion is preferred. For a direct positive color photographic material, a silver bromide or silver chlorobromide emulsion is preferred. For a color paper photographic material for rapid processing, a so-called high silver chloride emulsion having a high silver chloride content is preferred. The silver chloride content in such a high silver chloride emulsion is preferably 90 mol % or more, more preferably 95 mol % or more.

In such a high silver chloride emulsion, it is preferred that a silver bromide localized phase is in the inside and/or surface of the silver halide grain in the form of a layered or non-layered structure. The halogen composition in the localized phase is preferably such that the silver bromide content therein is at least 10 mol % or more, more preferably more than 20 mol %. The localized phase may be in the inside of the grain or on the edges or corners of the surface of the grain. As one preferred embodiment, the localized phase may be on the corner parts of the grain as epitaxially grown ones.

In the present invention, a silver chlorobromide or silver chloride which does not substantially contain silver iodide is preferably used. The phrase ". . . does not substantially contain silver iodide" as referred to herein means that the silver iodide content in the silver halide is 1 mol % or less, preferably 0.2 mol % or less.

The silver halide grains constituting the silver halide emulsion of the present invention may have a mean grain size of preferably from 0.1 μm to 2 μm, especially preferably from 0.15 μm to 1.5 μm. (The grain size indicates a diameter of a circle having an area equivalent to the projected area of the grain, and the mean grain size indicates a number average value to be obtained from the measured grain sizes.) Regarding the grain size distribution of the emulsion, a so-called monodispersed emulsion having a fluctuation coefficient (to be obtained by dividing the standard deviation of the grain size distribution by the mean grain size) being 20% or less, preferably 15% or less is preferred. For the purpose of obtaining a broad latitude, two or more monodispersed emulsions may be blended to form a mixed emulsion for one layer, or they may be separately coated to form plural layers. Such blending or separate coating is preferably effected for the intended purpose.

Regarding the shape of the silver halide grains of the silver halide emulsion of the present invention, the grains may be regular crystalline ones such as cubic, tetradecahedral or octahedral crystalline ones, or irregular crystalline ones such as spherical or tabular crystalline ones, or may be composite crystalline ones composed of such regular and irregular crystalline ones. They may also be tabular grains.

The silver halide emulsion for use in the present invention may be either a so-called surface latent image type emulsion capable of forming a latent image essentially on the surface of the grain or a so-called internal latent image type emulsion capable of forming a latent image essentially in the inside of the grain.

The silver halide photographic emulsion for use in the present invention can be produced by various known methods, for example, by the methods described in *Research Disclosure* (*RD*) No. 17643 (December, 1978), pages 22 to 23, "I. Emulsion Preparation and Types", ibid., No. 18716 (November, 1979), page 648; P. Glafkides, *Chemie et Phisique Photographique* (published by Paul Montel, 1967); F. Duffin, *Photographic Emulsion Chemistry* (published by Focal Press, 1966); and V. L. Zelikman et al., *Making and Coating Photographic Emulsion* (published by Focal Press, 1964).

Monodispersed emulsions as prepared by the methods described in U.S. Pat. Nos. 3,574,628 and 3,655,394 and British Patent 1,413,748 are also preferably employed in the present invention.

Tabular grains having an aspect ratio of about 5 or more may also be employed in the present invention. Such tabular grains may easily be prepared by known methods, for example, by the methods described in Gutoff, *Photographic Science and Engineering*, Vol. 14, pages 248 to 257 (1970); and U.S. Pat. Nos. 4,434,226, 4,414,310, 4,433,048 and 4,439,520 and British Patent 2,112,157.

Regarding the crystal structure of the silver halide grains for use in the present invention, the grains may have different halogen compositions in the inside of the grain and the surface part thereof, or they may have a layered structure. They may be composed of different silver halide compositions bonded by an epitaxial junction. If desired, the silver halide grains may have any other compound than silver halides, such as silver rhodanide or lead oxide, as bonded to the silver halide matrix by junction.

A mixture comprising silver halide grains having different crystalline forms may also be used.

The silver halide emulsion for use in the present invention may generally be physically ripened, chemically ripened or spectrally sensitized.

Various polyvalent metal ion impurities may be introduced into the silver halide grains for use in the present invention, during the step of forming the grains or the step of physically ripening them. As examples of compounds usable for this purpose, there are mentioned salts of cadmium, zinc, lead, copper or thallium, as well as salts or complex salts of VIII Group elements iron, ruthenium, rhodium, palladium, osmium, iridium or platinum.

Additives usable in physical ripening, chemical ripening and spectral sensitizing steps applicable to the silver halide emulsions for use in the present invention are described in *Research Disclosure* Nos. 17643, 18716 and 307105, and the relevant parts therein are mentioned below. Other known additives which may be used in the present invention are also described in these *Research Disclosures,* and the relevant parts therein are also mentioned below.

| Kind of Additives | RD 17643 | RD 18716 | RD 307105 |
|---|---|---|---|
| 1. Chemical Sensitizer | p. 23 | p. 648, right column | p. 866 |
| 2. Sensitivity Enhancer | | p. 648, right column | |
| 3. Spectral Sensitizer Supercolor Sensitizer | pp. 23 to 24 | p. 648, right column to p. 649, right column | pp. 866 to 868 |
| 4. Whitening Agent | p. 24 | p. 647 | p. 868 |
| 5. Anti-foggant Stabilizer | pp. 24 to 25 | p/ 649, right column | pp. 868 to 870 |
| 6. Light-Absorbent Filter Dye Ultraviolet Absorbent | pp. 25 to 26 | p. 649, right column to p. 650, left column | p. 873 |
| 7. Stain Inhibitor | p. 25, right column | p. 650, left to right column | p. 872 |
| 8. Color Image Stabilizer | p. 25 | p. 650, left column | p. 872 |
| 9. Hardening Agent | p. 26 | p. 651, left column | pp. 875 to 875 |
| 10. Binder | p. 26 | p. 651, left column | pp. 873 to 874 |
| 11. Plasticizer Lubricant | p. 27 | p. 650, right column | p. 876 |
| 12. Coating Aid Surfactant | pp. 26 to 27 | p. 650, right column | pp. 875 to 876 |
| 13. Antistatic Agent | p. 27 | p. 650, right column | pp. 876 to 877 |
| 14. Mat Agent | | | pp. 878 to 879. |

Gelatin is advantageously used as a binder or protective colloid in the emulsion layers constituting the color photographic material of the present invention. Any other hydrophilic colloid may also be used singly or along with gelatin.

Gelatin for use in the present invention may be either a lime-processed gelatin or an acid-processed gelatin. The details of producing gelatin are described in Arther Vais, *The Molecular Chemistry of Gelatin* (published by Academic Press, 1964).

The color photographic material of the present invention can contain various antiseptics and fungicides, such as 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, as described in JP-A-63-257747, JP-A-62-272248 and JP-A-1-80941.

When the color photographic material of the present invention is a direct positive color photographic material, it may contain a nucleating agent, such as hydrazine compounds or quaternary heterocyclic compounds as described in *Research Disclosure* No. 22534 (January, 1983), as well as a nucleation accelerator for promoting the effect of such a nucleating agent.

As the support for the photographic material of the present invention, a transparent film such as cellulose nitrate film or polyethylene terephthalate film, or a reflective support, which is generally used in preparing ordinary photographic materials, can be used. In view of the object of the present invention, a reflective support is more preferred.

A "reflective support" which is advantageously used in the present invention is one capable of elevating the reflectivity of the photographic material to thereby more sharpen the color image as formed in the silver halide emulsion layer. Such a reflective support includes one as prepared by coating a hydrophobic resin containing a photo-reflecting substance, such as titanium oxide, zinc oxide, calcium carbonate or calcium sulfate, as dispersed therein, on a support base; and one as formed from a hydrophobic resin itself containing the above-mentioned photo-reflective substance dispersed therein. For instance, there are mentioned baryta paper; polyethylene-coated paper; polypropylene synthetic paper; and transparent support (such as glass plate, polyester films such as polyethylene terephthalate, cellulose triacetate or cellulose nitrate film, polyamide films, polycarbonate films, polystyrene films, vinyl chloride resin films) as coated with a reflective layer or containing a reflective substance.

The photographic material of the present invention may be processed in accordance with any ordinary photographic processing methods, for example, by the methods described in the above-mentioned *Research Disclosure* No. 17643, pages 28 to 29 and ibid., No. 18716, page 615, from left to right column. For instance, the material is subjected to color development comprising a color developing step, a desilvering step and a rinsing step. In the desilvering step, bleaching with a bleaching solution and fixing with a fixing solution are effected. Alternatively, combined bleach-fixing with a bleach-fixing solution may also be effected. The bleaching step, fixing step and bleach-fixing step may be combined in any desired order. In place of rinsing, stabilization may be effected. If desired, the photographic material may be processed by a mono-bath process using a mono-bath developing and bleach-fixing solution where color development, bleaching and fixation are effected in one bath. In a combination of the processing steps, anyone or more selected from a pre-hardening step, a neutralization step, a stopping and fixing step, a post-hardening step, a compensation step and an intensifying step may be carried out. Between these steps, any desired inter-rinsing step may be carried out. In place of the color development step, a so-called activator processing step may also be effected.

The color developer to be used for developing the photographic material of the present invention is preferably an aqueous alkaline solution containing an aromatic primary amine color developing agent as a main component. As the color developing agent, aminophenol compounds are useful, but p-phenylenediamine compounds are more preferably used. As specific examples of such compounds, there are mentioned 3-methyl-4-amino-N,N-diethylaniline, 3-methyl-4-amino-N-ethyl-N-β-hydroxyethylaniline, 4-amino-N-ehtyl-N-β-hydroxyethylaniline, 3-methyl-4-amino-N-ethyl-N-β-methanesulfonamidoethylaniline, 3-methyl-4-amino-N-ethyl-β-methoxyethylanilne, and sulfates, hydrochlorides and p-toluenesulfonates of the compounds. Above all, especially preferred are 3-methyl-4-amino-N-ethyl-N-β-methanesulfonamidoethylaniline sulfate and 3-mehtyl-4-amino-N-ethyl-N-β-hydroxyethylaniline sulfate. These compounds may be used singly or in combination of two or more of them, in accordance with the intended object.

The color developer generally contains a pH buffer such as alkali metal carbonates, borates or phosphates; and a development inhibitor or an antifoggant such as chlorides, bromides, iodides, benzimidazoles, benzothiazoles or mercapto compounds. If desired, it may also contain various preservatives, such as hydroxylamine, diethylhydroxylamine, sulfites, hydrazines (e.g., N,N-biscarboxymethylhydrazine), phenylsemicarbazides, triethanolamine, and catechol-sulfonic acids; organic solvents such as ethylene glycol and diethylene glycol; development accelerators such as benzyl alcohol, polyethylene glycol, quaternary ammonium salts or amines; dye forming couplers; competing couplers; auxiliary developing agents such as 1-phenyl-3-pyrazolidone; nucleating agents such as sodium boronhydride or hydrazine compounds; thickening agents; various chelating agents such as aminopolycarboxylic acids, aminopolyphosphonic acids, alkylphosphonic acids or phosphonocarboxylic acids (e.g., ethylenediaminetetraacetic acid, nitrilotriacetic acid, diethylenetriamine-pentaacetic acid, cyclohexanediamine-tetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof); brightening agents such as 4,4'-diamino-2,2'-disulfostilbene compounds; and various surfactants such as alkylsulfonic acids, arylsulfonic acid, aliphatic carboxylic acids and aromatic carboxylic acids. The color developer for use in the present invention generally has a pH value from 9 to 12.

The color reversal process to be applied to the photographic material of the present invention generally comprises a black-and-white processing step, a rinsing step, a reversal processing step and a color development step. The reversal processing step may use a reversal bath containing a foggant or may be effected by photoreversal treatment. If desired, such a foggant may be incorporated into a color developer to omit the reversal processing step.

The black-and-white developer to be used in the black-and-white processing step may be any conventional one usable for processing ordinary black-and-white photographic materials, and it may contain any additives generally applicable to ordinary black-and-white developers.

As typical additives, there are mentioned developing agents such as 1-phenyl-3-pyrazolidone, N-methyl-p-aminophenol and hydroquinone; preservatives such as sulfites; pH buffers of water-soluble acids such as acetic acid and boric acid; pH buffers or development accelerators of water-soluble alkaline such as sodium hydroxide, sodium carbonate and potassium carbonate; inorganic or organic development inhibitors such as potassium bromide, 2-methylbenzimidazole and methylbenzothiazole; water softeners such as ethylenediaminetetraacetic acid and polyphosphates; antioxidants such as ascorbic acid or diethanolamine; organic solvents such as triethylene glycol and cellosolves; and surface overdevelopment inhibitors such as a slight amount of iodides and mercapto compounds.

The amount of the replenisher to the color developer is, though depending upon the color photographic material to be processed therewith, generally 3 liters or less per $m^2$ of the material. By reducing the bromide ion concentration in the replenisher, the amount of the replenisher to be replenished to the color developer may be reduced to 500 ml or less. Where the amount of the replenisher is reduced in such a way, it is desired that evaporation or air oxidation of the processing solution is prevented by reducing the contact area between the surface of the processing tank and air.

As a method of reducing the contact area between the surface of the processing tank and air, a surface-masking substance such as a floating lid may be provided on the surface of the processing solution in the processing tank. In addition, a method of using a movable lid as described in JP-A-1-82033 and a slit development method as described in JP-A-63-216050 may also be employed. It is preferred that the technique is employed not only in both the color development and black-and-white development steps but also in all the successive steps of bleaching, bleach-fixing, fixing, rinsing and stabilizing steps. In addition, a means of preventing the accumulation of bromide ions in the developer tank may also be employed so as to reduce the amount of replenisher to be added to the tank.

The color development time is generally set between 2 minutes and 5 minutes. However, by elevating the processing temperature and elevating the pH value of the processing solution (developer) and further elevating the concentration of the color developing agent in the developer, the processing time (color development time) may further be shortened.

The photographic emulsion layer is, after being color-developed, desilvered. Desilvering is effected by simultaneous or separate bleaching and fixation. Simultaneous bleaching and fixation is called bleach-fixation. In order to further accelerate the processing, bleach-fixation may be effected after bleaching. If desired, a bleaching bath comprising two tanks connected in series may be used; or fixation may be effected before bleach-fixation; or bleach-fixation may be effected after bleaching. The processing systems may be selected and employed in accordance with the intended object.

As bleaching agents in the bleaching solution or bleach-fixing solution usable in the present invention, there are mentioned iron salts; compounds of polyvalent metals such as iron(III), cobalt(III), chromium (IV) and chromium (II); per acids; quinones; and Nitro compounds. Specific examples of such agents are iron chloride; ferricyanides; bichromates; organic complexes of iron(III) (for example, metal complexes of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminetetraacetic acid); persulfates, bromates, permanganates, and nitrobenzenes. Above all, aminopolycarboxylato/iron(III) complexes such as ethylenediaminetetraacetato/iron(III) complexes and 1,3-diaminopropanetetraacetato/iron(III) complexes are preferred in view of the rapid processability and for prevention of environmental pollution. Aminopolycarboxylato/iron(III) complexes are useful both in a bleaching solution and especially in a bleach-fixing solution. The bleaching solution or bleach-fixing solution containing such an aminopolycarboxylato/iron(III) complex is used under the condition of a pH value from 3 to 8.

The bleaching solution or bleach-fixing solution may contain various known additives, for example, a rehalogenating agent such as ammonium bromide and ammonium chloride; a pH buffer such as ammonium nitrate; and a metal corrosion inhibitor such as ammonium sulfate.

The bleaching solution or bleach-fixing solution preferably contains an organic acid for the purpose of preventing bleaching stains, in addition to the above-mentioned compounds. Especially preferred organic acids for this purpose are compounds having an acid dissociation constant (pKa) from 2 to 5.5. Specifically, there are preferably mentioned acetic acid and propionic acid.

As a fixing agent to be in the fixing solution or bleach-fixing solution used in the present invention, there are mentioned thiosulfates, thiocyanates, thioether compounds, thioureas, and a large amount of iodides. Generally used are thiosulfates. In particular, ammonium thiosulfate is most widely used. In addition, combination of thiosulfates and thiocyanates, thioether compounds or thioureas is also preferred.

The fixing solution or bleach-fixing solution may contain a preservative such as sulfites, bisulfites, carbonyl-bisulfite adducts, or sulfinic acid compounds described in European Patent 294,769A. In addition, it is preferred to add various aminopolycarboxylic acids or organic phosphonic acids (e.g., 1-hydroxyethylidene-1,1-diphosphonic acid, N,N,N',N'-ethylenediaminetetraphosphonic acid) to the fixing solution or bleach-fixing solution for the purpose of stabilizing the solution.

The fixing solution or bleach-fixing solution may further contain various brightening agents, defoaming agents, surfactants, polyvinyl pyrrolidone and methanol.

The bleaching solution and bleach-fixing solution and the pre-bath thereof may optionally contain a bleaching accelerator. As specific examples of acceptable bleaching accelerators, there are mentioned compounds having a mercapto group or disulfido group as described in U.S. Pat. No. 3,893,858, German Patents 1,290,812 and 2,059,898, JP-A-53-32736, JP-A-53-57831, JP-A-53-37418, JP-A-53-73623, JP-A-53-95630, JP-A-53-95631, JP-A-53-104232, JP-A-53-124424, JP-A-53-141623 and JP-A-53-28426, and *Research Disclosure* No. 17129 (July, 1978); thiazolidine derivatives described in JP-A-50-140129; thiourea derivatives described in JP-B-45-8506, JP-A-52-20832 and 53-32735, and U.S. Pat. No. 3,706,561; iodides described in German Patent 1,127,715, add JP-A-58-16235; polyoxyethylene compounds described in German Patents 966,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide ions. Above all, compounds having a mercapto group or disulfido group are preferred as having a large accelerating effect, and in particular, those described in U.S. Pat. No. 3,893,858, German Patent 1,290,812 and JP-A-53-95630 are especially preferred. In addition, compounds described in U.S. Pat. No. 4,552,834 are also preferred. Such a bleaching accelerator may be added to the photographic material. Where the photographic material of the present invention is a picture-taking color photographic material and it is bleach-fixed, the above-mentioned bleaching accelerators are especially effective.

The total desilvering time is desired to be as short as possible within the range of not causing desilvering failure. The preferred time is from one minute to 3 minutes, more preferably from 1 minute to 2 minutes. The processing temperature may be within the range between 25° C. and 50° C., preferably between 35° C. and 45° C. In the preferred temperature range, the desilvering rate is elevated and staining in the processed materials may effectively be prevented.

In the desilvering step, it is desired that stirring of the system is reinforced as much as possible. As specific means for accelerating the stirring, there are mentioned a method of beating a jet stream of the processing solution against the emulsion-coated surface of the photographic material being processed, as described in JP-A-62-183460 and JP-A-62-183461; a method of using a rotating means so as to augment the stirring effect, as described in JP-A-62-183461; a method of moving the photographic material being processed with the emulsion surface of the material being kept in contact with a wiper blade as provided in the processing solution, so that the flow of the processing solution on the emulsion surface is made turbulant and the stirring effect is thus elevated; and a method of increasing the amount of the circulating flow of all the processing solution. Such stirring accelerating means are effective also in the processing steps with the other bleaching solution, bleach-fixing solution and fixing solution. It is considered that elevation of the stirring efficiency would result in accelerated application of the bleaching agent and fixing agent to the emulsion film and, as a result, the desilvering rate would thereby be elevated. The above-mentioned stirring promoting means are more effective when a bleaching accelerator is used, and the bleaching accelerating effect of the bleaching accelerator used may noticeably be enhanced by the means with the fixation inhibiting action of the same being retarded.

The photographic material of the present invention may be processed with an automatic developing machine, which is preferably equipped with a photographic material conveying means as described in JP-A-60-191257, JP-A-60-191258 and JP-A-60-191259. As so described in JP-A-60-191257, the conveying means may noticeably reduce the amount of the carryover of the processing solution from the previous bath to the next bath so that deterioration of the properties of the processing solution being used may well be prevented. The effect to be attained by provision of the conveying means is especially preferred for shortening the processing time and for reducing the amount of the replenisher to the processing solution.

The color photographic material of the present invention is generally rinsed, after being desilvered as mentioned above. In place of rinsing, stabilization may also be effected. In the stabilization step, any known methods as described, for example, in JP-A-57-8543, JP-A-58-14834 and JP-A-60-220345 may be employed. If desired, a combined rinsing-stabilization step may be effected, in which a stabilizing bath containing a dye-stabilizing agent and a surfactant is used as the final bath. The step is conveniently applied to picture-taking color photographic materials.

The rinsing solution and stabilizing solution applicable to the photographic material of the present invention may contain a water softener such as inorganic phosphoric acids, polyaminocarboxylic acids and organic aminophosphonic acids; a metal salt such as Mg salts, Al salts or Bi salts; a surfactant; and a hardening agent.

The amount of the rinsing water to be used in the rinsing step may be set in a broad range, depending upon the properties of the photographic material being processed (for example, the components constituting the material, such as couplers, etc.), the use of the material, the temperature of the rinsing water, the number of the rinsing tanks (the number of the rinsing stages), the replenishment system of either countercurrent type or normal current type, and other various conditions. The relationship between the number of the rinsing tanks and the rinsing water in a multi-stage countercurrent rinsing system may be obtained in accordance with the method described in *Journal of the Society of Motion Picture and Television Engineers,* Vol. 64, pages 248 to 253 (May, 1955). As a means of overcoming the problems of propagation of bacteria and adhesion of floating substances, which are formed due to noticeable reduction in the amount of the rinsing water to be used in the multi-stage countercurrent rinsing system, to the photographic materials being processed, the method of reducing the amounts of calcium ions and magnesium ions in the rinsing water, as described in JP-A-62-288838, may be used extremely effectively. In addition, isothiazolone compounds and thiabendazoles described in JP-A-57-8542; chlorine-containing bactericides such as chlorinated sodium isocyanurates; and benzoriazoles and other bactericides described in H. Horiguichi, *Chemistry of Bactericidal and Fungicidal Agents* (1986, by Sankyo Publishing Co., Japan), *Bactericidal and Fungicidal Techniques to Microorganisms,* edited by Association of Sanitary Technique, Japan (1982, by Kogyo Gijutsukai, Japan), and *Encyclopeadia of Bactericidal and Fungicidal Agents,* edited by Nippon Bactericide and Fungicide Association, Japan (1986), can also be used.

The pH value of the rinsing water to be used for processing the photographic material of the present invention is from 4 to 9, preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 10 minutes, and preferably the temperature is from 25° C. to 40° C. and the time is from 30 seconds to 5 minutes.

As the dye stabilizing agent which may be in the stabilizing solution, there are mentioned aldehydes such as formalin and glutaraldehyde; N-methylol compounds; hexamethylenetetramine; and aldehyde-sulfite adducts. The stabilizer may further contain a pH adjusting buffer such as boric acid or sodium hydroxide; a chelating agent such as 1-hydroxyethylidene-1,1-diphosphonic acid or ethylenediaminetetraacetic acid; an antioxidant such as alkanolamines; a brightening agent; and a fungicide.

The overflow liquid to be derived by replenishment to the above-mentioned rinsing solution and/or the stabilizing solution may be re-circulated to the other bath such as the previous desilvering bath.

Where the photographic material is processed with an automatic developing machine and the processing solutions used are concentrated due to evaporation during the process, it is desired to add water so as to compensate the concentrated solutions.

The control photographic material of the present invention can contain a color developing agent for the purpose of simply and rapidly processing the material. Preferably, various precursors of color developing materials are incorporated into the material. For instance, as examples of usable precursors, there are mentioned indoaniline compounds described in U.S. Pat. No. 3,342,597, Schiff base compounds described in U.S. Pat. No. 3,342,599, *Research Disclosure* No. 14850 and ibid., No. 5159, aldole compounds described in *Research Disclosure* No. 13924, metal complexes described in U.S. Pat. No. 3,719,492, and urethane compounds described in JP-A-53-135628.

The color photographic material of the present invention may contain, if desired, various 1-phenyl-3-pyrazolidones for the purpose of promoting the color developability thereof. Specific examples of compounds usable for the purpose are described in JP-A-56-64339, JP- A-57-144547 and JP-A-58-115438.

In processing the photographic material of the present invention, the processing solutions are used at a temperature between 10° C. and 50° C. In general, the standard processing temperature is between 33° C. and 38° C. The processing temperature may be elevated higher so as to promote the processing step or to shorten the processing time or it may be lowered so as to improve the image quality of the image to be formed or to promote the stability of the processing solutions being used.

The present invention will be explained in more detail by way of the following examples, which, however, are not intended to restrict the scope of the present invention.

EXAMPLE 1

Formation of Sample No. 101

Plural layers each having the composition mentioned below were formed on a paper support, both surfaces of which were laminated with polyethylene, to form sample No. 101. A coating composition for the first layer was prepared in the manner mentioned below.

Preparation of Coating Composition for First Layer 0.51 g of cyan coupler (RC-1), 0.2 g of sodium dodecylbenzenesulfonate and 0.34 cc of dibutyl phthalate were completely dissolved in 10 cc of ethyl acetate. 30 g of an aqueous 14% gelatin solution was added to the whole of the resulting coupler solution in ethyl actate and dispersed by emulsification with a homogenizer. After dispersion by emulsification, distilled water was added to the resulting dispersion, which was thus made to be 100 g. 100 g of the emulsified dispersion and a silver chlorobromide emulsion (silver chloride content: 95 mol %) were blended and dissolved, which was formed into a coating composition for the first layer having the composition mentioned below. As a gelatin hardening agent, a 1-hydroxy-3,5-dichloro-s-triazine sodium salt was used.

Layer Constitution of Sample No. 101

Support:
Polyethylene-laminated Paper

| First Layer: | |
|---|---|
| Silver Chlorobromide Emulsion | 0.17 g/m$^2$ as Ag |
| Gelatin | 5.03 g/m$^2$ |
| Cyan Coupler (RC-1) | 0.40 mmol/m$^2$ |
| Dibutyl Phthalate | 0.17 cc/m$^2$ |
| Protective Layer: | 1.55 g/m$^2$ |
| Gelatin | |

Formation of Sample No. 102

Sample No. 102 was prepared in the same manner as in preparation of sample No. 101, except that 0.16 g (50 mol % to coupler) of color image stabilizer (comparative compound (a)) was added along with the coupler in preparing the emulsified dispersion.

Preparation of Sample No. 106

Sample No. 106 was prepared in the same manner as in preparation of sample No. 101, except that 0.46 g (100 mol % to coupler) of color image stabilizer (II-23) was added along with the coupler in preparing the emulsified dispersion.

Preparation of Other Samples

Other samples were prepared in the same manner as in preparation of samples Nos. 101, 102 and 106, except that the coupler and the image stabilizer to be added in preparing the emulsified dispersion were varied as indicated in Table 1 below. The amount of the color image stabilizer I added was 50 mol % to the coupler added; and that of the color image stabilizer II was 100 mol % thereto. The amount of the coupler added to each sample of Table 1 was the same molar amount as that added to sample No. 101.

Processing of Samples and Evaluation of Anti-staining Property and Color Image Storability of Processed Samples Samples 101 to 151 thus prepared were wedgewise exposed to a white light and then continuously processed in accordance with the process mentioned below until the amount of the replenisher to the color developer became two times the tank capacity of the color development tank (running test).

Processing Steps:

| Step | Temp. | Time | Replenisher (ml) (*) | Tank Capacity (liter) |
|---|---|---|---|---|
| Color Development | 35° C. | 45 sec | 161 | 17 |
| Bleach-Fixation | 35° C. | 45 sec | 215 | 17 |
| Rinsing (1) | 35° C. | 20 sec | — | 10 |
| Rinsing (2) | 35° C. | 20 sec | — | 10 |
| Rinsing (3) | 35° C. | 20 sec | 360 | 10 |
| Drying | 80° C. | 60 sec | | |

Rinsing was effected by a three-tank countercurrent cascade system from rinsing tank (3) to rinsing tank (1).
(*) This is an amount of the replenisher per m$^2$ of the photographic paper sample being processed.

The processing solutions used in the above-mentioned process are mentioned below.

Color Developer:

| | Tank Solution | Replenisher |
|---|---|---|
| Water | 700 ml | 700 ml |
| Ethylenediaminetetraacetic Acid | 3.0 g | 3.0 g |
| Disodium 1,2-Dihydroxybenzene-4,6-disulfonate | 0.5 g | 0.5 g |
| Triethanolamine | 12.0 g | 12.0 g |
| Potassium Chloride | 1.6 g | — |
| Potassium Bromide | 0.01 g | — |
| Potassium Carbonate | 27.0 g | 27.0 g |
| Brightening Agent (WHITEX 4B, product by Sumitomo Chemical Co.) | 1.0 g | 2.5 g |
| Sodium Sulfite | 0.1 g | 0.2 g |
| Disodium N,N-Bis(sulfonatoethyl)hydroxylamine | 8.0 g | 10.0 g |
| N-Ethyl-N-(β-methanesulfonamidoethyl)-3-methyl-4-aminoaniline Sulfate | 5.0 g | 7.1 g |
| Water to make | 1000 ml | 1000 ml |
| pH (25° C.) | 10.05 | 10.45 |

Bleach-fixing Solution:

Both the tank solution and the replenisher were the same.

| | |
|---|---|
| Water | 600 ml |
| Ammonium Thiosulfate (700 g/liter) | 100 ml |
| Ammonium Ethylenediaminetetraacetate | 55 g |
| Ethylenediaminetetraacetic Acid | 5 g |
| Ammonium Bromide | 40 g |
| Nitric Acid (67%) | 30 g |
| Water to make | 1000 ml |
| pH (25° C.) (with acetic acid or aqueous ammonia) | 5.8 |

After the running test, samples Nos. 101 to 155 were wedgewise exposed in the same manner as in the running test and then developed with the processing solutions used in the running test.

The thus processed samples were subjected to a fading test and to a staining test so as to evaluate them with respect to the anti-fading property and the anti-staining property thereof. Briefly, for evaluating the color image stabilizers used, the processed samples were stored in a conditioned dark place having a temperature of 80° C. and a relative humidity of 70% or in a dark place of 100° C. each for 2 weeks, whereupon the yellow density (stain) in the non-exposed area of each sample was measured. In addition, each processed sample was exposed to a xenon tester (200,000 lux) through a 380 nm UV-cut filter for 12 days, whereupon the cyan density retention percentage at the initial density of 1.0 of each sample was measured.

Measurement of the values was effected with a Fuji Type Densitometer. The results obtained are shown in Table 1 below.

TABLE 1

| Sample | Coupler | Color Image Stabilizer I | Color Image Stabilizer II | Evaluation of Capacity of Color Image Stabilizers: Stain Density 80° C.-70% RH, 2 weeks | Stain Density 100° C., 2 weeks | Dye Retention Percentage (initial density 1.0), Xe (200,000 lux), 12 days | Remarks |
|---|---|---|---|---|---|---|---|
| 101 | RC-1 | — | — | 0.13 | 0.14 | 0.62 | comparative sample |
| 102 | RC-1 | comparative compound (a) | — | 0.13 | 0.13 | 0.66 | comparative sample |
| 103 | RC-1 | comparative compound (b) | — | 0.15 | 0.16 | 0.50 | comparative sample |
| 104 | RC-1 | I-3 | — | 0.14 | 0.14 | 0.64 | comparative sample |
| 105 | RC-1 | I-8 | — | 0.14 | 0.15 | 0.60 | comparative sample |
| 106 | RC-1 | I-30 | — | 0.14 | 0.15 | 0.70 | comparative sample |
| 107 | RC-1 | — | II-23 | 0.14 | 0.15 | 0.63 | comparative sample |
| 108 | RC-1 | — | II-60 | 0.13 | 0.17 | 0.61 | comparative sample |
| 109 | RC-1 | I-3 | II-60 | 0.13 | 0.15 | 0.67 | comparative sample |
| 110 | RC-1 | I-8 | II-60 | 0.14 | 0.18 | 0.64 | comparative sample |
| 111 | RC-2 | comparative compound (a) | — | 0.12 | 0.13 | 0.62 | comparative sample |
| 112 | RC-2 | I-3 | — | 0.15 | 0.14 | 0.63 | comparative sample |
| 113 | RC-2 | I-30 | — | 0.14 | 0.14 | 0.65 | comparative sample |
| 114 | RC-2 | I-3 | II-60 | 0.15 | 0.14 | 0.61 | comparative sample |
| 115 | (12) | — | — | 0.40 | 0.38 | 0.88 | comparative sample |
| 116 | (12) | comparative compound (a) | — | 0.39 | 0.35 | 0.84 | comparative sample |
| 117 | (12) | comparative compound (b) | — | 0.45 | 0.49 | 0.77 | comparative sample |
| 118 | (12) | comparative compound (c) | — | 0.36 | 0.42 | 0.80 | comparative sample |
| 119 | (12) | comparative compound (d) | — | 0.39 | 0.38 | 0.83 | comparative sample |
| 120 | (12) | comparative compound (e) | — | 0.34 | 0.35 | 0.84 | comparative sample |
| 121 | (12) | comparative compound (a) | II-60 | 0.25 | 0.27 | 0.82 | comparative sample |
| 122 | (12) | comparative compound (b) | II-60 | 0.28 | 0.32 | 0.78 | comparative sample |
| 123 | (12) | I-3 | — | 0.22 | 0.21 | 0.91 | sample of the invention |
| 124 | (12) | I-4 | — | 0.22 | 0.21 | 0.92 | sample of the invention |
| 125 | (12) | I-8 | — | 0.24 | 0.25 | 0.90 | sample of the invention |
| 126 | (12) | I-13 | — | 0.23 | 0.21 | 0.94 | sample of the invention |
| 127 | (12) | I-30 | — | 0.24 | 0.22 | 0.92 | sample of the invention |
| 128 | (12) | — | II-23 | 0.25 | 0.28 | 0.86 | comparative sample |
| 129 | (12) | — | II-60 | 0.28 | 0.28 | 0.87 | comparative sample |
| 130 | (12) | I-3 | II-60 | 0.18 | 0.17 | 0.92 | sample of the invention |
| 131 | (12) | I-4 | II-23 | 0.15 | 0.14 | 0.92 | sample of the invention |
| 132 | (12) | I-4 | II-60 | 0.16 | 0.16 | 0.90 | sample of the invention |
| 133 | (12) | I-8 | II-60 | 0.19 | 0.17 | 0.94 | sample of the invention |
| 134 | (12) | I-30 | II-60 | 0.20 | 0.17 | 0.90 | sample of the invention |
| 135 | (32) | — | — | 0.31 | 0.32 | 0.85 | comparative sample |
| 136 | (32) | I-4 | — | 0.21 | 0.23 | 0.93 | sample of the invention |
| 137 | (32) | I-4 | II-60 | 0.14 | 0.16 | 0.95 | sample of the invention |
| 138 | (37) | — | — | 0.44 | 0.48 | 0.80 | comparative sample |

TABLE 1-continued

| Sample | Coupler | Color Image Stabilizer I | Color Image Stabilizer II | Evaluation of Capacity of Color Image Stabilizers: Stain Density 80° C.-70% RH, 2 weeks | Stain Density 100° C., 2 weeks | Dye Retention Percentage (initial density 1.0), Xe (200,000 lux), 12 days | Remarks |
|---|---|---|---|---|---|---|---|
| 139 | (37) | I-4 | — | 0.22 | 0.25 | 0.91 | sample of the invention |
| 140 | (37) | I-4 | II-60 | 0.18 | 0.18 | 0.90 | sample of the invention |
| 141 | (45) | — | — | 0.32 | 0.35 | 0.84 | comparative sample |
| 142 | (45) | comparative compound (a) | — | 0.31 | 0.33 | 0.85 | comparative sample |
| 143 | (45) | comparative compound (b) | — | 0.36 | 0.40 | 0.85 | comparative sample |
| 144 | (45) | comparative compound (a) | II-60 | 0.24 | 0.26 | 0.84 | comparative sample |
| 145 | (45) | comparative compound (b) | II-60 | 0.29 | 0.30 | 0.85 | comparative sample |
| 146 | (45) | I-3 | — | 0.20 | 0.19 | 0.92 | sample of the invention |
| 147 | (45) | I-4 | — | 0.18 | 0.17 | 0.95 | sample of the invention |
| 148 | (45) | I-8 | — | 0.22 | 0.21 | 0.90 | sample of the invention |
| 149 | (45) | I-13 | — | 0.21 | 0.20 | 0.96 | sample of the invention |
| 150 | (45) | I-3 | II-60 | 0.15 | 0.14 | 0.95 | sample of the invention |
| 151 | (45) | I-4 | II-23 | 0.13 | 0.13 | 0.90 | sample of the invention |
| 152 | (45) | I-4 | II-60 | 0.14 | 0.13 | 0.91 | sample of the invention |
| 153 | (48) | — | — | 0.33 | 0.35 | 0.86 | comparative sample |
| 154 | (48) | I-4 | — | 0.19 | 0.19 | 0.92 | sample of the invention |
| 155 | (48) | I-4 | II-60 | 0.14 | 0.14 | 0.92 | sample of the invention |

Comparative compounds used above are shown below.

Comparative Compound (a):

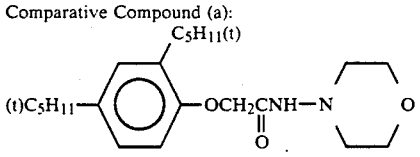

This is a compound described in JP-A 62-270954 and 2-141745.

Comparative Compound (b):

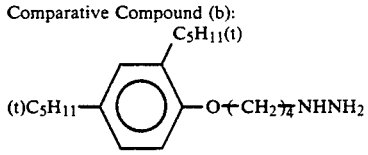

This is a compound described in JP-A 1-147455.

Comparative Compound (c):

-continued

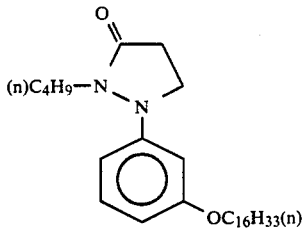

This is a compound described in JP-A 2-148035.

Comparative Compound (d):

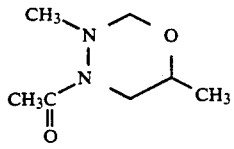

This is a compound described in JP-A 63-256951.

Comparative Compound (e):

-continued

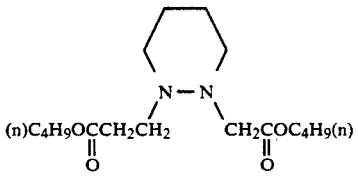

This is a compound described in JP-A 63-220142.

Comparative Coupler (RC-1):

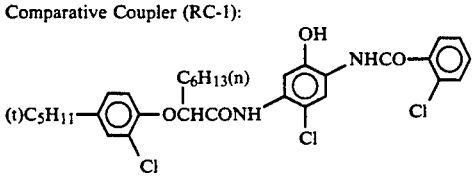

This is a coupler described in JP-A 2-141745.

Comparative Coupler (RC-2):

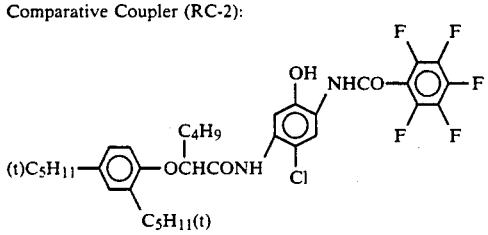

This is a coupler described in JP-A 63-220142.

From the results in Table 1 above, it is understood that the compounds of formula (I) of the present invention are extremely effective for preventing stains to be caused by cyan couplers of formula (C-I), and additionally they are also extremely effective for preventing color images from fading under light. Further, it is also understood that the anti-staining effect of the compounds of formula (I) is augmented due to combination with the compounds of formula (II) of the present invention without impairing the anti-fading property of the formed images under light. In particular, it is understood that the combination of the color image stabilizers of the present invention with couplers of formula (C-1) where $R_0$ is a group of formula ($R_0$-1) is extremely effective.

EXAMPLE 2

Several samples as prepared in Example 1 were subjected to a test for measuring the maximum color density and to a test for testing the raw film (non-processed) storability. For measuring the maximum color density, each sample was left in a dark place having a temperature of 25° C. and a relative humidity of 50% and the maximum color density of the thus stored sample was measured. The thus measured value of each sample was compared with the maximum color density of sample No. 101, and the relative value is shown in Table 2 below. For evaluating the raw film storability, each sample (non-processed) was stored in a conditioned dark place having a temperature of 60° C. and a relative humidity of 40% or in a conditioned dark place having a temperature of 40° C. and a relative humidity of 80%, each for 2 days, and the maximum color density of the thus stored sample was measured. The measured value of each sample was compared with the maximum color density of the corresponding sample as stored in a conditioned dark place having a temperature of 25° C. and a relative humidity of 50% for 2 days, and the relative value thus obtained is shown in Table 2 below. For processing the samples, the processing solutions as used in the running test in Example 1 were used. Measurement of the maximum color density of each sample was effected with a Fuji Type Densitometer (which type?), at the density of Dmax part of each sample, using a red light.

The results thus obtained are shown in Table 2 below.

TABLE 2

| Sample | Relative maximum Color Density | Evaluation of Storability of Raw Film (non-processed): Depression Percentage of Color Density in Dmax Part, 60° C.-40% RH, 2 days | Depression Percentage of Color Density in Dmax Part, 40° C.-80% RH, 2 days | Remarks |
|---|---|---|---|---|
| 101 | 1.00 | 1.00 | 0.98 | comparative sample |
| 112 | 0.92 | 0.97 | 0.95 | comparative sample |
| 113 | 0.85 | 0.91 | 0.86 | comparative sample |
| 116 | 0.87 | 0.93 | 0.90 | comparative sample |
| 120 | 0.91 | 0.99 | 0.99 | sample of the invention |
| 128 | 0.93 | 1.01 | 0.98 | sample of the invention |
| 131 | 1.80 | 0.95 | 0.93 | comparative sample |
| 132 | 1.83 | 1.00 | 1.00 | sample of the invention |
| 133 | 1.85 | 1.00 | 0.99 | sample of the invention |
| 137 | 2.71 | 0.96 | 0.87 | comparative sample |
| 139 | 2.20 | 0.84 | 0.72 | comparative sample |
| 143 | 2.75 | 0.99 | 0.98 | sample of the invention |
| 144 | 2.58 | 1.00 | 1.00 | sample of the invention |

From the results in Table 2 above, it is understood that the photographic material samples of the present invention have excellent color forming property and storability. In particular, it is understood that the samples containing a coupler of formula (C-1) where R0 is a group of formula ($R_0$-1) have an extremely excellent color forming property.

EXAMPLE 3

Formation of Samples Nos. 301 to 305

Samples Nos. 301 to 305 were prepared in the same manner as in preparation of sample No. 118 of Example 1, except that color image stabilizer (II-60) was added in an amount of 0, 5, 10, 50 or 100 mol % to the amount of the coupler. Sample No. 301 is same as sample No. 118; and sample No. 305 is same as sample No. 125.

Formation of Samples Nos. 306 to 310

On the basis of sample No. 139 in Example 1, samples Nos. 306 to 310 were prepared in the same manner as in preparation of samples Nos. 301 to 305, respectively.

Processing of Samples and Evaluation of Anti-staining property and Color Image Storability of Processed Samples The thus prepared samples were wedgewise exposed to a white light and then processed with the processing solutions as used in the running test in Example 1.

The thus processed samples were subjected to the same fading test and staining test as those employed in Example 1, with respect to the anti-fading property and the anti-staining property of the images formed in the samples. The results obtained are shown in Table 3 below.

TABLE 3

| Sample | Coupler | Color Image Stabilizer I | Color Image Stabilizer/Amount Added (mol %) (vs. coupler) | Evaluation of Capacity of Color Image Stabilizer: Stain Density 80° C.-70% RH, 2 weeks | Stain Density 100° C., 2 weeks | Dye Retention Percentage (initial density 1.0), Xe (200,000 lux), 12 days | Remarks |
|---|---|---|---|---|---|---|---|
| 301 | (12) | I-4 | II-60/0 | 0.23 | 0.21 | 0.92 | sample of the invention |
| 302 | (12) | I-4 | II-60/5 | 0.22 | 0.21 | 0.91 | sample of the invention |
| 303 | (12) | I-4 | II-60/10 | 0.18 | 0.19 | 0.93 | sample of the invention |
| 304 | (12) | I-4 | II-60/50 | 0.18 | 0.17 | 0.90 | sample of the invention |
| 305 | (12) | I-4 | II-60/100 | 0.16 | 0.16 | 0.91 | sample of the invention |
| 306 | (45) | I-4 | II-60/0 | 0.18 | 0.17 | 0.95 | sample of the invention |
| 307 | (45) | I-4 | II-60/5 | 0.18 | 0.17 | 0.94 | sample of the invention |
| 308 | (45) | I-4 | II-60/10 | 0.16 | 0.16 | 0.94 | sample of the invention |
| 309 | (45) | I-4 | II-60/50 | 0.16 | 0.15 | 0.95 | sample of the invention |
| 310 | (45) | I-4 | II-60/100 | 0.14 | 0.13 | 0.96 | sample of the invention |

From the results in Table 3 above, it is understood that the compounds of formula (II) of the present invention positively display an anti-staining effect when added in an amount of 10 mol % or more to coupler.

EXAMPLE 4

Formation of Sample No. 401

Plural layers each having the composition mentioned below were formed on a paper support, both surfaces of which are laminated with polyethylene, to form sample No. 401. A coating composition for the first layer was prepared in the manner mentioned below.

Preparation of Coating Composition for First Layer 0.71 g of cyan coupler (12), 0.2 g of sodium dodecylbenzenesulfonate and 0.35 cc of tri(2-ethylhexyl) phosphate were completely dissolved in 10 cc of ethyl acetate. 30 g of an aqueous 14% gelatin solution was added to the whole of the coupler solution in ethyl acetate and dispersed by emulsification with a homogenizer. After dispersion by emulsification, distilled water was added to the resulting dispersion, which was thus made to be 100 g. Using 100 g of the emulsified dispersion thus formed, a coating composition for the first layer having the composition mentioned below was prepared. As a gelatin hardening agent, a 1-hydroxy-3,5-dichloro-s-triazine sodium salt was used.

Layer Constitution of Sample No. 401

Support:
Polyethylene-laminated Paper

| | |
|---|---|
| First Layer: | |
| Gelatin | 5.03 g/m$^2$ |
| Coupler | 0.64 mol/m$^2$ |
| Tri(2-ethylhexyl) Phosphate | 0.20 cc/m$^2$ |
| Protective Layer: | 1.55 g/m$^2$ |
| Gelatin | |

Formation of Samples Nos. 402 to 415

Samples Nos. 402 to 415 were prepared in the same manner as above, except that the coupler used in Sample No. 401 was replaced by one as indicated in Table 4 and that the compound(s) of the present invention was/were added in the manner also as indicated in Table 4. The amount of the coupler of each sample was the same molar amount of the coupler in sample No. 401. Compounds of formulae (I) and (II) were added to each sample in an amount of 50 mol % and 100 mol %, respectively, to coupler.

Evaluation of Anti-staining Property of Samples

The reflection density to blue light of each of the thus prepared samples Nos. 401 to 415 was measured. Next, these samples were stored in a conditioned dark place having a temperature of 80° C. and a relative humidity of 70% for 15 days, or in a dark place having a temperature of 100° C. for 10 days, or in a xenon tester (200,000 lux) for 3 days. Then, the reflection density to blue light of each of the thus stored sample was again measured. The density increment of each of the stored samples is shown in Table 4 below.

TABLE 4

| Sample | Coupler | Color Image Stabilizer I | Color Image Stabilizer II | Evaluation of Anti-staining Capacity: Density Increment 80° C.-70% RH, 15 days | Density Increment 100° C., 10 days | Density Increment Xe (200,000 lux), 3 days | Remarks |
|---|---|---|---|---|---|---|---|
| 401 | (12) | — | — | 0.28 | 0.34 | 0.14 | comparative sample |
| 402 | (12) | comparative compound (a) | — | 0.26 | 0.29 | 0.12 | comparative sample |
| 403 | (12) | comparative compound (b) | — | 0.33 | 0.35 | 0.14 | comparative sample |
| 404 | (12) | I-3 | — | 0.10 | 0.12 | 0.06 | sample of the invention |
| 405 | (12) | I-4 | — | 0.09 | 0.12 | 0.05 | sample of the invention |
| 406 | (12) | I-8 | — | 0.15 | 0.15 | 0.08 | sample of the invention |
| 407 | (12) | I-4 | II-23 | 0.05 | 0.04 | 0.05 | sample of the invention |
| 408 | (12) | I-4 | II-60 | 0.06 | 0.07 | 0.04 | sample of the invention |
| 409 | (32) | I-4 | II-60 | 0.04 | 0.06 | 0.04 | sample of the invention |
| 410 | (45) | — | — | 0.20 | 0.25 | 0.14 | comparative sample |
| 411 | (45) | comparative compound (b) | — | 0.25 | 0.28 | 0.15 | comparative sample |
| 412 | (45) | I-4 | — | 0.08 | 0.06 | 0.04 | sample of the invention |
| 413 | (45) | I-8 | — | 0.11 | 0.10 | 0.07 | sample of the invention |
| 414 | (45) | I-4 | II-60 | 0.03 | 0.02 | 0.05 | sample of the invention |
| 415 | (48) | I-4 | II-60 | 0.04 | 0.04 | 0.05 | sample of the invention |

From the results in Table 4 above, it is understood that the anti-staining effect of the compounds of the present invention is out of relation to development of the photographic materials containing them.

EXAMPLE 5

One surface of a paper support, both surfaces of which were laminated with polyethylene, was subjected to corona discharging treatment, and a subbing gelatin layer containing sodium dodecylbenzenesulfonate was provided on the surface and plural photographic layers mentioned below were then coated over the subbing layer to prepare a multi-layer color photographic paper. Coating compositions for the photographic layers were prepared as mentioned below.

Preparation of Coating Composition for Fifth Layer

A mixture of 50.0 cc of ethyl acetate and 14.0 g of solvent (Solv-6) was added to a mixture of 32.0 g of cyan coupler (ExC), 3.0 g of image stabilizer (Cpd-2), 2.0 g of image stabilizer (Cpd-4), 18.0 g of image stabilizer (Cpd-6), 40.0 g of image stabilizer (Cpd-7) and 5.0 g of image stabilizer (Cpd-8) to obtain a solution. The resulting solution was added to 500 cc of aqueous 20% gelatin solution containing 8 cc of sodium dodecylbenzenesulfonate and then emulsified and dispersed with an ultrasonic homogenizer to prepare an emulsified dispersion. On the other hand, a silver chlorobromide emulsion was prepared, which was a mixture (¼ as silver molar ratio) comprising a large-size emulsion of cubic grains having a mean grain size of 0.58 μm and a small-size emulsion of cubic grains having a mean grain size of 0.45 μm. The two emulsions had a fluctuation coefficient of grain size distribution of 0.09 and 0.11, respectively. They each had 0.6 mol % of silver bromide locally on a part of the surfaces of the grains. The red-sensitizing dye mentioned below was added to the mixture emulsion in an amount of $0.9\times10^{-4}$ mol per mol of silver to the large-size emulsion and $1.1\times10^{-4}$ mol per mol of silver to the small-size emulsion. Then, the silver chlorobromide emulsion was chemically sensitized with a sulfur sensitizer and a gold sensitizer. The previously prepared emulsified dispersion and the red-sensitive silver chlorobromide emulsion were blended to obtain a coating composition for the fifth layer, which comprised the components mentioned below.

Other coating compositions for the first layer to the fourth layer, the sixth layer and the seventh layer were prepared in the same manner as above. 1-Hydroxy-3,5-dichloro-s-triazine sodium salt was used as the gelatin hardening agent for each layer.

Each layer contained 25.0 mg/m² of Cpd-10 and 50.0 mg/m² of Cpd-11.

The following color sensitizing dyes were added to the silver chlorobromide emulsions for the respective light-sensitive layers.

Blue-sensitive Emulsion Layer

Sensitizing Dye A:

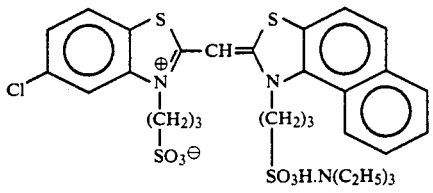

and

Sensitizing Dye B:

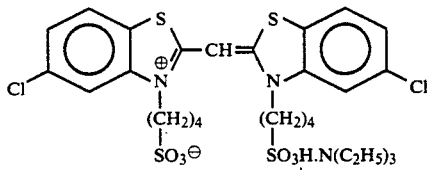

(The both were each added in an amount of $2.0\times10^{-4}$ mol per mol of silver halide to the large-size emulsion and $2.5\times10^{-4}$ mol per mol of silver halide to the small-size emulsion.)

Green-sensitive Emulsion Layer

Sensitizing Dye C:

-continued

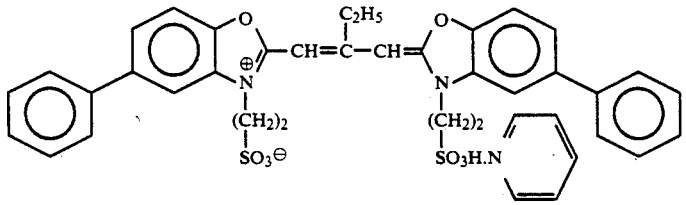

(This was added in an amount of $4.0\times10^{-4}$ mol per mol of silver halide to the large-size emulsion and $5.6\times10^{-4}$ mol per mol of silver halide to the small-size emulsion.)

Sensitizing Dye D:

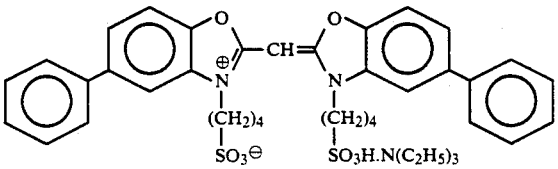

(This was added in an amount of $7.0\times10^{-5}$ mol per mol of silver halide to the large-size emulsion and $1.0\times10^{-5}$ mol per mol of silver halide to the small-size emulsion.)

Red-sensitive Emulsion Layer

Sensitizing Dye E:

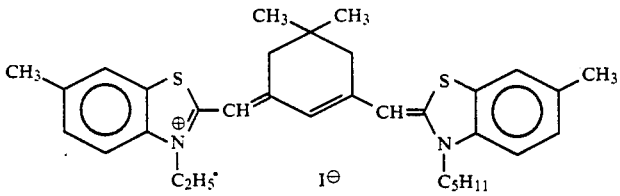

(This was added in an amount of $0.9\times10^{-4}$ mol per mol of silver halide to the large-size emulsion and $1.1\times10^{-4}$ mol per mol of silver halide to the small-size emulsion.)

To the red-sensitive emulsion layer was added the following compound in an amount of $2.6\times10^{-3}$ mol per mol of silver halide.

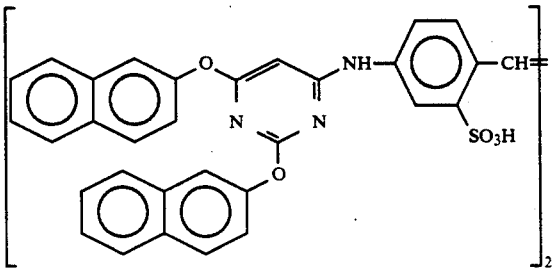

To each of the blue-sensitive emulsion layer, green-sensitive emulsion layer and red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, each per mol of silver halide, respectively.

To each of the blue-sensitive emulsion layer and green-sensitive emulsion layer was added 4-hydroxy-6-methyl-1,3,3a,7-tetrazaindene in an amount of $1\times10^{-4}$ mol and $2\times10^{-4}$ mol, each per mol of silver halide, respectively.

The following dyes were added to each emulsion layer for anti-irradiation. (The amount in parenthesis indicates the amount of each dye coated.)

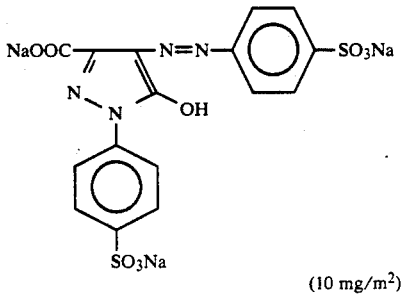

(10 mg/m²)

-continued

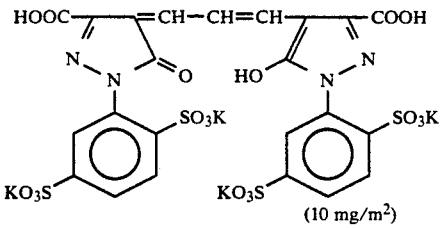

(10 mg/m²)

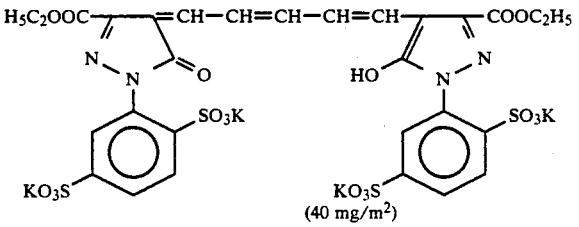

and (40 mg/m²)

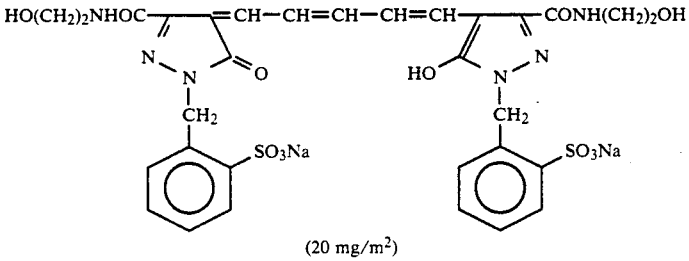

(20 mg/m²)

Layer Constitution of Sample Photographic Material

The composition of each layer of the sample photographic material is mentioned below. The number indicates the amount of the component coated (g/m²). The amount of the silver halide emulsion coated is represented by the amount of silver coated therein.

Support:

Polyethylene-laminated Paper (containing white pigment ($TiO_2$) and bluish dye (ultramarine) in polyethylene below the first layer)

First Layer (Blue-sensitive Layer)

| | |
|---|---|
| Silver Chlorobromide Emulsion (3/7 (as silver molar ratio) mixture comprising a large-size emulsion of cubic grains with a mean grain size of 0.88 μm and a small-size emulsion of cubic grains with a mean grain size of 0.70 μm; the two emulsions each having a fluctuation coefficient of grain size distribution of 0.08 and 0.10, respectively, and each having 0.3 mol % of AgBr localized on the surfaces of the grains) | 0.30 |
| Gelatin | 1.86 |
| Yellow Coupler (ExY) | 0.82 |
| Color Image Stabilizer (Cpd-1) | 0.19 |
| Solvent (Solv-3) | 0.18 |
| Solvent (Solv-7) | 0.18 |
| Color Image Stabilizer (Cpd-7) | 0.06 |

Second Layer (Color Mixing Preventing Layer):

| | |
|---|---|
| Gelatin | 0.99 |
| Color Mixing Preventing Agent (Cpd-5) | 0.08 |
| Solvent (Solv-1) | 0.16 |
| Solvent (Solv-4) | 0.08 |

Third Layer (Green-sensitive Layer):

| | |
|---|---|
| Silver Chlorobromide Emulsion (1/3 (as silver molar ratio) mixture comprising a large-size emulsion of cubic grains with a mean grain size of 0.55 μm and a small-size emulsion of cubic grains with a mean grain size of 0.39 μm; the two emulsions each having a fluctuation coefficient of grain size distribution of 0.10 and 0.08, respectively, and each having 0.8 mol % of AgBr localized on the surfaces of the grains) | 0.12 |
| Gelatin | 1.24 |
| Magenta Coupler (ExM) | 0.23 |
| Color Image Stabilizer (Cpd-2) | 0.03 |
| Color Image Stabilizer (Cpd-3) | 0.16 |
| Color Image Stabilizer (Cpd-4) | 0.02 |
| Color Image Stabilizer (Cpd-9) | 0.02 |
| Solvent (Solv-2) | 0.40 |

Fourth Layer (Ultraviolet Absorbing Layer):

| | |
|---|---|
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |

Fifth Layer (Red-sensitive Layer):

| | |
|---|---|
| Silver Chlorobromide Emulsion (1/4 (as silver molar ratio) mixture comprising a large-size emulsion of cubic grains with a mean grain size of 0.58 μm and a small-size emulsion of cubic grains with a mean grain size of 0.45 μm; the two emulsions each having a fluctuation coefficient of grain size distribution of 0.09 and 0.11, respectively, and each having 0.6 mol % of AgBr localized on the surfaces of the grains) | 0.23 |
| Gelatin | 1.34 |
| Cyan Coupler (ExC) | 0.32 |
| Color Image Stabilizer (Cpd-2) | 0.03 |
| Color Image Stabilizer (Cpd-4) | 0.02 |

-continued

| | |
|---|---|
| Color Image Stabilizer (Cpd-6) | 0.18 |
| Color Image Stabilizer (Cpd-7) | 0.40 |
| Color Image Stabilizer (Cpd-8) | 0.05 |
| Solvent (Solv-6) | 0.14 |

Sixth Layer (Ultraviolet Absorbing Layer):

| | |
|---|---|
| Gelatin | 0.53 |
| Ultraviolet Absorbent (UV-1) | 0.16 |
| Color Mixing Preventing Agent (Cpd-5) | 0.02 |

-continued

| | |
|---|---|
| Solvent (Solv-5) | 0.08 |

Seventh Layer (Protective Layer):

| | |
|---|---|
| Gelatin | 1.33 |
| Acryl-modified Copolymer of Polyvinyl Alcohol (modification degree 17%) | 0.17 |
| Liquid Paraffin | 0.03 |

The compounds used above are mentioned below.

(ExY)Yellow Coupler:

1/1 (by mol) mixture of the following:

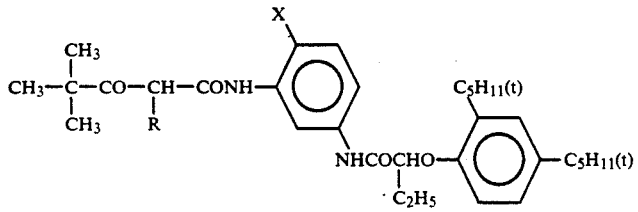

R=

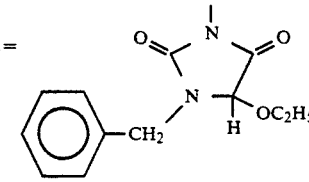

X = Cl and

R=

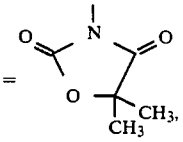

X = $OCH_3$ (ExM)Magenta Coupler:

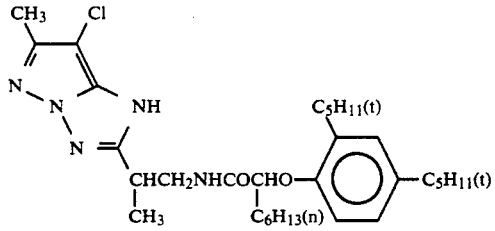

(ExC)Cyan Coupler:

1/1 (by mol) mixture of the following:

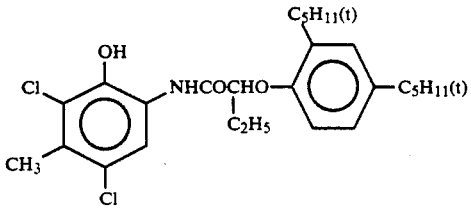

and

-continued
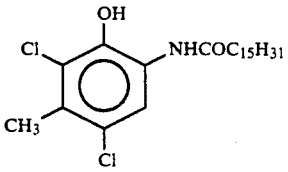
(Cpd-1) Color Image Stabilizer:
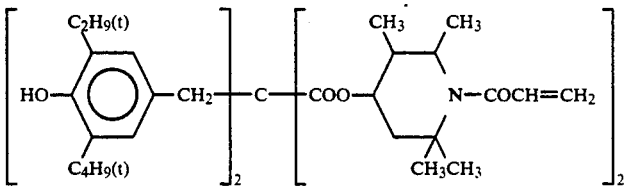
(Cpd-2) Color Image Stabilizer:
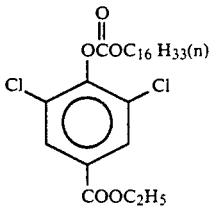
(Cpd-3) Color Image Stabilizer:
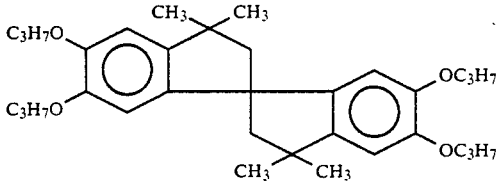
(Cpd-4) Color Image Stabilizer:
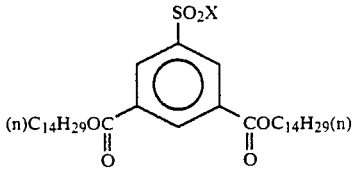
(Cpd-5) Color Mixing Inhibitor:
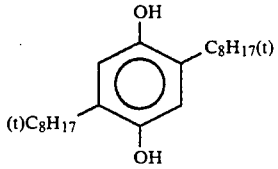
(Cpd-6) Color Image Stabilizer:
2/4/4 mixture (by weight) of the following:
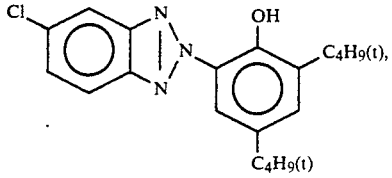

-continued
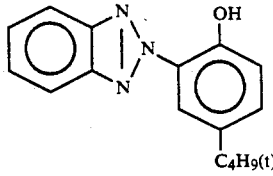
and
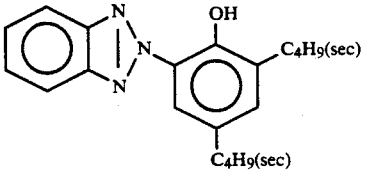
(Cpd-7) Color Image Stabilizer:
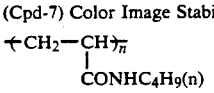
(average molecular weight: 60,000)
(Cpd-8) Color Image Stabilizer:
1/1 mixture (by weight) of the following:
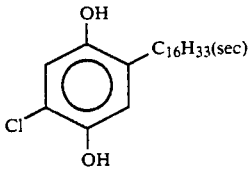
and
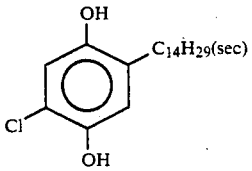
(Cpd-9) Color Image Stabilizer:
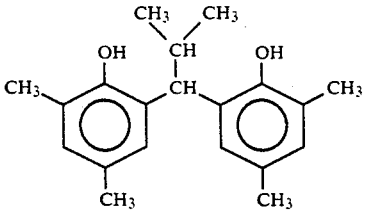
(Cpd-10) Preservative:
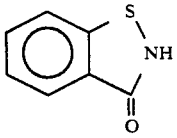
(Cpd-11) Preservative:
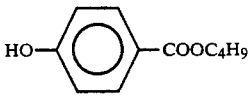
(UV-1) Ultraviolet Absorbent:
4/2/4 mixture (by weight) of the following:
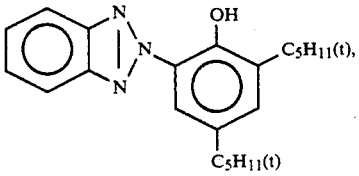

-continued

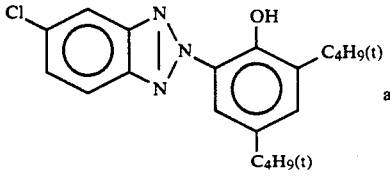

and

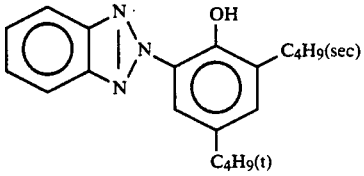

(Solv-1) Solvent:

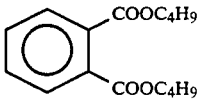

(Solv-2) Solvent:
1/1 mixture (by volume) of the following:

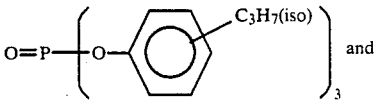

and

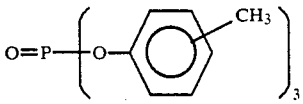

(Solv-3) Solvent:
$O{=}P{+}O{-}C_9H_{19}(iso)]_3$ (Solv-4) Solvent:

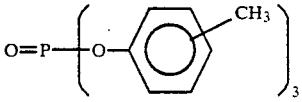

(Solv-5) Solvent:

$$\begin{array}{l} COOC_3H_{17} \\ | \\ (CH_2)_8 \\ | \\ COOC_3H_{17} \end{array}$$

(Solv-6) Solvent:
80/20 mixture (by volume) of the following:

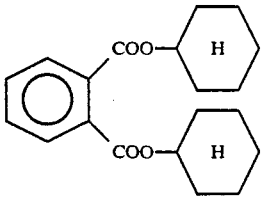

and $$C_8H_{17}\underset{\diagdown\ \diagup}{CH\ CH}(CH_2)_7COOC_8H_{17}$$
$$\quad\ \ O$$

(Solv-7) Solvent:

$$C_8H_{17}\underset{\diagdown\ \diagup}{CH\ CH}(CH_2)_7COOC_8H_{17}$$
$$\quad\ \ O$$

Using a sensitometer (FWH Model, manufactured by Fuji Photo Film Co. the light source has a color temperature of 3200° K.), the sample was wedgewise exposed through a sensitometrical three-color separation filter, whereupon the exposure time was 0.1 second and the exposure amount was 250 CMS.

The exposed paper sample was subjected to a running test where it was processed with a photographic paper processing machine in accordance with the processing steps mentioned below, using the processing solutions also mentioned below, until the amount of the replenisher used became two times the tank capacity of the color developer tank.

Processing Steps:

| Step | Temp. | Time | Replenisher (ml) (*) | Tank Capacity (liter) |
|---|---|---|---|---|
| Color Development | 35° C. | 45 sec | 161 | 17 |
| Bleach-Fixation | 30 to 35° C. | 45 sec | 215 | 17 |
| Rinsing (1) | 30 to 35° C. | 20 sec | — | 10 |
| Rinsing (2) | 30 to 35° C. | 20 sec | — | 10 |
| Rinsing (3) | 30 to 35° C. | 20 sec | 350 | 10 |
| Drying | 70 to 80° C. | 60 sec | | |

Rinsing was effected by a three-tank countercurrent cascade system from rinsing tank (3) to rinsing tank (1).
(*) This is an amount of the replenisher per $m^2$ of the photographic paper sample being processed.

The processing solutions used in the above-mentioned process are mentioned below.

Color Developer:

| | Tank Solution | Replenisher |
|---|---|---|
| Water | 800 ml | 800 ml |
| Ethylenediamine-N,N,N,N'-tetramethylene-phosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)hydrazine | 4.0 g | 5.0 g |
| N,N-Di(sulfoethyl)hydroxylamine.1-Na | 4.0 g | 5.0 g |
| Brightening Agent (WHITEX 4B, product by Sumitomo Chemical Co.) | 1.0 g | 2.0 g |
| Water to make | 1000 ml | 1000 ml |
| pH (25° C.) | 10.05 | 10.45 |

Bleach-fixing Solution:

Both the tank solution and the replenisher were the same.

| | |
|---|---|
| Water | 400 ml |
| Ammonium Thiosulfate (70%) | 100 ml |
| Sodium Sulfite | 17 g |
| Ammonium Ethylenediaminetetraacetato/iron(III) | 55 g |
| Disodium Ethylenediaminetetraacetate | 5 g |
| Ammonium Bromide | 40 g |
| Water to make | 1000 ml |
| pH (25° C.) | 6.0 |

Rinsing Solution:

Both the tank solution and the replenisher were the same.

An ion-exchanged water (having a calcium content and a magnesium content of each being 3 ppm or less) was used.

The photographic paper sample thus prepared and processed was called sample 1A. In the same manner, other samples 2A to 36A were prepared, except that the cyan coupler in the fifth layer was replaced by one as indicated in Table 5 below and that the color image stabilizer also as indicated in Table 1 was incorporated into the fifth layer along with the indicated cyan coupler in the form of a co-emulsion of the two. The amount of the added color image stabilizer was 50 mol % to the cyan coupler. Comparative compounds (a) to (d) and comparative coupler (RC-1) were the same as those used in Example 1.

The samples thus processed to form a color image thereon were subjected to an anti-fading test in which the processed samples were stored under the conditions of 80° C. and 70% RH for 12 days or were stored under the conditions of 100° C. for 10 days whereupon the stain density of the non-exposed area of each sample was measured. In addition, each sample was exposed to a xenon tester (200,000 lux) for 12 days and then the cyan density retention in the area having an initial cyan density of 1.0 was measured. On the basis of the measured values, the anti-fading effect of each sample was evaluated. Measurement of the tested samples was effected by the use of a Fuji Autosensitometer.

The results obtained are shown in Table 5 below.

TABLE 5

| Sample | Coupler | Color Image Stabilizer | Evaluation of Anti-Fading Test: Stain Density (80° C., 70% RH, 12 days) | Stain Density (100° C., 10 days) | Dye Retention, initial density 1.0, Xe (200,000 lux), 12 days | Remarks |
|---|---|---|---|---|---|---|
| 1A | EXC | — | 0.21 | 0.15 | 60% | comparative sample |
| 2A | EXC | comparative compound (a) | 0.21 | 0.15 | 62 | comparative sample |
| 3A | EXC | comparative compound (b) | 0.25 | 0.18 | 53 | comparative sample |
| 4A | EXC | I-30 | 0.20 | 0.14 | 63 | comparative sample |
| 5A | (9) | — | 0.30 | 0.33 | 61 | comparative sample |
| 6A | (9) | comparative compound (a) | 0.27 | 0.30 | 64 | comparative sample |
| 7A | (9) | comparative compound (b) | 0.40 | 0.42 | 50 | comparative sample |
| 8A | (9) | I-30 | 0.27 | 0.27 | 79 | sample of the invention |

TABLE 5-continued

| Sample | Coupler | Color Image Stabilizer | Evaluation of Anti-Fading Test: Stain Density (80° C., 70% RH, 12 days) | Stain Density (100° C., 10 days) | Dye Retention, initial density 1.0, Xe (200,000 lux), 12 days | Remarks |
|---|---|---|---|---|---|---|
| 9A | (9) | I-1 | 0.23 | 0.18 | 85 | sample of the invention |
| 10A | (9) | I-30 | 0.26 | 0.25 | 83 | sample of the invention |
| 11A | (9) | I-4 | 0.25 | 0.24 | 82 | sample of the invention |
| 12A | (9) | I-8 | 0.27 | 0.28 | 79 | sample of the invention |
| 13A | (9) | I-13 | 0.22 | 0.19 | 85 | sample of the invention |
| 14A | (12) | — | 0.32 | 0.35 | 61 | comparative sample |
| 15A | (12) | comparative compound (a) | 0.29 | 0.32 | 62 | comparative sample |
| 16A | (12) | comparative compound (b) | 0.41 | 0.42 | 48 | comparative sample |
| 17A | (12) | I-30 | 0.28 | 0.29 | 79 | sample of the invention |
| 18A | (12) | I-2 | 0.25 | 0.25 | 81 | sample of the invention |
| 19A | (12) | I-12 | 0.22 | 0.22 | 82 | sample of the invention |
| 20A | (12) | I-18 | 0.23 | 0.20 | 85 | sample of the invention |
| 21A | (12) | I-25 | 0.22 | 0.20 | 84 | sample of the invention |
| 22A | EXC | I-13 | 0.21 | 0.15 | 61 | comparative sample |
| 23A | EXC | I-14 | 0.21 | 0.16 | 62 | comparative sample |
| 24A | EXC | I-23 | 0.22 | 0.16 | 62 | comparative sample |
| 25A | EXC | I-3 | 0.22 | 0.17 | 61 | comparative sample |
| 26A | EXC | comparative compound (c) | 0.22 | 0.15 | 67 | comparative sample |
| 27A | EXC | comparative compound (d) | 0.23 | 0.15 | 64 | comparative sample |
| 28A | (9) | comparative compound (c) | 0.29 | 0.32 | 68 | comparative sample |
| 29A | (9) | comparative compound (d) | 0.30 | 0.35 | 63 | comparative sample |
| 30A | comparative coupler (a) | — | 0.24 | 0.18 | 45 | comparative sample |
| 31A | comparative coupler (a) | comparative compound (a) | 0.24 | 0.19 | 48 | comparative sample |
| 32A | comparative coupler (a) | comparative compound (b) | 0.28 | 0.23 | 40 | comparative sample |
| 33A | comparative coupler (a) | comparative compound (c) | 0.23 | 0.18 | 55 | comparative sample |
| 34A | comparative coupler (a) | I-1 | 0.24 | 0.18 | 48 | comparative sample |
| 35A | comparative coupler (a) | I-3 | 0.24 | 0.19 | 45 | comparative sample |
| 36A | comparative coupler (a) | I-13 | 0.25 | 0.18 | 47 | comparative sample |

The photographic materials of the present invention contain couplers of formula (C-1) in combination with compounds of formula (I) so that they have much more improved color image fastness than any other conventional photographic materials.

EXAMPLE 6

Samples (1B) to (9B) were prepared in the same manner as in the preparation of samples (5A) to (13A) of Example 5, except that color image stabilizer (Cpd-2) was removed from the fifth layer and that compound (II-60) was co-emulsified therein in an amount of 100 mol % to the coupler. These samples were subjected to the same forced fading test as that in Example 5. For development of the samples, the processing solutions prepared in Example 5 were used. The results obtained are shown in Table 6 below.

TABLE 6

| Sample | Coupler | Color Image Stabilizer I | Color Image Stabilizer II | Evaluation of Anti-staining Capacity: Density Increment 80° C.-70% RH, 15 days | Density Increment 100° C., 10 days | Density Increment Xe (200,000 lux), 3 days | Remarks |
|---|---|---|---|---|---|---|---|
| 1B | (9) | — | II-60 | 0.25 | 0.29 | 60% | comparative sample |
| 2B | (9) | comparative | II-60 | 0.24 | 0.28 | 65% | comparative sample |

TABLE 6-continued

| Sample | Coupler | Color Image Stabilizer I | Color Image Stabilizer II | Evaluation of Anti-staining Capacity: Density Increment 80° C.-70% RH, 15 days | Density Increment 100° C., 10 days | Density Increment Xe (200,000 lux), 3 days | Remarks |
|---|---|---|---|---|---|---|---|
| 3B | (9) | compound (a) comparative compound (b) | II-60 | 0.29 | 0.31 | 48% | comparative sample |
| 4B | (9) | I-29 | II-60 | 0.23 | 0.24 | 79% | sample of the invention |
| 5B | (9) | I-1 | II-60 | 0.22 | 0.17 | 84% | sample of the invention |
| 6B | (9) | I-3 | II-60 | 0.22 | 0.21 | 83% | sample of the invention |
| 7B | (9) | I-4 | II-60 | 0.20 | 0.16 | 83% | sample of the invention |
| 8B | (9) | I-8 | II-60 | 0.25 | 0.24 | 79% | sample of the invention |
| 9B | (9) | I-13 | II-60 | 0.21 | 0.15 | 84% | sample of the invention |

From the results in Table 6 above, it is understood that the compounds of formula (II) of the present invention are effective even in multi-layer color photographic material samples.

EXAMPLE 7

Samples (1C) to (15C) were prepared in the same manner as in Example 5, except that color image stabilizer (Cpd-2) and color image stabilizer (Cpd-7) were removed from the fifth layer and that the coupler and color image stabilizers as indicated in Table 7 were incorporated, the amounts coated being reduced to 40 % of those in Example 5.

These samples were subjected to the same forced fading test as that in Example 5. Development of the samples were effected with the processing solutions as prepared in Example 5. The maximum cyan color density of the samples of the present invention was not lower than the maximum cyan color density of sample (1A) of Example 5.

TABLE 7

| Sample | Coupler | Color Image Stabilizer I | Color Image Stabilizer II | Evaluation of Anti-staining Capacity: Density Increment 80° C.-70% RH, 15 days | Density Increment 100° C., 10 days | Density Increment Xe (200,000 lux), 3 days | Remarks |
|---|---|---|---|---|---|---|---|
| 1C | (45) | — | — | 0.21 | 0.23 | 0.80 | comparative example |
| 2C | (45) | comparative compound (a) | — | 0.20 | 0.21 | 0.82 | comparative sample |
| 3C | (45) | comparative compound (b) | — | 0.25 | 0.27 | 0.74 | comparative sample |
| 4C | (45) | comparative compound (a) | II-60 | 0.17 | 0.18 | 0.81 | comparative sample |
| 5C | (45) | comparative compound (b) | II-60 | 0.20 | 0.22 | 0.75 | comparative sample |
| 6C | (45) | I-3 | — | 0.18 | 0.17 | 0.85 | sample of the invention |
| 7C | (45) | I-4 | — | 0.16 | 0.17 | 0.86 | sample of the invention |
| 8C | (45) | I-8 | — | 0.17 | 0.18 | 0.87 | sample of the invention |
| 9C | (45) | I-3 | II-60 | 0.15 | 0.14 | 0.85 | sample of the invention |
| 10C | (45) | I-4 | II-60 | 0.13 | 0.13 | 0.85 | sample of the invention |
| 11C | (45) | I-8 | II-60 | 0.15 | 0.15 | 0.87 | sample of the invention |
| 12C | (48) | — | — | 0.22 | 0.24 | 0.78 | comparative sample |
| 13C | (48) | I-4 | — | 0.19 | 0.20 | 0.84 | sample of the invention |
| 14C | (48) | I-3 | II-60 | 0.15 | 0.14 | 0.85 | sample of the invention |
| 15C | (48) | I-4 | II-60 | 0.13 | 0.13 | 0.85 | sample of the invention |

From the results in Table 7 above, it is understood that the multi-layer photographic material samples of the present invention containing a coupler of formula (C-1) of the present invention where $R_0$ is a group of formula (R0-1) and color image stabilizer(s) of the present invention display an excellent anti-staining effect and that the amount of the coupler to be coated in these samples may well be reduced.

EXAMPLE 8

Photographic material samples, Sample Nos. 102 to 104 are prepared in the same manner as in the preparation of Sample No. 101 of Example 1 of JP-A-2-854 except that all the cyan couplers used in the third, fourth and fifth layers are replaced by the equal molar amount of cyan coupler (12), (14) or (31) of the present invention. Further, photographic material samples, Sample Nos. 105 to 116 are prepared by adding to the third, fourth and fifth layers of each of Sample Nos. 102 to 104 compound (I-1), (I-13), (I-18) or (I-23) of the present invention co-emulsified with the cyan coupler, in which the molar amount added of the cyan coupler is equal to that used in Sample No. 101 of JP-A-2-854 and the amount added of the compounds of the present invention is 25 mol % based on the amount of the cyan couplers.

Sample Nos. 101 to 116 are exposed and developed in the same manner as in Example 1 of JP-A-2-854, and the processed samples are subjected to the same anti-fading test as that mentioned hereinabove, whereupon the samples of the present invention have an excellent anti-fading effect and excellent photographic characteristics. From the results, it is understood that the compounds of formula (I) of the present invention are effective even in such photographic materials.

EXAMPLE 9

Photographic material samples, Sample Nos. 117 to 120 are prepared in the same manner as in the preparation of Sample No. 101 of Example 2 of JP-A-1-158431 except that all the cyan couplers used in the third, fourth and fifth layers are replaced by the equal molar amount of cyan coupler (12), (19), (25) or (26) of the present invention. Further, photographic material samples, Sample Nos. 121 to 136 are prepared by adding to the third, fourth and fifth layers of each of Sample Nos. 117 to 120 compound (I-1), (I-13), (I-18) or (I-23) of the present invention co-emulsified with the cyan coupler, in which the molar amount added of the cyan coupler is equal to that used in Example 2 of JP-A-1-158431 and the amount added of the compounds of the present invention is 25 mol % based on the amount of the cyan couplers.

These samples are exposed and developed in the same manner as in Example 2 of JP-A-1-158431, and the processed samples are subjected to the same anti-fading test as that mentioned hereinabove, whereupon the samples of the present invention show an excellent anti-fading effect and excellent photographic characteristics. From the results, it is understood that the compounds of formula (I) of the present invention are effective even in such photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material containing at least one cyan dye forming coupler of formula (C-1) and at least one compound of formula (I) in the same layer of the material:

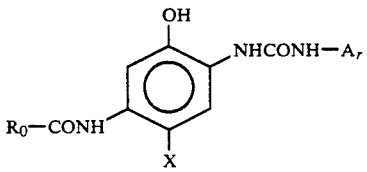

(C-1)

wherein $R_0$ represents an alkyl group, an alkenyl group, an aryl group, or a heterocyclic group;

X represents a hydrogen atom, or a group capable of being split off by a coupling reaction with the oxidation product of an aromatic primary amine color developing agent; and Ar represents an aromatic group;

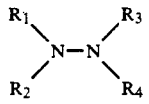

(I)

wherein $R_1$, $R_2$, $R_3$ and $R_4$ represents an alkyl group;

$R_1$ and $R_2$, or $R_3$ and $R_4$ may be directly bonded to each other to form a 5-membered to 8-membered ring along with the nitrogen atom in the formula;

provided that $R_1$ and $R_3$, or $R_2$ and $R_4$ are not bonded to each other to form a ring, and that the sum of the carbon atoms of $R_1$, $R_2$, $R_3$ and $R_4$ is 6 or more.

2. The silver halide color photographic material as in claim 1, which further contains at least one compound of formula (II) in the same layer along with coupler(s) of formula (C-1) and compound(s) of formula (I),

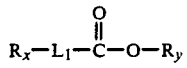

(II)

wherein

Rx represents an aliphatic group, an aryl group, or a heterocyclic group;

$L_1$ represents a single bond or —O—;

Ry represents an aryl group,

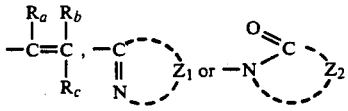

provided that when Ry is an aryl group, then —O—Ry is not a partial structure of a group useful as a photographic reducing agent;

Ra, Rb and Rc may be same as or different from one another and each represents a hydrogen atom, an aliphatic group, an aryl group, a heterocyclic group, an alkoxy group, an aryloxy group, a heterocyclic-oxy group, an alkylthio group, an arylthio group, a heterocyclic-thio group, an amino group, an alkylamino group, an acyl group, an amido group, a sulfonamido group, a sulfonyl group, an alkoxycarbonyl group, a sulfo group, a carboxyl group, a hydroxyl group, an acyloxy group, an ureido group, a urethane group, a carbamoyl group, or a sulfamoyl group;

Ra and Rb, or Rb and Rc may be bonded to each other form a 5-membered to 7-membered hetero ring, which may be substituted or may form a spiro ring or a bicyclo ring or may be condensed with an aromatic ring;

$Z_1$ and $Z_2$ each represent a nonmetal atomic group necessary for forming a 5-membered or 7-membered hetero ring, which may be substituted or may form a spiro ring or a bicyclo ring or may be condensed with an aromatic ring.

3. The silver halide color photographic material as in claim 2, in which the proportion of the total amount of compound(s) of formula (II) to cyan dye forming coupler(s) of formula (C-1) therein is 10 mol % or more.

4. The silver halide color photographic material as in claim 2, wherein compounds of formula (II) are used in a proportion from 0.5 to 300 mol % to a coupler of formula (C-1) in the same layer.

5. The silver halide color photographic material as in claim 2, wherein $R_x$ is an aliphatic group having from 6 to 40 carbon atoms.

6. The silver halide color photographic material as in claim 2, wherein $R_y$ is an aryl group or

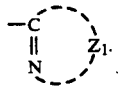

7. The silver halide color photographic material as in claim 6, wherein $Z_1$ is a nonmetal atomic group necessary for forming a 5-membered ring.

8. The silver halide color photographic material as in claim 6, wherein $R_y$ ia an aryl group substituted by a chlorine atom, a bromine atom, an alkoxycarbonyl group, a cyano group or a sulfonyl group.

9. The silver halide color photographic material as in claim 1, wherein $R_1$, $R_2$, $R_3$ and $R_4$ each represent an unsubstituted alkyl group or a substituted alkyl group having one or more substituents selected from the group consisting of an aliphatic group, an aryl group, a heterocyclic group, an acyl group, an acyloxy group, an acylamino group, an alkoxy group, an aryloxy group, a heterocyclic oxy group, an alkoxycarbonyl group, an aryloxycarbonyl group, a heterocyclic oxycarbonyl group, a carbamoyl group, an alkylsulfonyl group, an arylsulfonyl group, a sulfamoyl group, a sulfonamido group, an alkylamino group, an arylamino group, an alkylsulfinyl group, an arylsulfinyl group, an alkylthio group, an arylthio group, a mercapto group, a cyano group, a nitro group, a hydroxyamino group, and a halogen atom.

10. The silver halide color photographic material as claimed in claim 9, wherein $R_1$, $R_2$, $R_3$ and $R_4$ each represents an unsubstituted alkyl group or an alkyl group substituted by at least one of the substituents selected from the group consisting of an alkoxycarbonyl group, an alkoxy group, an alkylsulfonyl group, an alkylacylamino group, a carbamoyl group and a phenoxy group.

11. The silver halide color photographic material as in claim 1, wherein $R_0$ is an alkyl or an alkenyl group having from 1 to 36 carbon atoms, an aryl group having from 6 to 48 carbon atoms, or a heterocyclic group having from 2 to 48 carbon atoms.

12. The silver halide color photographic material as in claim 1, wherein $R_0$ is a tertiary alkyl group having from 4 to 36 carbon atoms, or a group of the following formula ($R_0$-1), ($R_0$-2), ($R_0$-3) or ($R_0$-4) having from 7 to 48 carbon atoms:

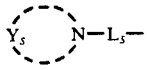

($R_0$-1)

where $Y_s$ represents a nonmetal atomic group necessary for forming a 3-membered to 8-membered hetero ring along with the nitrogen atom in the formula; and $L_s$ represents an alkylene group;

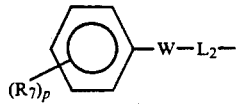

($R_0$-2)

where $L_2$ has the same meaning as $L_s$ in formula ($R_0$-1);

W represents —O—, —S—,

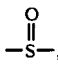

or $—SO_2—$;

$R_7$ represents a monovalent substituent; and

P represents 0 or an integer from 1 to 5, and when P is plural number, then plural $R_7$'s may be the same or different;

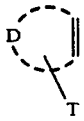

($R_0$-3)

wherein D represents a nonmetal atomic group necessary for forming a 3-membered to 8-membered hetero ring along with the carbon-carbon double bond in the formula, and the ring may optionally be a condensed ring, and T represents a substituent;

$R_8—Q—SO_2—L_3$ ($R_0$-4)

where $R_8$ represents an alkyl group having from 1 to 30 carbon atoms, or an aryl group having from 6 to 30 carbon atoms;

Q represents —NH—, —S—, —O— or a single bond; and $L_3$ has the same meaning as $L_s$ in formula ($R_0$-1).

13. The silver halide color photographic material as in claim 12, wherein the 3-membered to 8-membered hetero ring to be formed by $Y_s$ is a 3-membered to 8-membered monocyclic or condensed ring having from 1 to 30 carbon atoms and further containing N, O, S, So, To or combinations thereof in the ring.

14. The silver halide color photographic material as in claim 13, wherein the monocyclic ring is a 1-pyrrolyl group, a 1-imidazolyl group, a 1-pyrazolyl group, a 1,2,4-triazol-1-yl group, a 1,2,4-triazol-4-yl group, a 1,2,3-triazol-1-yl group, a 1,2,3,4-tetrazol-1-yl group, a 1,2,3,4-tetrazol-2-yl group, or a 4-pyridon-1-yl group; and the condensed ring is an indol-1-yl group, an indazol-1-yl group, a benzimidazol-1-yl group, a benzotriazol-1-yl group, a benzotriazol-1-yl group, a carbazolyl group, a purin-1-yl group, or a xanthen-1-yl group.

15. The silver halide color photographic material as in claim 12, wherein $L_s$ is a group of formula ($L_s$-1):

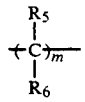

($L_s$-1)

where $R_3$ and $R_6$ each represent a hydrogen atom, an alkyl group, a cycloalkyl group, an aryl group, an alkoxy group, an aryloxy group, or an alkoxycarbonyl group; and m represents an integer from 1 to 6; when m is a plural number, then plural $R_5$'s and $R_6$'s each may be the same or different.

16. The silver halide color photographic material as in claim 15, wherein $R_5$ is a hydrogen atom and $R_6$ is an alkyl group having from 4 to 25 carbon atoms.

17. The silver halide color photographic material as in claim 12, wherein $R_7$ is a halogen atom, an alkyl group, an alkoxy group, a carbonamido group, a sulfonamido group, a carboxyl group, a sulfo group, a cyano group, a hydroxyl group, a carbamoyl group, a sulfamoyl group, an alkoxycarbonyl group, or an arylsulfonyl group.

18. The silver halide color photographic material as in claim 12, wherein T is an alkoxy group, an alkoxycarbonyl group, an alkylthio group or an alkylsulfonyl group.

19. The silver halide color photographic material as in claim 12, wherein $R_8$ is a straight chain or branched alkyl group having from 1 to 24 carbon atoms.

20. The silver halide color photographic material as in claim 1, wherein in formula (C-1), Ar is an aryl group having from 6 to 36 carbon atoms.

21. The silver halide color photographic material as in claim 20, wherein the aryl group is substituted by substituents selected from the group consisting of a halogen atom, a hydroxyl group, a carboxyl group, a sulfo group, a cyano group, a nitro group, an amino group, an alkyl group, an alkenyl group, an alkynyl group, a cycloalkyl group, an aryl group, an alkoxy group, an aryloxy group, an alkylthio group, an arylthio group, an alkylsulfonyl group, an arysulfonyl group, an acyl group, an acyloxy group, an alkoxycarbonyl group, an aryloxycarbonyl group, a carbonamido group, a sulfonamido group, a carbamoyl group, a sulfamoyl group, a ureido group, an alkoxycarbonyl group, a sulfamoylamino group, an alkoxysulfonyl group, an imido group and a heterocyclic group.

22. The silver halide color photographic material as in claim 1, wherein a coupler of formula (C-I) is present in an amount from 0.001 to 1 mol, per mol of light-sensitive silver halide.

23. The silver halide color photographic material as in claim 1, wherein a compound of formula (I) has from 6 to 60 carbon atoms.

24. The silver halide color photographic material as in claim 1, wherein the amount of the compounds of formula (I) for use in the present invention is from 0.5 to 300 mol %, to a coupler to be used together therewith.

25. The silver halide color photographic material as in claim 1, wherein the alkyl groups for $R_1$ and $R_2$ or the alkyl groups for $R_3$ and $R_4$ are bonded directly to each other to form a 5-membered to 8-membered ring.

26. The silver halide color photographic material as in claim 25, wherein the 5-membered to 8-membered ring is a piperidine ring.

* * * * *